US005780198A

United States Patent [19]

Goto et al.

[11] Patent Number: 5,780,198

[45] Date of Patent: *Jul. 14, 1998

[54] SILVER HALIDE PHOTOGRAPHIC MATERIAL

[75] Inventors: Takahiro Goto; Kazunobu Katoh; Minoru Sakai, all of Kanagawa, Japan

[73] Assignee: Fuji Photo Film Co., Ltd., Kanagawa, Japan

[ * ] Notice: The term of this patent shall not extend beyond the expiration date of Pat. No. 5,085,971.

[21] Appl. No.: 389,728

[22] Filed: Feb. 15, 1995

Related U.S. Application Data

[63] Continuation of Ser. No. 950,761, Sep. 24, 1992, abandoned, which is a continuation of Ser. No. 584,029, Sep. 18, 1990, abandoned.

[30] Foreign Application Priority Data

| | | | |
|---|---|---|---|
| Sep. 18, 1989 | [JP] | Japan | 1-240966 |
| Nov. 8, 1989 | [JP] | Japan | 1-290564 |
| Nov. 9, 1989 | [JP] | Japan | 1-291783 |

[51] Int. Cl.[6] ..... G03C 1/06

[52] U.S. Cl. ..... 430/264; 430/222; 430/223; 430/502; 430/506; 430/509; 430/544; 430/566; 430/572; 430/598; 430/957

[58] Field of Search ..... 430/222, 223, 430/264, 502, 506, 509, 544, 566, 572, 598, 957

[56] References Cited

U.S. PATENT DOCUMENTS

| | | | |
|---|---|---|---|
| 4,684,604 | 8/1987 | Hardner | 430/375 |
| 4,761,362 | 8/1988 | Sasaoka et al. | 430/264 |
| 4,914,002 | 4/1990 | Inoue et al. | 430/264 |
| 4,956,257 | 9/1990 | Inoue | 430/264 |
| 5,085,971 | 2/1992 | Katoh et al. | 430/264 |
| 5,124,231 | 6/1992 | Sakai et al. | 430/222 |
| 5,155,006 | 10/1992 | Goto et al. | 430/223 |
| 5,190,850 | 3/1993 | Sakai et al. | 430/223 |
| 5,230,983 | 7/1993 | Inoue et al. | 430/264 |
| 5,395,732 | 3/1995 | Katoh et al. | 430/264 |

FOREIGN PATENT DOCUMENTS

| | | | |
|---|---|---|---|
| 61-213847 | 9/1986 | Japan | 430/598 |
| 3713042 | 10/1987 | Japan | G03C 1/06 |
| 62-245263 | 10/1987 | Japan | 430/957 |
| 63-046450 | 2/1988 | Japan | 430/544 |
| 1-072140 | 3/1989 | Japan | 430/569 |
| 72140 | 3/1989 | Japan | G03C 1/02 |

OTHER PUBLICATIONS

Unexamined Published Japanese Patent Application No SHO-64-72140 (Partial Translation).

European Search Report English Abstract of JP-A-1-72140.

*Primary Examiner*—Thorl Chea

*Attorney, Agent, or Firm*—Sughrue, Mion, Zinn, Macpeak & Seas, PLLC

[57] ABSTRACT

A silver halide photographic material comprising a plurality of light-sensitive silver halide emulsion layers, wherein (A) at least one of the layers contains a hydrazine nucleating agent represented by formula (II):

(II)

wherein $R_1$ represents an aliphatic group or an aromatic group; $R_2$ represents a hydrogen atom, an alkyl group, an aryl group, an alkoxy group, an aryloxy group, an amino group, a hydrazine group, a carbamoyl group, or an oxycarbonyl group; $G_1$ represents a carbonyl group, a sulfonyl group, a sulfinyl group, a sulfoxy group, a thiocarbonyl group, or an iminomethylene group; and $A_3$ and $A_4$ each represents a hydrogen atom, a substituted or unsubstituted alkylsulfonyl group, a substituted or unsubstituted arylsulfonyl group, or a substituted or unsubstituted acyl group, provided that at least one of $A_3$ and $A_4$ is a hydrogen atom; and (B) another layer contains a redox compound capable of releasing a development inhibitor when the redox compound is oxidized. The photographic material can be processed with a highly stable developing solution and provides an ultrahigh contrast image with broad dot gradation.

2 Claims, 1 Drawing Sheet

FIGURE
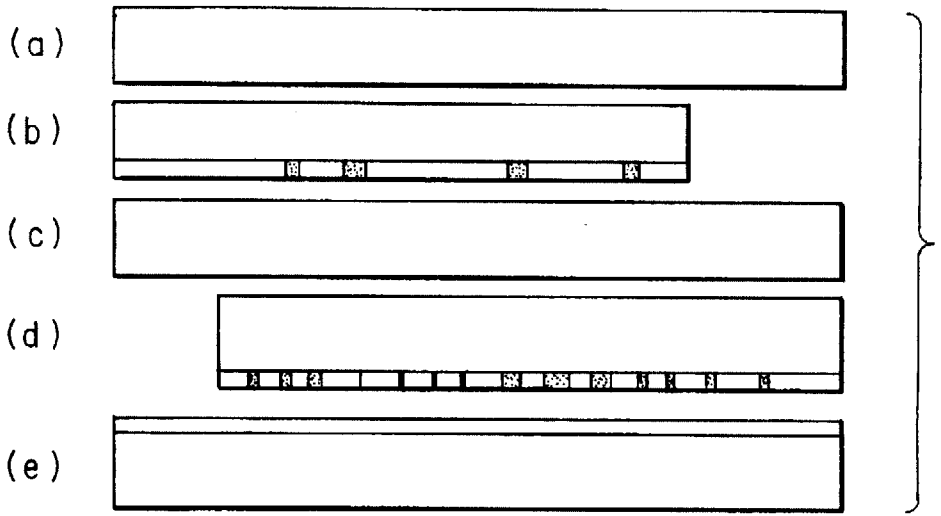

SILVER HALIDE PHOTOGRAPHIC MATERIAL

This is a Continuation of application Ser. No. 07/950,761 filed Sep. 24, 1992, now abandoned, which is a Continuation of application Ser. No. 07/584,029 filed Sep. 18, 1990, which is now abandoned.

FIELD OF THE INVENTION

This invention relates to silver halide photographic materials and a method of forming an ultrahigh contrast negative image. More particularly, it relates to ultrahigh contrast negative silver halide photographic materials suitable for use in photomechanical reproduction processes.

BACKGROUND OF THE INVENTION

In the field of photomechanical reproduction, there is a long-standing need for photographic light-sensitive materials having satisfactory image reproducibility and that can be suitably developed using stable processing solutions and simplified replenishment systems, in order to provide high reproduction quality of diverse and complex printed materials.

In particular, originals to be photographically reproduced in line work comprise photo-composed letters, handwritten letters, illustrations, dot prints, and other materials containing images having different densities and/or line widths. There has been a need, therefore, to develop a process camera, photographic light-sensitive material, or image formation system which would enable one to accurately reproduce an original having variable resolution of dot size and spacing. In the photomechanical reproduction of catalogues or large posters, on the other hand, enlargement or reduction of a dot print is routinely done. When a dot print is enlarged in plate making, the line number becomes reduced and the dots become blurred. When a dot print is reduced, the line number/inch increases and the dots become smaller. Accordingly, an image formation system that compensates for problems associated with both enlargement and reduction has been sought that results in accurate reproduction of dot gradation.

A halogen lamp or a xenon lamp can be employed as a light source for a process camera. In order to obtain sufficient photographic sensitivity to such light sources, photographic materials are usually subjected to orthochromatic sensitization. However, orthochromatic materials are more susceptible to influences of chromatic lens aberration and thus are likely to suffer from poor reproduction of image quality. Such deterioration is conspicuous when a xenon lamp is used as a light source.

Known photopathic reproduction systems which have been found to accurately reproduce both enlargements and reductions of printed materials include a method comprising processing a lith silver halide light-sensitive material comprised of silver chlorobromide (comprising at least 50% silver chloride) with a hydroquinone developer having an extremely low sulfite ion effective concentration (usually 0.1 mol/l or less), used to thereby obtain a line or dot image having high contrast and density in which reproduced image areas and non-image areas are clearly distinguished. According to this method, however, development of such reproductions is extremely unstable due to air oxidation caused by low sulfite concentration of the developer. Hence, due to such instability, it has been necessary to make various efforts have been made to develop compounds and devices that either stabilize development or considerably reduce processing speed, with the disadvantage of reducing working efficiency.

There has thus been a need to establish a reproduction system which eliminates image formation instability associated with the above-described lith development system and which also provides ultrahigh contrast images by utilizing a processing solution having satisfactory preservation stability. In this context, it has been proposed to develop a surface latent image type silver halide photographic material containing a specific acylhydrazine compound with a developing solution having a pH between 11.0 and 12.3 and containing at least 0.15 mol/l of a sulfite preservative, thereby exhibiting satisfactory preservation stability to form ultrahigh contrast negative images having a gamma (γ) exceeding 10 as disclosed in U.S. Pat. Nos. 4,166,742, 4,168,977, 4,221,857, 4,224,401, 4,243,739, 4,272,606, and 4,311,781. This image formation system is characterized in that silver iodobromide and silver chloroiodobromide, as well as silver chlorobromide, are applicable thereto, whereas conventional ultrahigh contrast image formation systems are applicable only to photographic materials comprising silver chlorobromide having a high silver chloride content.

While the above-described image formation system provides images having excellent sharpness of dot resolution, processing stability, speed of processing, and reproducibility of originals, the recent increase in diversity of printed materials has resulted in the need for further improvement in the reproducibility of originals.

In an attempt to broaden gradation latitude, a method of using a redox compound capable of releasing a photographically useful group has been suggested as disclosed, e.g., in JP-A-61-213847 (the term "JP-A" as used herein means an "unexamined published Japanese patent application") and U.S. Pat. No. 4,684,604. However, these redox compounds, when used in ultrahigh contrast processing systems, act to hinder increased contrast and thus their desirable characteristics could not be fully utilized.

SUMMARY OF THE INVENTION

Accordingly, one object of this invention is to provide a light-sensitive material for photomechanical processing which provides high contrast images while utilizing highly stable developing solutions.

Another object of this invention is to provide light-sensitive materials for photomechanical processing which have a broad dot gradation latitude.

A further object of this invention is to provide high contrast light-sensitive materials for photomechanical processing which contain a hydrazine nucleating agent and have broad dot gradation latitude.

The above objects of this invention are accomplished by a silver halide photographic material comprising a plurality of light-sensitive silver halide emulsion layers, in which at least one of the layers contains a hydrazine nucleating agent represented by formula (II):

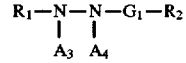

$$R_1-\underset{\underset{A_3}{|}}{N}-\underset{\underset{A_4}{|}}{N}-G_1-R_2 \qquad \text{(II)}$$

wherein $R_1$ represents an aliphatic group or an aromatic group; $R_2$ represents a hydrogen atom, an alkyl group, an aryl group, an alkoxy group, an aryloxy group, an amino group, a hydrazino group, a carbamoyl group, or an oxycarbonyl group; $G_1$ represents a carbonyl group, a sulfonyl group, a sulfinyl group, a sulfoxy group,

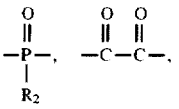

a thiocarbonyl group, or an iminomethylene group; and $A_3$ and $A_4$ each represents a hydrogen atom, a substituted or unsubstituted alkylsulfonyl group, a substituted or unsubstituted arylsulfonyl group, or a substituted or unsubstituted acyl group, provided that at least one of $A_3$ and $A_4$ is a hydrogen atom, and at least one other layer contains a redox compound capable of releasing a development inhibitor on oxidation.

BRIEF DESCRIPTION OF THE DRAWING

The FIGURE shows the relation between a light-sensitive material according to the present invention for dot-to-dot work and originals, at the time of exposure, in the formation of a superimposed letter image by contact work, in which (a) is a transparent or semi-transparent base for layout, (b) is a line image original (the black part indicates a line image), (c) is a transparent or semi-transparent base for layout, (d) is a dot original (the black part indicates dots), and (e) is a light-sensitive material for contact-work.

DETAILED DESCRIPTION OF THE INVENTION

Redox compounds capable of releasing a developing inhibitor on oxidation contain, as a redox group, hydroquinones, catechols, naphthohydroquinones, aminophenols, pyrazolidones, hydrazines, hydroxylamines, and reductones. Preferred redox compounds are those containing a hydrazine as a redox group. More preferred are those represented by formula (I):

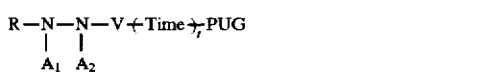

(I)

wherein $A_1$ and $A_2$ each represents a hydrogen atom, a sulfinic acid residue,

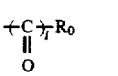

(wherein $R_0$ represents an alkyl group, an alkenyl group, an aryl group, an alkoxy group, or an aryloxy group; and 1 represents 1 or 2), or an unsubstituted acyl group; Time represents a divalent linking group; t represents 0 or 1; PUG (photographically useful group) represents a residue of a development inhibitor; and V represents a carbonyl group,

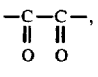

a sulfonyl group, a sulfinyl group, a sulfoxy group,

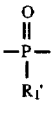

(wherein $R_1'$ represents an alkoxy group, an aryloxy group, or an amino group), an iminomethylene group, or a thiocarbonyl group; R represents an aliphatic group, an aromatic group, or a heterocyclic group.

In formula (I), $A_1$ and $A_2$ each represents a hydrogen atom, an alkylsulfonyl or arylsulfonyl group having not more than 20 carbon atoms (preferably a phenylsulfonyl group or a phenylsulfonyl group which is substituted so that a sum of Hammett's σ values may be about −0.5 or more), or

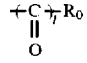

(wherein $R_0$ preferably contains not more than 30 carbon atoms and represents a straight chain, branched or cyclic alkyl group, an alkenyl group, an aryl group (preferably a phenyl group or a phenyl group which is substituted so that the sum of the Hammett's σ values may be about −0.5 or more), an alkoxy group (e.g., ethoxy), or an aryloxy group (preferably monocyclic), each of which has not more than 30 carbon atoms, provided that at least one of $A_1$ and $A_2$ is a hydrogen atom. These groups, other than a hydrogen atom, may have a substituent selected from, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an aryloxycarbonyl group, an acyl group, an alkoxycarbonyl group, an acyloxy group, a carbonamido group, a sulfonamido group, and a nitro group, each of which may further be substituted.

Specific examples of the sulfinic acid residue as represented by $A_1$ or $A_2$ are described in U.S. Pat. No. 4,478,928.

$A_1$ may be taken together with $-(Time)_t-$ to form a ring.

$A_1$ and $A_2$ each preferably represents a hydrogen atom.

The "Time" group in formula (I) represents a divalent linking group which may have a timing control function. t represents 0 or 1, and when t=0, PUG is directly bonded to V.

The divalent linking group Time is capable of releasing a photographically useful group (PUG) through one or more steps from Time-PUG which is released from an oxidation product of the oxidation-reduction nucleus.

Examples of the divalent linking groups, as represented by Time, include a group which releases PUG on intramolecular cyclization of a p-nitrophenoxy derivative, e.g., as disclosed in U.S. Pat. No. 4,248,962 (corresponding to JP-A-54-145135); a group which releases a PUG on intramolecular cyclization, subsequent to ring opening, as disclosed, e.g., in U.S. Pat. No. 4,310,612 (corresponding to JP-A-55-5330) and U.S. Pat. No. 4,358,252; a group which releases PUG on intramolecular cyclization of a carboxyl group of a succinic monoester or an analogue thereof together with formation of an acid anhydride, as disclosed, e.g., in U.S. Pat. Nos. 4,330,617, 4,446,216 and 4,483,919 and JP-A-59-121328; a group which releases PUG while forming quinomonomethane, or an analogue thereof, through electron transfer via a double bond conjugated with an aryloxy group or a heterocyclic oxy group as disclosed, e.g., in U.S. Pat. Nos. 4,409,323 and 4,421,845, Research Disclosure, No. 21228 (December 1981), U.S. Pat. No. 4,416,977 (corresponding to JP-A-57-135944), JP-A-58-209736, and JP-A-58-209738; a group which releases PUG from a nitrogen-containing heterocyclic ring through electron transfer in the moiety having an enamine structure (release is from the γ-position of the enamine) as disclosed, e.g., in U.S. Pat. No. 4,420,554 (corresponding to JP-A-57-

136640), JP-A-57-135945, JP-A-57-188035, JP-A-58-98728, and JP-A-58-209737; a group which releases PUG on intramolecular cyclization of an oxy group formed through electron transfer to a carbonyl group conjugated with a nitrogen group of a nitrogen-containing hetero ring as disclosed in JP-A-57-56837; a group which releases PUG while forming an aldehyde as disclosed in U.S. Pat. No. 4,146,396 (corresponding to JP-A-52- 90932), JP-A-59-93442 and JP-A-59-75475; a group which releases PUG on decarboxylation as disclosed in JP-A-51-146828, JP-A-57-179842, and JP-A-59-104641; a group having a structure of —O—$COOCR_2R_b$-PUG which releases PUG on decarboxylation followed by formation of an aldehyde; a group which releases PUG while forming an isocyanate as disclosed in JP-A-60-7429; and a group which releases PUG on coupling reaction with an oxidation product of a color developing agent as disclosed in U.S. Pat. No. 4,438,193.

Specific examples of these divalent linking groups as Time are given in JP-A-61-236549 and JP-A-1-269936. Examples of preferred divalent linking groups as Time are shown below. In the following formulae, the asterisk mark * indicates the position at which V is bonded, and the double asterisk mark ** indicates the position at which PUG is bonded.

T-(1)

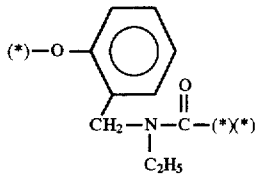

T-(2)

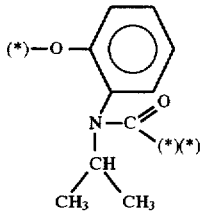

T-(3)

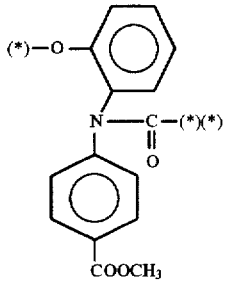

T-(4)

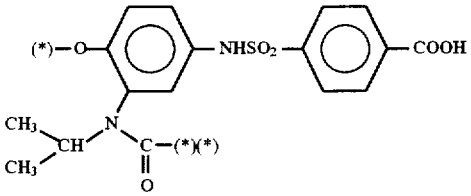

-continued

T-(5)

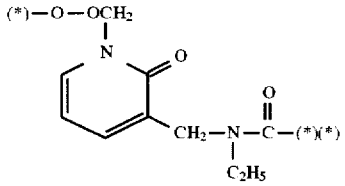

T-(6)

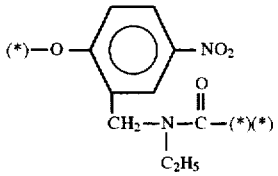

T-(7)

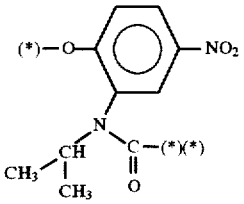

T-(8)

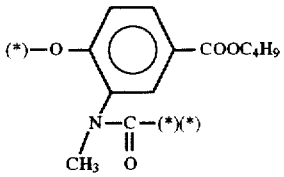

T-(9)

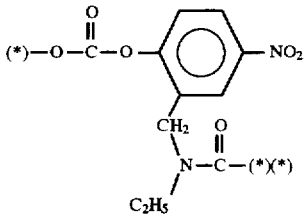

T-(10)

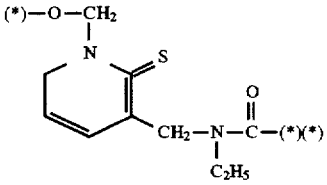

T(11)

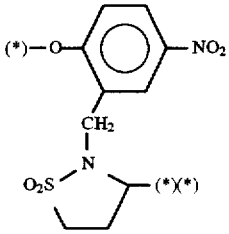

T(12)

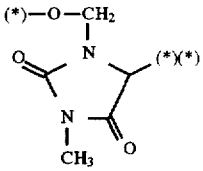

-continued
T-(13)
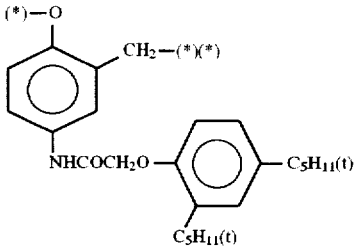
T-(14)
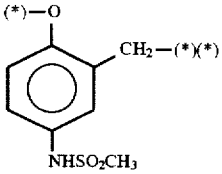
T-(15)
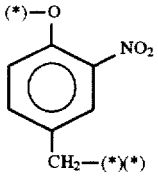
T-(16)
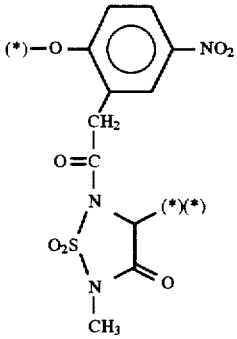
T-(17)
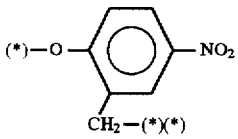
T-(18)
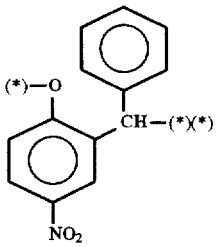
T-(19)
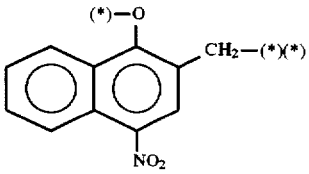
-continued
T-(20)
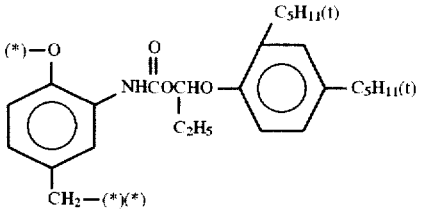
T-(21)
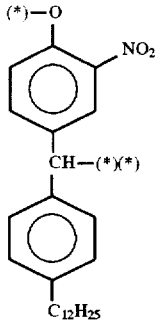
T-(22)
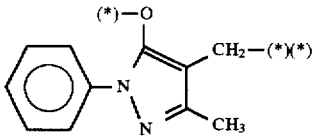
T-(23)
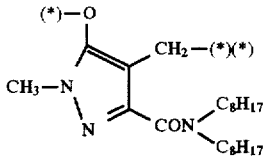
T-(24)
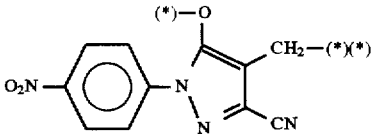
T-(25)
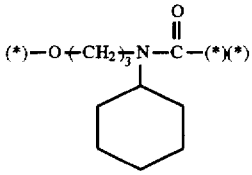
T-(26)
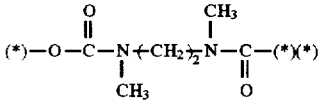
T-(27)
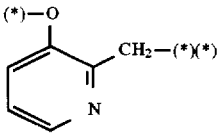

-continued

T-(28)

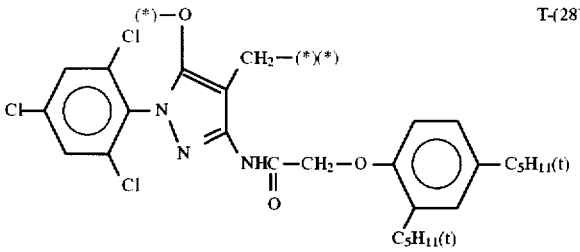

T-(29)

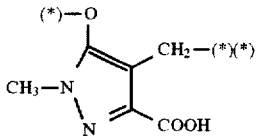

T-(30)

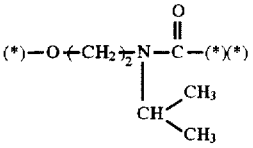

T-(31)

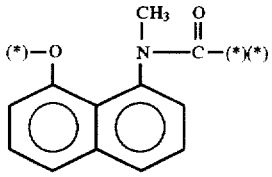

T-(32)

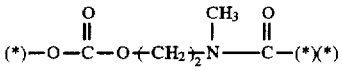

T-(33)

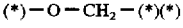

T-(34)

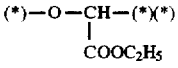

T-(35)

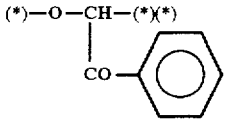

T-(36)

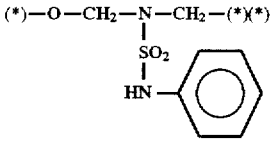

T-(37)

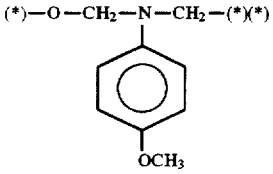

T-(38)

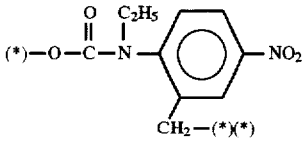

-continued

T-(39)

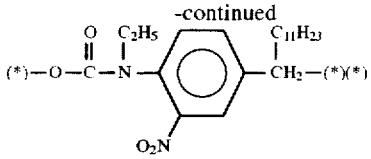

T-(40)

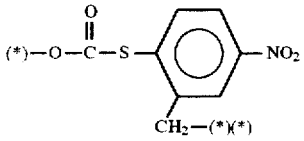

T-(41)

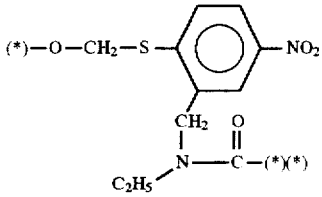

T-(41)

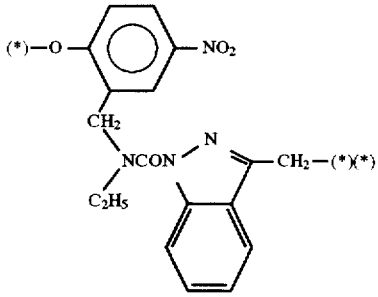

PUG represents a group having a development inhibitory effect either as (Time-)$_t$PUG or PUG.

The development inhibitor represented by PUG or (Time-)$_t$PUG is a known development inhibitor containing a hetero atom via which it is bonded to Time or V. Examples of such a development inhibitor are described, e.g., in C. E. K. Mees and T. H. James, *The Theory of Photographic Processes*, 3rd Ed., pp. 344–346, MacMillan (1966). More specifically, the development inhibitor includes mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetraazaindenes, triazaindenes, and mercaptoaryls.

The development inhibitor, as represented by PUG may have a substituent selected from, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group, a sulfoxy group, a phosphono group, a phosphinico group, and a phosphoramido group. These groups may further be substituted. Of these substituents, preferred are a nitro group, a sulfo group, a carboxyl group, a sulfamoyl group, a phosphono group, a phosphinico group, and a sulfonamido group.

Development inhibitors represented by PUG which may be used in the present invention include, but are not limited to, the following specific examples.

1. Mercaptotetrazole Derivatives:
(1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotriazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-|4-(2-Hydroxyethoxy)phenyl|-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(α-Naphthyl)-5-mercaptotetrazole
(19) 1-(4-Sulfophenyl)-5-mercaptotetrazole
(20) 1-(3-Sulfophenyl)-5-mercaptotetrazole
(21) 1-(β-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole hydrochloride
(32) 1-(2-Diethylaminoethyl)-5-mercaptotetrazole
(33) 2-(5-Mercapto-1-tetrazole)ethyltrimethylammonium chloride
(34) 1-(3-Phenoxycarbonylphenyl)-5-mercaptotetrazole
(35) 1-(3-Maleinimidophenyl)-5-mercaptotetrazole
2. Mercaptotriazole Derivatives:
(1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-Naphthyl)-3-mercaptotriazole
(8) 4-(4-Sulfophenyl)-3-mercaptotriazole
(9) 4-(3-Nitrophenyl)-3-mercaptotriazole
3. Mercaptoimidazole Derivatives:
(1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole
4. Mercaptopyrimidine Derivatives:
(1) Thiouracil
(2) Methylthiouracil
(3) Ethylthiouracil
(4) Propylthiouracil
(5) Nonylthiouracil
(6) Aminothiouracil
(7) Hydroxythiouracil
5. Mercaptobenzimidazole Derivatives:
(1) 2-Mercaptobenzimidazole
(2) 5-Carboxyl-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthoimidazole
(8) 2-Mercapto-5-sulfobenzimidazole
(9) 1-(2-Hydroxyethyl)-2-mercaptobenzimidazole
(10) 5-Capronamido-2-mercaptobenzimidazole
(11) 5-(2-Ethylhexanoylamino)-2-mercaptobenzimidazole
6. Mercaptothiadiazole Derivatives:
(1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole
7. Mercaptobenzothiazole Derivatives:
(1) 2-Mercaptobenzothiazole
(2) 5-Nitro-2-mercaptobenzothiazole
(3) 5-Carboxyl-2-mercaptobenzothiazole
(4) 5-Sulfo-2-mercaptobenzothiazole
8. Mercaptobenzoxazole Derivatives:
(1) 2-Mercaptobenzoxazole
(2) 5-Nitro-2-mercaptobenzoxazole
(3) 5-Carboxyl-2-mercaptobenzoxazole
(4) 5-Sulfo-2-mercaptobenzoxazole
9. Benzotriazole Derivatives:
(1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5 ,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Carboxybenzotriazole
(12) 5-Sulfobenzotriazole Na salt
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole
10. Benzimidazole Derivatives:
(1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5, 6-Dimethylbenzimidazole
(8) 5-Nitro-2-(trifluoromethyl)benzimidazole
11. Indazole Derivatives:
(1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-Chloroindazole
(8) 3-Chloro-5-nitroindazole
(9) 3-Carboxyl-5-nitroindazole
12. Tetrazole Derivatives:
(1) 5-(4-Nitrophenyl)tetrazole
(2) 5-Phenyltetrazole (3) 5-(3-Carboxyphenyl)tetrazole 13. Tetraazaindene Derivatives:

(1) 4-Hydroxy-6-methyl-5-nitro-1,3,3a,7-tetraazaindene (2) 4-Mercapto-6-methyl-5-nitro-1,3,3a,7-tetraazaindene 14. Mercaptoaryl Derivatives:

(1) 4-Nitrothiophenol (2) Thiophenol (3) 2-Carboxythiophenol

V in formula (I) represents a carbonyl group,

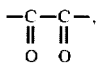

a sulfonyl group, a sulfinyl group, a sulfoxy group,

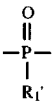

(wherein $R_{14}$ represents an alkoxy group, an aryloxy group, or an amino group), an iminomethylene group, or a thiocarbonyl group. V preferably represents a carbonyl group.

R in formula (I) represents an aliphatic group, an aromatic group, or a heterocyclic group. The aliphatic group as represented by R is a straight chain, branched or cyclic alkyl, alkenyl or alkynyl group preferably containing from 1 to 30 carbon atoms, and particularly from 1 to 20 carbon atoms. The branched alkyl group may be cyclized to form a saturated heterocyclic ring containing at least one hetero atom. Specific examples of the aliphatic group for R are methyl, t-butyl, n-octyl, t-octyl, cyclohexyl, hexenyl, pyrrolidinyl, tetrahydrofuryl, and n-dodecyl groups.

The aromatic group represented by R is a monocyclic or bicyclic aryl group, e.g., a phenyl group and a naphthyl group.

The heterocyclic group represented by R is a 3- to 10-membered saturated or unsaturated heterocyclic ring containing at least one of nitrogen, oxygen and sulfur atoms. The heterocyclic group may be monocyclic or may form a condensed ring with other aromatic rings or heterocyclic rings. Examples of preferred heterocyclic rings are 5- to 6-membered aromatic heterocyclic rings, e.g., pyridine, imidazolyl, quinolinyl, benzimidazolyl, pyrimidinyl, pyrazolyl, isoquinolinyl, benzothiazolyl, and thiazolyl groups.

The groups for R may have a substituent selected from, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, alkylthio group, an arylthio group, a sulfothio group, a sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group, and a phosphoramide group. These substituents may further be substituted.

R or $-(Time-)_t PUG$ in formula (I) may contain therein a ballast group generally employed in nondiffusible, photographically useful additives, such as couplers, or a group which accelerates adsorption onto silver halides (hereinafter referred to as an adsorption accelerating group).

Ballast groups are organic groups having a sufficient molecular size for substantially preventing the compound of formula (I) from diffusing into other layers or processing solutions. It comprises at least one of an alkyl group, an aryl group, a heterocyclic group, an ether group, a thioether group, an amido group, a ureido group, a urethane group, a sulfonamido group, or other suitable group. Preferred ballast groups are those having a substituted benzene ring, and, more preferably, those having a benzene ring substituted with a branched alkyl group.

Examples of suitable adsorption accelerating groups include a cyclic thioamido group (e.g., 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione, benzothiazoline-2-thione, thiotriazine, and 1,3-imidazolin-2-thione), an acyclic thioamido group, an aliphatic mercapto group, a heterocyclic mercapto group (a group wherein the carbon atom on which —SH is bonded is adjacent to a nitrogen atom (having the same meaning as a cyclic thioamido group), a tautomeric isomer of the heterocyclic mercapto group, and specific examples of such a group are the same as those enumerated above), a group having a disulfide linkage, a nitrogen-containing heterocyclic group comprising a combination of nitrogen, oxygen, sulfur and carbon atoms (e.g., benzotriazole, triazole, tetrazole, indazole, benzimidazole, imidazole, benzothiazole, thiazole, thiazoline, benzoxazole, oxazole, oxazoline, thiadiazole, oxathiazole, triazine, and azaindene), and a heterocyclic ring quaternary salt (e.g., benzimidazolinium). These groups may further be substituted with an appropriate substituent. Examples of suitable substituents include those mentioned with respect to the substituents of R.

Specific examples of redox compounds which can be used in the present invention are presented below for illustrative purposes, but redox compounds suitable for use in the present invention are not limited to these examples.

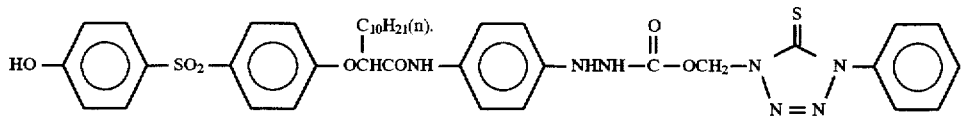

I-1

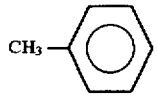

I-1

-continued
I-2
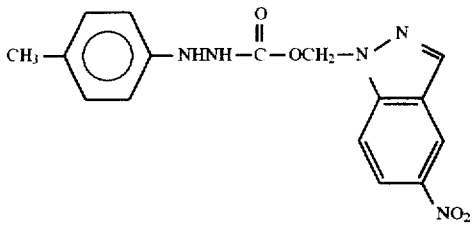
I-3
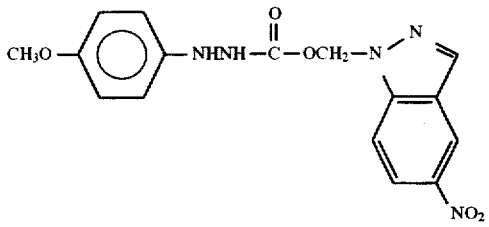
I-4
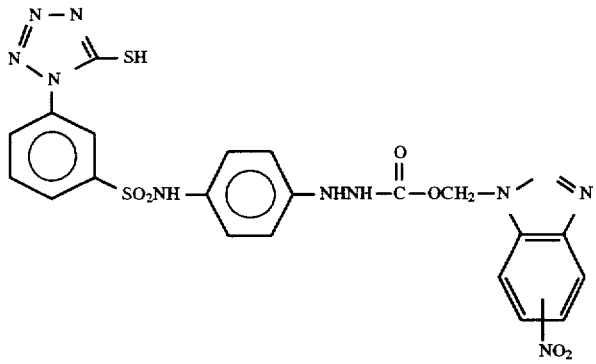
I-5
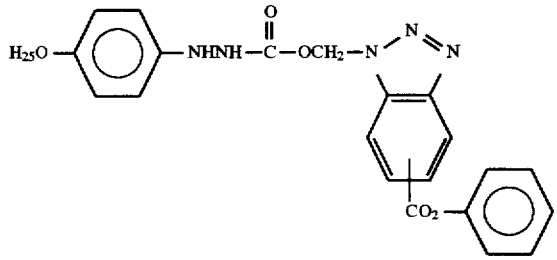
I-6
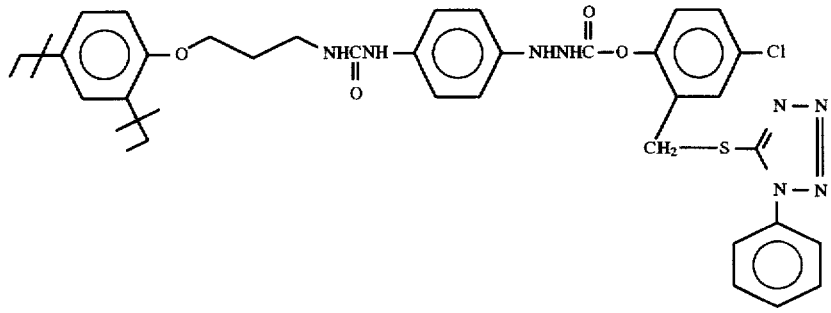
I-7
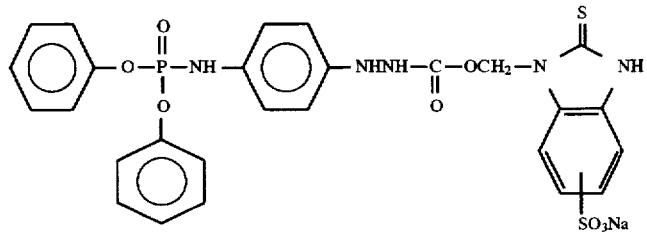

-continued
I-8
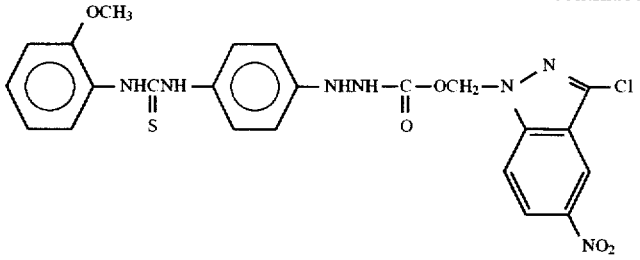
I-9
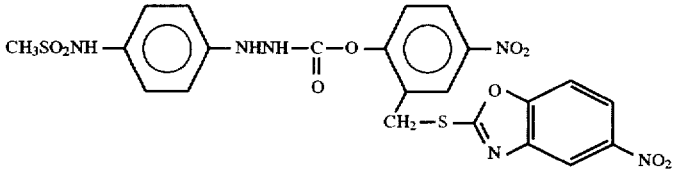
I-10
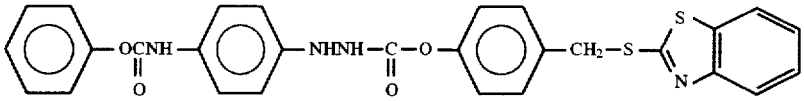
I-11
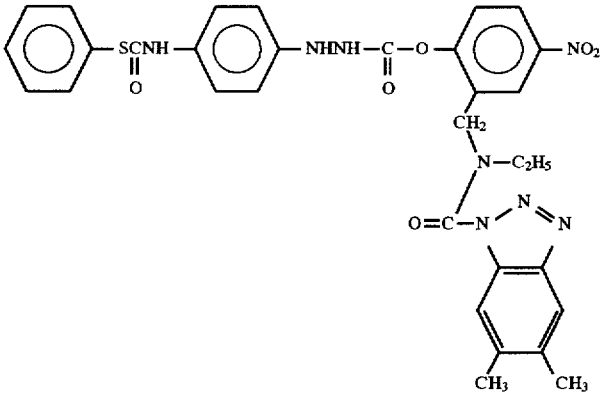
I-12
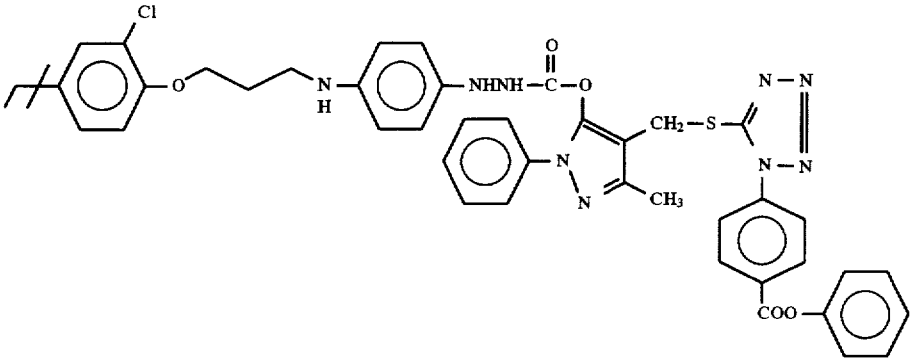
I-13
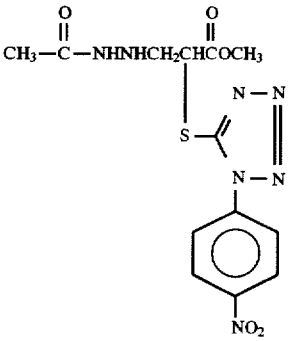

-continued
I-14
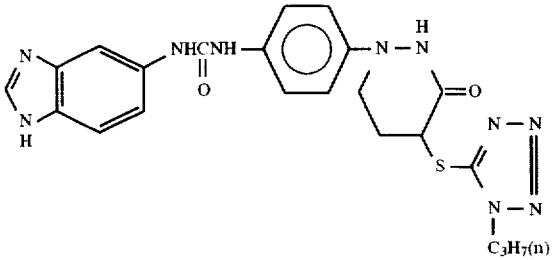
I-15
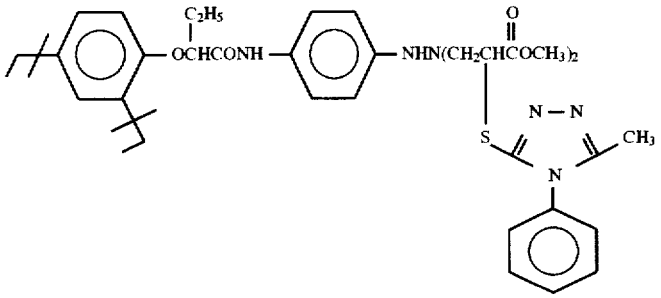
I-16
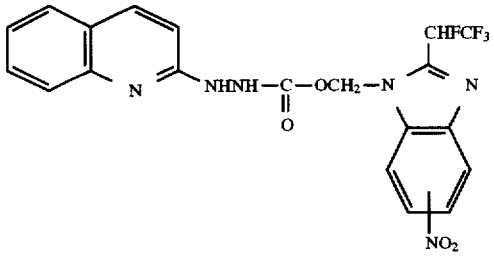
I-17
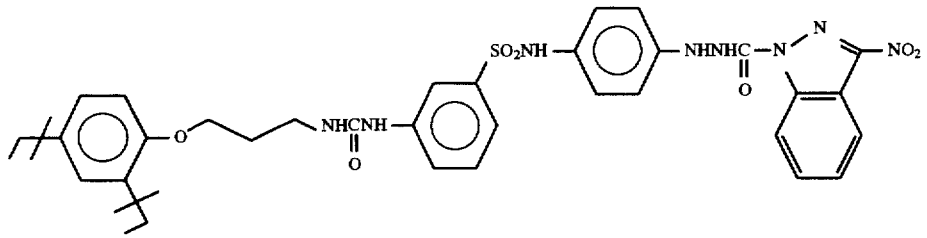
I-18
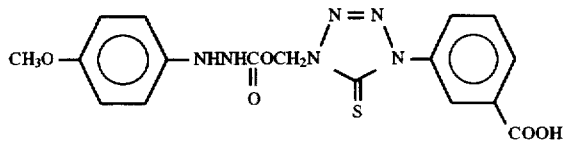
I-19
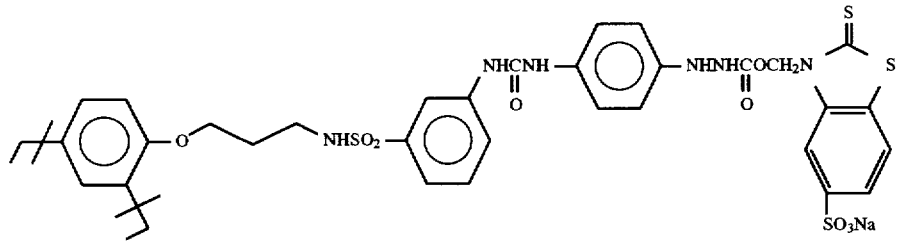
I-20
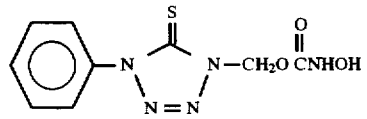

-continued
I-21
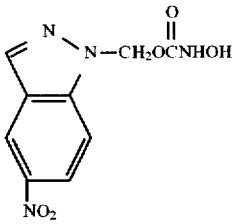
I-22
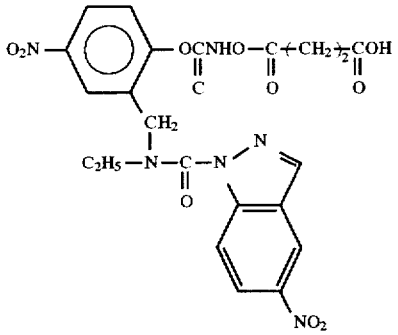
I-23
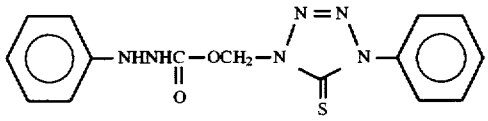
I-24
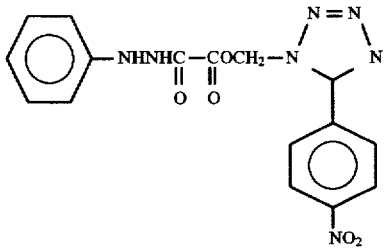
I-25
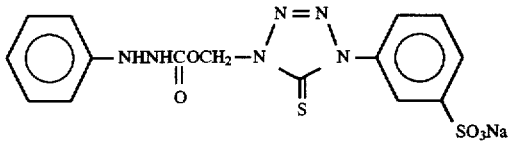
I-26
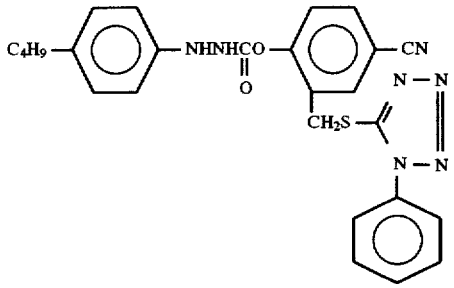
I-27
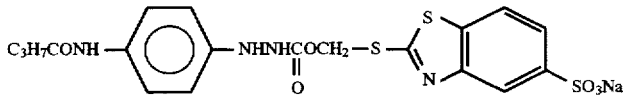
I-28
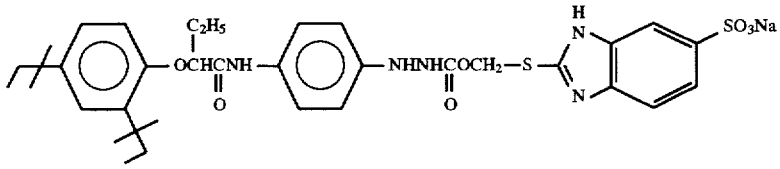

-continued
I-29
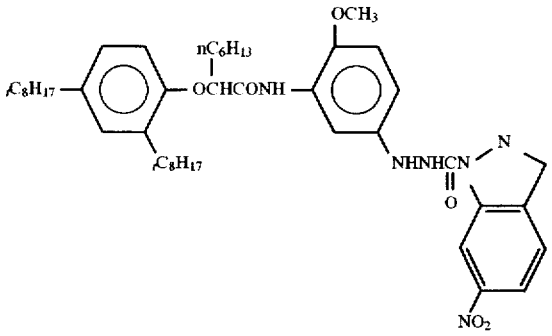
I-30
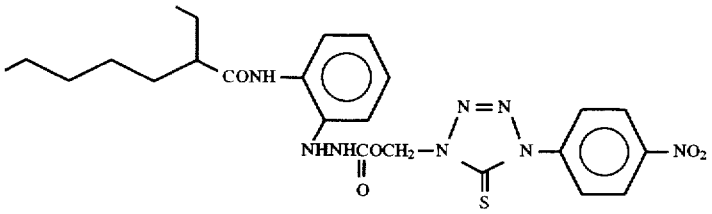
I-31
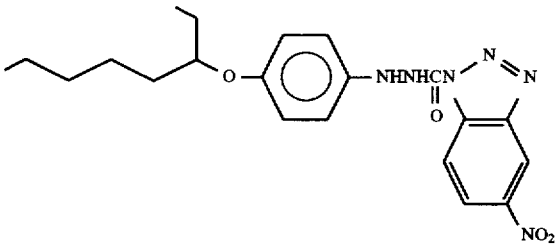
I-32
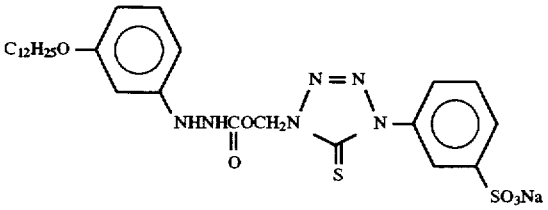
I-33
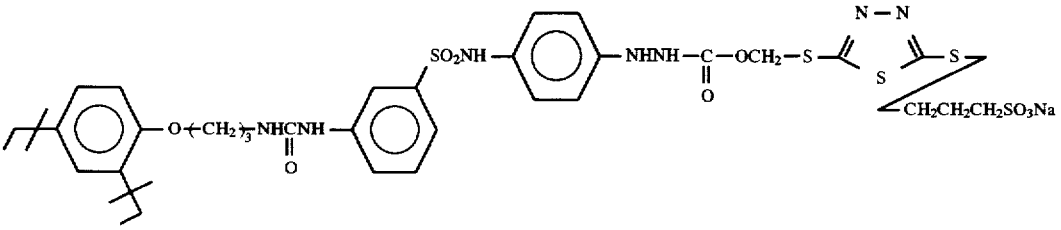
I-34
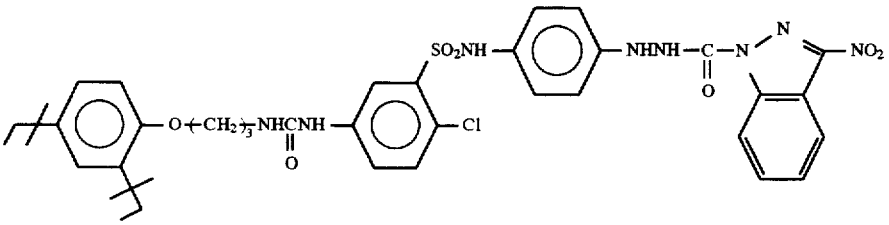

-continued
I-35
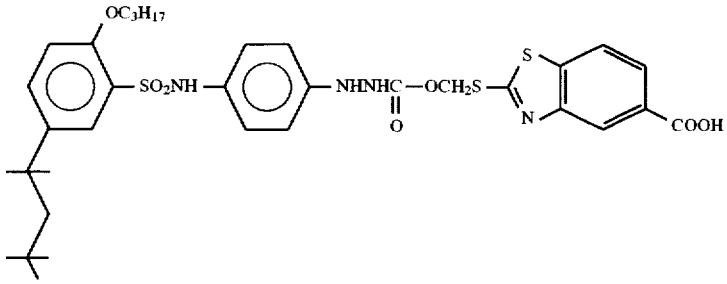
I-36
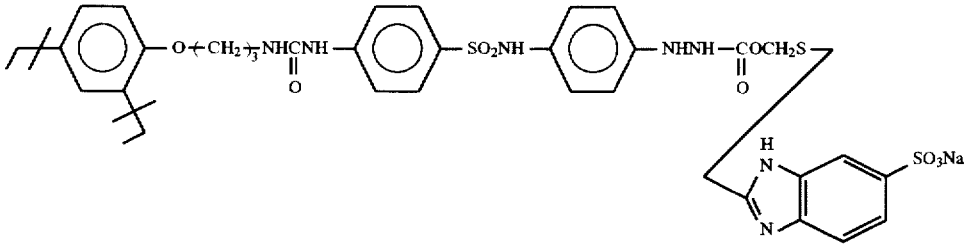
I-37
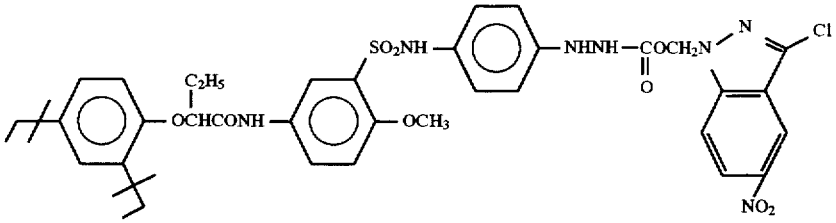
I-38
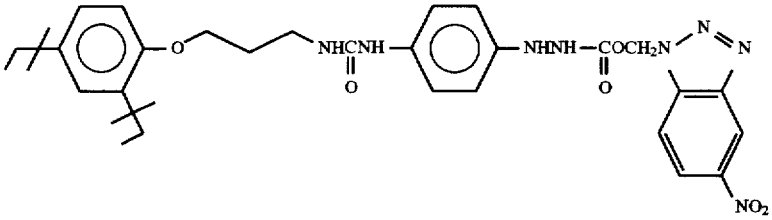
I-39
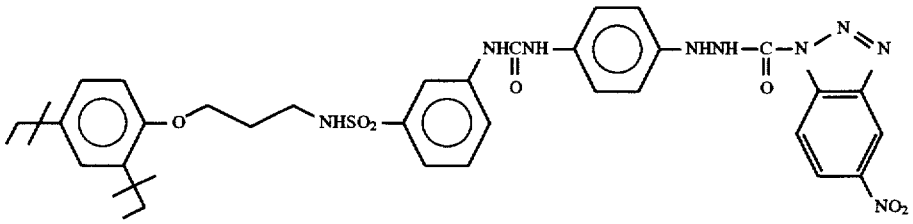
I-40
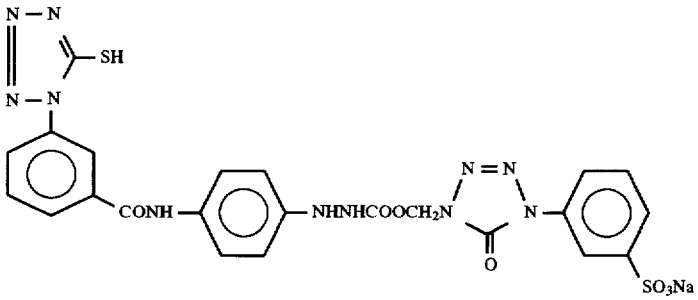

-continued
I-41
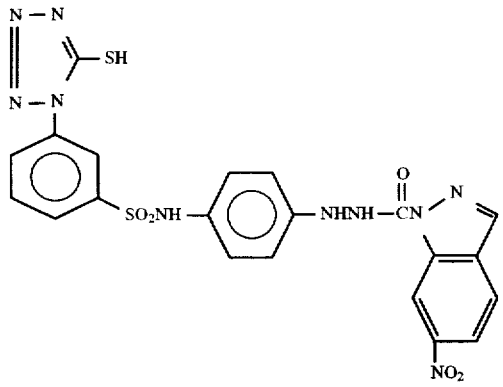
I-42
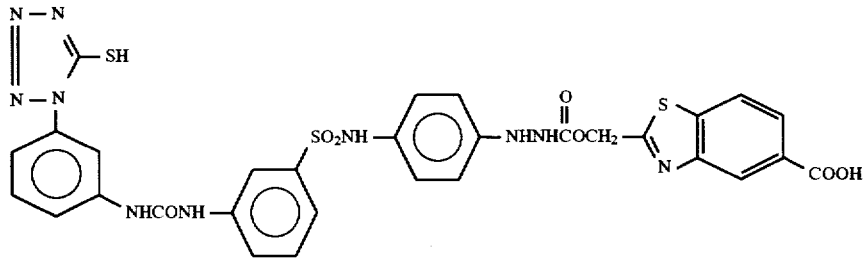
I-43
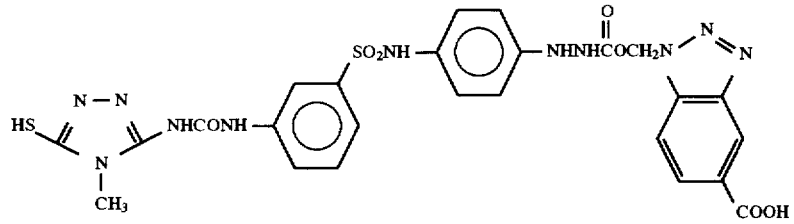
I-44
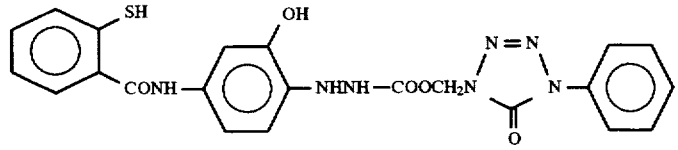
I-45
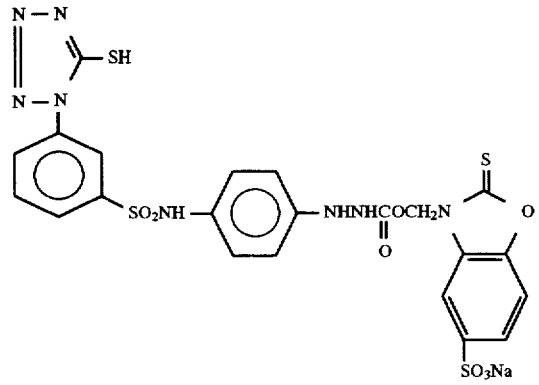

-continued
I-46
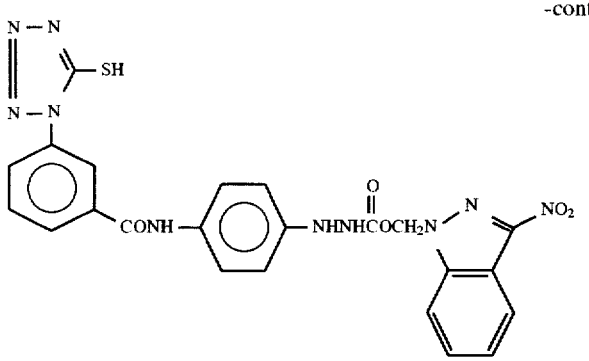
I-47
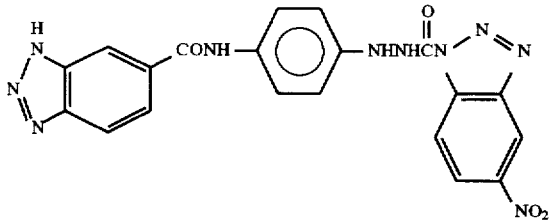
I-48
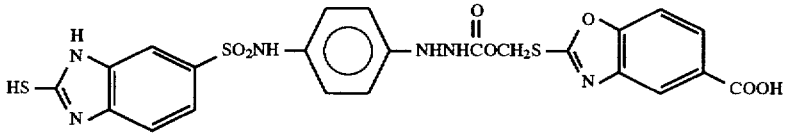
I-49
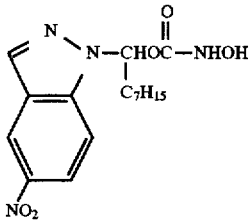
I-50
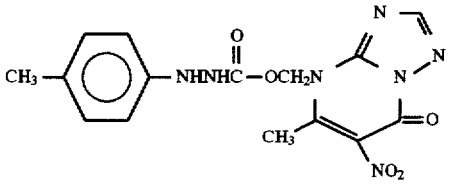
I-51
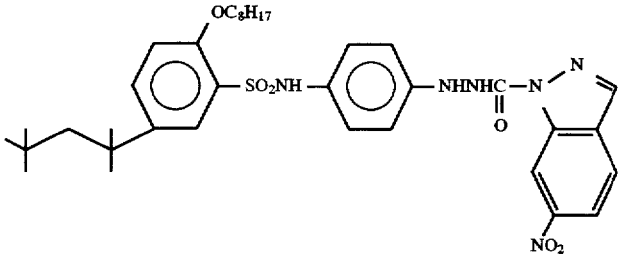
I-52
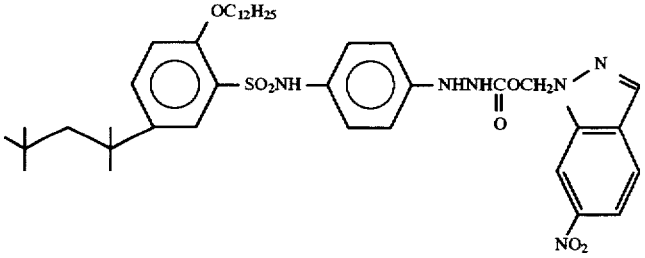

-continued
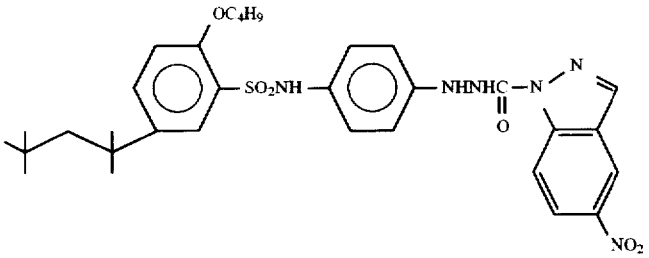
I-53
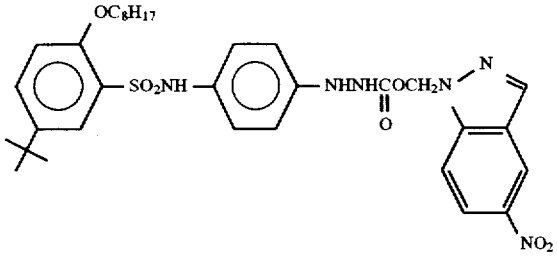
I-54
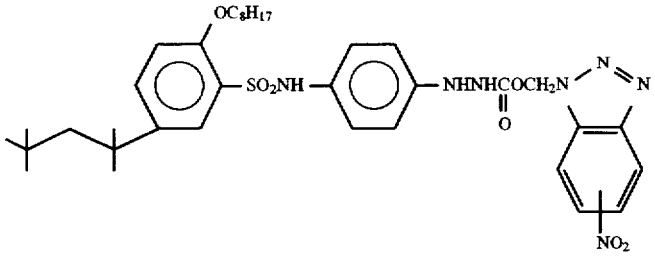
I-55
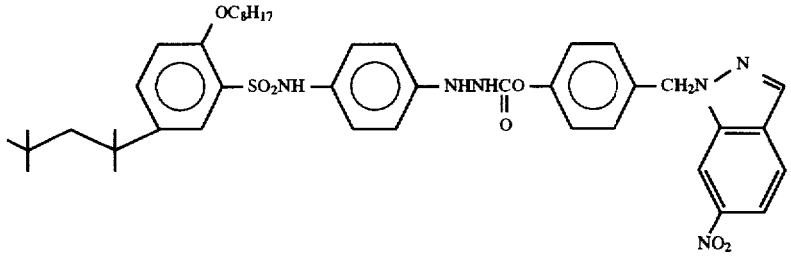
I-56
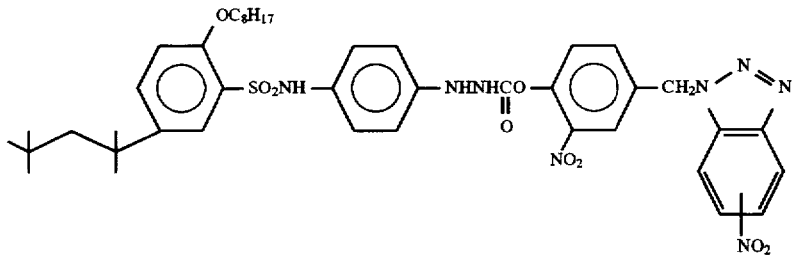
I-57
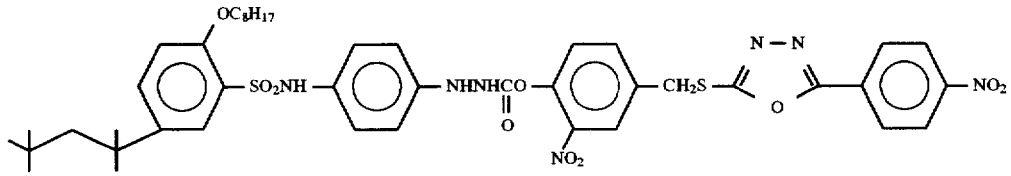
I-58

-continued
I-59
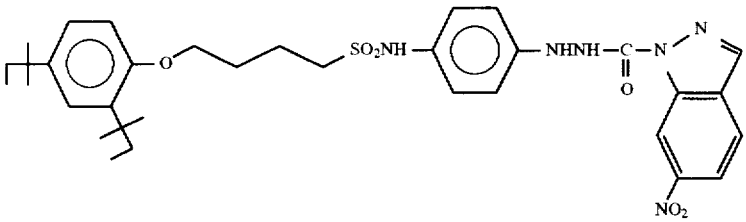
I-60
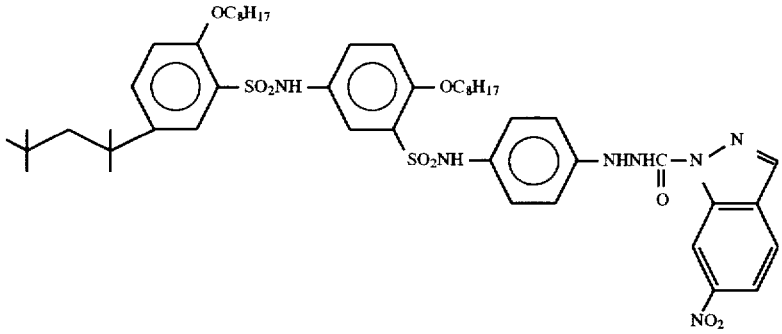
I-61
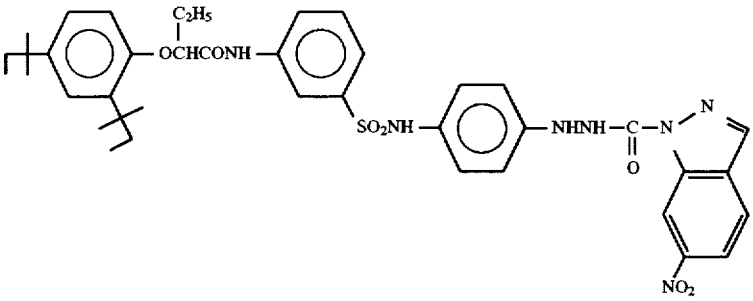
I-62
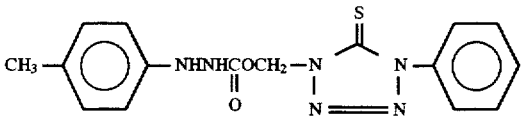
I-63
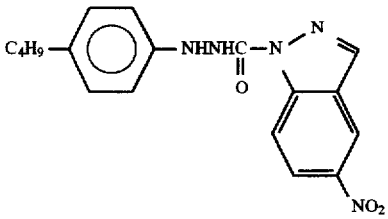
I-64
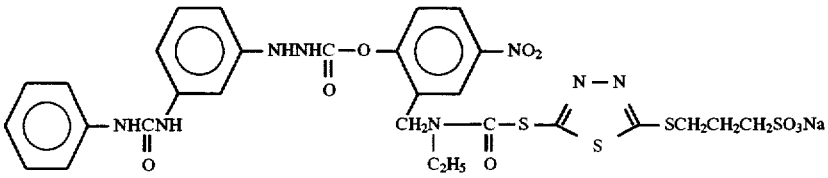

-continued
I-65
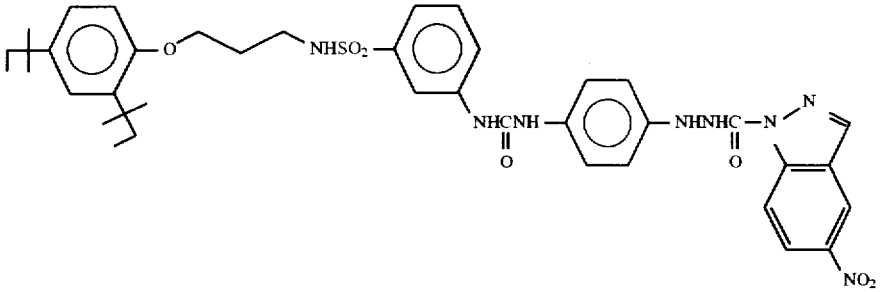
I-66
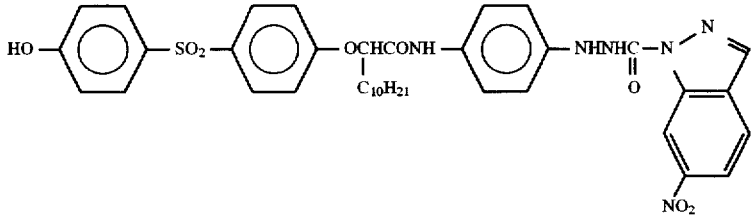
I-67
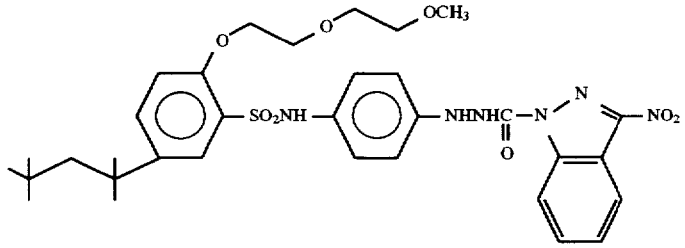
I-68
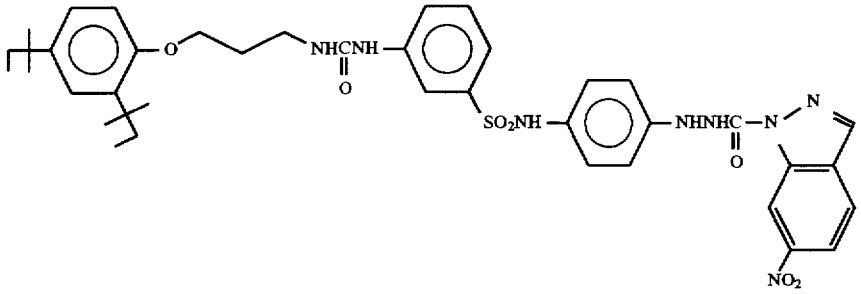
I-69
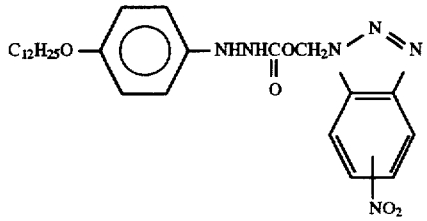
I-70
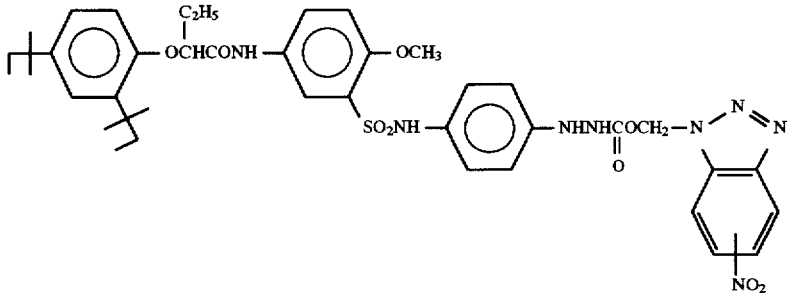

-continued
I-71
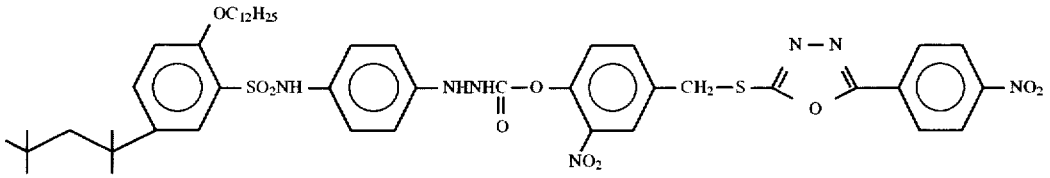
I-72
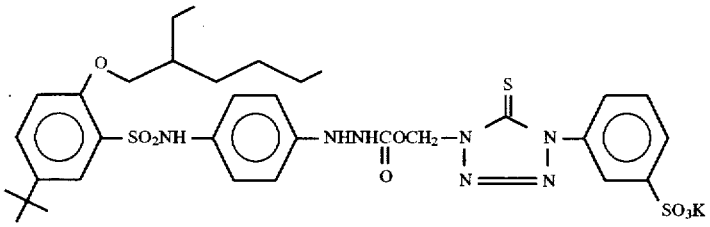
I-73
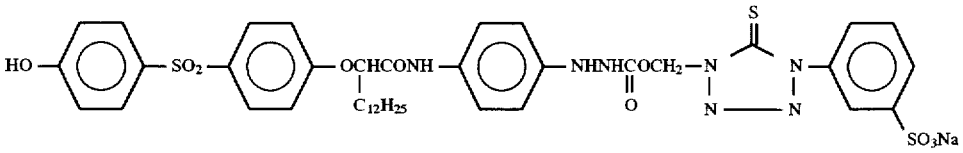
I-74
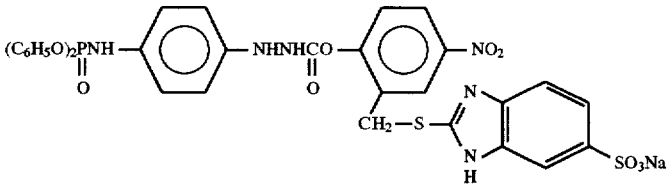
I-75
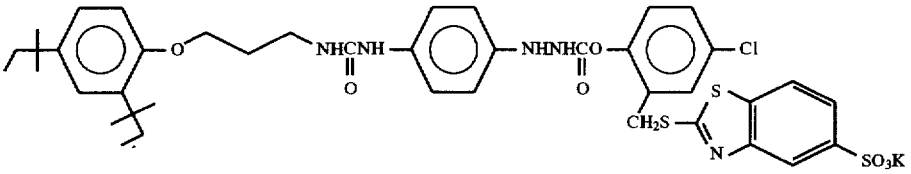
I-76
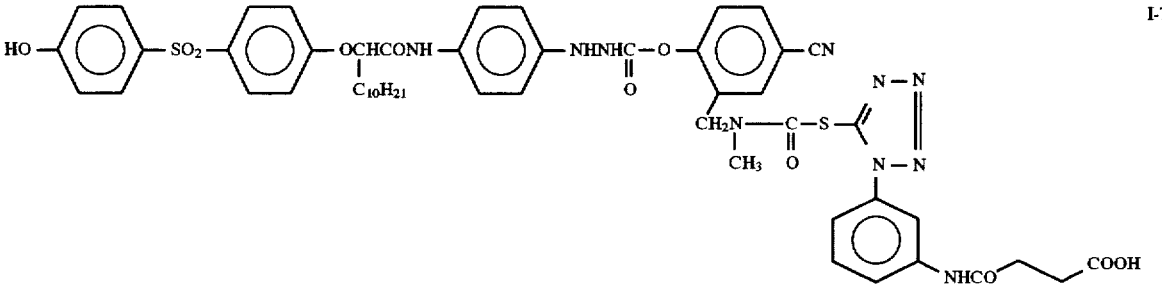
I-77
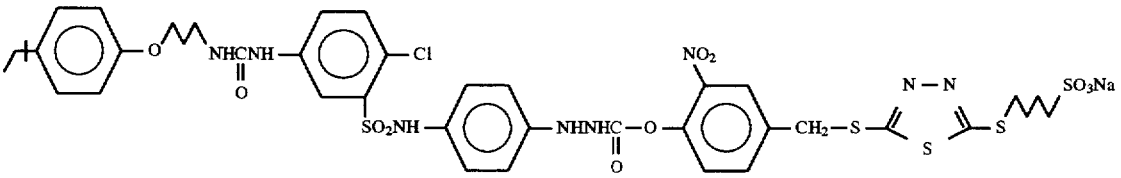
I-78
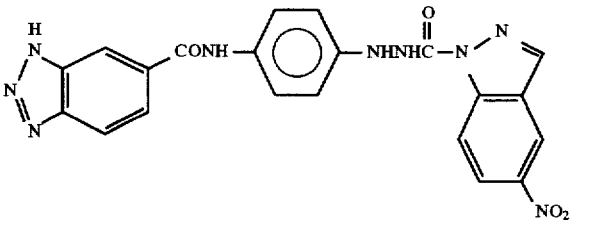

-continued

I-79

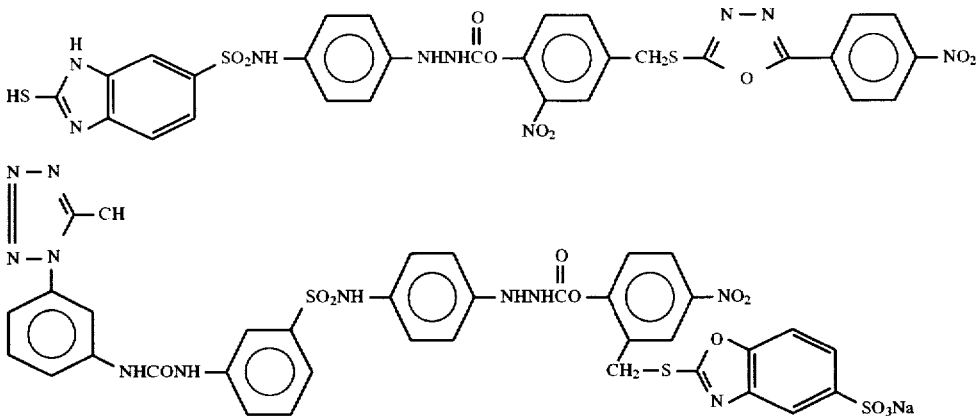

The above-described redox compounds are used in an amount ranging from about $1.0\times10^{-7}$ to $1.0\times10^{-3}$ mol. and preferably from about $1.0\times10^{-6}$ to $1.0\times10^{-4}$ mol. per $m^2$ of a silver halide light-sensitive material of the present invention.

Such redox compounds used in the present invention are incorporated into a photographic layer other than a layer containing a hydrazine nucleating agent represented by formula (II). for example. a layer above or below a hydrazine nucleating agent-containing. light-sensitive emulsion layer. either in direct contact or with an intermediate layer containing gelatin or a synthetic polymer (e.g., polyvinyl acetate and polyvinyl alcohol) being provided therebetween. The redox-containing layer may contain light-sensitive or light-insensitive silver halide emulsion grains.

Redox compounds. used in the present invention can be incorporated into a photographic layer as dissolved in an appropriate water-miscible organic solvent. such as alcohols (e.g., methanol. ethanol. propanol. and fluorinated alcohols). ketones (e.g., acetone and methyl ethyl ketone). dimethylformamide. dimethyl sulfoxide. methyl cellosolve. or other suitable solvent. Incorporation of such redox compounds can also be carried out by a well-known dispersion method. such as using a mechanically prepared emulsion. or by dispersion of a redox compound in an oil (e.g., dibutyl phthalate. tricresyl phosphate. glyceryl triacetate. and diethyl phthalate) with an auxiliary solvent (e.g., ethyl acetate and cyclohexane). A solid dispersion method may also be used by dispersing a powder of a redox compound in water by means of e.g., a ball mill. a colloid mill. ultrasonic wave or other suitable dispersion means. may also be employed.

Hydrazine nucleating agents represented by formula (II) are explained in more detail below.

When $R_1$ in formula (II) represents an aliphatic group. $R_1$ preferably comprises from 1 to 30 carbon atoms. and more preferably a straight chain. branched or cyclic alkyl group having from 1 to 20 carbon atoms. A branched alkyl group may be cyclized to form a saturated heterocyclic ring containing at least one hetero atom. Further. the alkyl group may be substituted with an aryl group. an alkoxy group. a sulfoxy group. a sulfonamido group. a carbonamido group. or other suitable group.

When $R_1$ in formula (II) represents an aromatic group. $R_1$ may be a monocyclic or bicyclic aryl group or an unsaturated heterocyclic group. An unsaturated heterocyclic group may be condensed with a monocyclic or bicyclic aryl group to form a heteroaryl group. Examples of suitable aromatic groups include benzene. naphthalene ring. pyridine. pyrimidine. imidazole. pyrazole. quinoline. isoquinoline. benzimidazole. thiazole. and benzothiazole rings. with those containing a benzene ring being particularly preferred.

$R_1$ preferably represents an aryl group.

When $R_1$ in formula (II) represents an aryl group or an unsaturated heterocyclic group. $R_1$ may have a substituent typically including an alkyl group. an aralkyl group. an alkenyl group. an alkynyl group. an alkoxy group. an aryl group. a substituted amino group. an acylamino group. a sulfonylamino group. a ureido group. a urethane group. an aryloxy group. a sulfamoyl group. a carbamoyl group. an alkylthio group. an arylthio group. a sulfonyl group. a sulfinyl group. a hydroxyl group. a halogen atom. a cyano group. a sulfo group. an alkyloxycarbonyl group. an aryloxycarbonyl group. an acyl group. an alkoxycarbonyl group. an acyloxy group. a carbonamido group. a sulfonamido group. a carboxyl group. a phosphoramido group. a diacylamino group. an imido group. and $R_2$

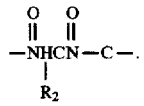

Preferred of these substituents are a straight chain. branched or cyclic alkyl group (more preferably having from 1 to 20 carbon atoms). an aralkyl group (more preferably a monocyclic or bicyclic group having from 1 to 3 carbon atoms in the alkyl moiety thereof). an alkoxy group (more preferably having from 1 to 20 carbon atoms). a substituted amino group (more preferably substituted with an alkyl group having from 1 to 20 carbon atoms). an acylamino group (more preferably having from 2 to 30 carbon atoms). a sulfonamido group (more preferably having from 1 to 30 carbon atoms). a ureido group (more preferably having from 1 to 30 carbon atoms). and a phosphoric acid amido group (more preferably having from 1 to 30 carbon atoms).

When $R_2$ in formula (II) represents an alkyl group. $R_2$ preferably contains from 1 to 4 carbon atoms and may have a substituent. e.g., a halogen atom. a cyano group. a carboxyl group. a sulfo group. an alkoxy group. a phenyl group. an acyl group. an alkoxycarbonyl group. an aryloxycarbonyl group. a carbamoyl group. an alkylsulfo group. an arylsulfo group. a sulfamoyl group. a nitro group. an aromatic heterocyclic group. and

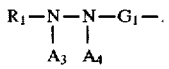

These substituents may further be substituted.

When $R_2$ represents an aryl group, $R_2$ preferably includes monocyclic or bicyclic aryl groups, such as those containing a benzene ring. An aryl group may have a substituent selected from, for example, those mentioned above with respect to $R_2$ as an alkyl group.

When $R_2$ in formula (II) represents an alkoxy group, $R_2$ preferably contains from 1 to 8 carbon atoms and may be substituted with a halogen atom, an aryl group, or other group, e.g., as mentioned for $R_2$ when $R_2$ represents an alkyl group, above.

When $R_2$ in formula (II) represents an aryloxy group, $R_2$ is preferably monocyclic and may be substituted with a halogen atom, or other group, e.g., as mentioned above for $R_2$ as an alkyl group.

When $R_2$ in formula (II) represents an amino group, $R_2$ preferably includes an unsubstituted amino group or an amino group substituted with an alkylamino or arylamino group having up to 10 carbon atoms. An amino group may also be substituted with an alkyl group, a halogen atom, a cyano group, a nitro group, a carboxyl group, or other group, e.g., as mentioned above for $R_2$ as an alkyl group.

When $R_2$ represents a carbamoyl group, $R_2$ preferably includes an unsubstituted carbamoyl group or an alkyl- or arylcarbamoyl group having up to 10 carbon atoms. An carbamoyl group may also be substituted with an alkyl group, a halogen atom, a cyano group, a carboxyl group, or other group, e.g., as mentioned above for $R_2$ as an alkyl group.

When $R_2$ represents an oxycarbonyl group, $R_2$ preferably includes an alkoxy- or aryloxycarbonyl group having up to 10 carbon atoms. The oxycarbonyl group may also be substituted with an alkyl group, a halogen atom, a cyano group, a nitro group, or other group, e.g., as mentioned above for $R_2$ as an alkyl group.

When $G_1$ in formula (II) is a carbonyl group, $R_2$ preferably represents a hydrogen atom, an alkyl group (e.g., methyl, trifluoromethyl, 3-hydroxypropyl, 3-methanesulfonamidopropyl, and phenylsulfonylmethyl), an aralkyl group (e.g., o-hydroxybenzyl), or an aryl group (e.g., phenyl, 3,5-dichlorophenyl, o-methanesulfonamidophenyl, and 4-methanesulfonylphenyl), and more preferably a hydrogen atom.

When $G_1$ is a sulfonyl group, $R_2$ preferably represents an alkyl group (e.g., methyl), an aralkyl group (e.g., o-hydroxyphenylmethyl), an aryl group (e.g., phenyl), or a substituted amino group (e.g., dimethylamino).

When $G_1$ is a sulfoxy group, $R_2$ preferably represents a cyanobenzyl group or a methylthiobenzyl group.

When $G_1$ is

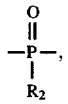

$R_2$ preferably represents a methoxy group, an ethoxy group, a butoxy group, a phenoxy group, or a phenyl group, and more preferably a phenoxy group.

When $G_1$ is an N-substituted or unsubstituted iminomethylene group, $R_2$ preferably represents a methyl group, an ethyl group, or a substituted or unsubstituted phenyl group.

Substituents mentioned above as the substituents of $R_1$ are also applicable to $R_2$.

$G_1$ preferably represents a carbonyl group.

$R_2$ may be a group which causes the $G_1$—$R_2$ moiety to be split off from the remainder of formula (II) to induce cyclization producing a cyclic structure containing the —$G_1$—$R_2$ moiety. More specifically, such a group is represented by formula (a):

$$-R_3-Z_1 \qquad \text{(a)}$$

wherein $Z_1$ represents a group which nucleophilically attacks $G_1$ to split the $G_1$—$R_3$—$Z_1$ moiety from the remainder; $R_3$ represents a group derived from $R_2$ by removing one hydrogen atom therefrom; and $R_3$ and $Z_1$ are capable of forming a cyclic structure together with $G_1$ upon nucleophilic attack of $Z_1$ on $G_1$.

In particular, when hydrazine compounds of formula (II) undergo a reaction, such as an oxidation, to produce an intermediate represented by formula $R_1$—N=N—$G_1$—$R_3$—$Z_1$, $Z_1$ readily reacts nucleophilically with $G_1$ to separate $R_1$—N=N from $G_1$. $Z_1$ may include a functional group capable of directly reacting with $G_1$, e.g., —OH, —SH, —$NHR_4$ (wherein $R_4$ represents a hydrogen atom, an alkyl group, an aryl group, —$COR_5$, or —$SO_2R_5$, wherein $R_5$ represents a hydrogen atom, an alkyl group, an aryl group, a heterocyclic group, or other substituent group, e.g., as mentioned above for $R_2$ as an aryl group), and —COOH (these functional groups may be temporarily protected so as to release the functional group upon hydrolysis with an alkali, or other hydrolytic agent), and a functional group which becomes capable of reacting with $G_1$ on reacting with a nucleophilic agent (e.g., a hydroxide ion and a sulfite ion), such as

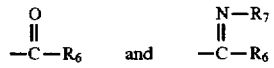

(wherein $R_6$ and $R_7$ each represents a hydrogen atom, an alkyl group, an alkenyl group, an aryl group, or a heterocyclic group).

The ring formed by $G_1$, $R_3$, and $Z_1$ is preferably a 5- or 6-membered ring.

Preferred of the groups represented by formula (a) are those represented by formulae (b) and (c):

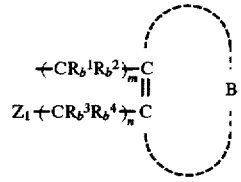

(b)

wherein $Z_1$ is as defined above; $R_b^1$, $R_b^2$, $R_b^3$, and $R_b^4$, which may be the same or different, each represents a hydrogen atom, an alkyl group (preferably having from 1 to 12 carbon atoms), an alkenyl group (preferably having from 2 to 12 carbon atoms), an aryl group (preferably having from 6 to 12 carbon atoms), etc.; B represents an atomic group necessary to form a substituted or unsubstituted 5- or 6-membered ring; m and n each represents 0 or 1; and (n+m) is 1 or 2.

In formula (b), the 5- or 6-membered ring formed by B includes cyclohexene, cycloheptene, benzene, naphthalene, pyridine, and quinoline rings.

$$-\underset{\displaystyle R_c^3}{\underset{|}{N}}-\underset{q}{(}-CR_c^1R_c^2-\underset{q}{)}-Z_1 \qquad (c)$$

wherein $Z_1$ is as defined above; $R_c^1$ and $R_c^2$, which may be the same or different, each represents a hydrogen atom, an alkyl group, an alkenyl group, an aryl group, a halogen atom, or other substituent, e.g., as mentioned above for $R_2$ as an aryl group; $R_c^3$ represents a hydrogen atom, an alkyl group, an alkenyl group, or an aryl group; p represents 0 or 1; q represents an integer of from 1 to 4; $R_c^1$, $R_c^2$, and $R_c^3$ may be taken together to form a ring as long as $Z_1$ is capable of intramolecular nucleophilic attack on $G_1$.

$R_c^1$ and $R_c^2$ each preferably represents a hydrogen atom, a halogen atom, or an alkyl group, and $R_c^3$ preferably represents an alkyl group or an aryl group.

q preferably represents 1, 2, or 3. When q is 1, p represents 1 or 2; when q is 2, p represents 0 or 1; when q is 3, p represents 0 or 1; and when q is 2 or 3, $R_c^1R_c^2$ moieties may be the same or different.

$A_3$ and $A_4$ in formula (II) each represents a hydrogen atom, an alkylsulfonyl or arylsulfonyl group having not more than 20 carbon atoms (preferably a phenylsulfonyl group or a phenylsulfonyl group which is substituted so that a sum of Hammett's σ values may be −0.5 or more), or an acyl group having not more than 20 carbon atoms (preferably a benzoyl group; a benzoyl group which is substituted so that the sum of the Hammett's σ values may be −0.5 or more; or a straight chain or branched or cyclic substituted or unsubstituted aliphatic acyl group (which may have substituents including, e.g., a halogen atom, an ether group, a sulfonamido group, a carbonamido group, a hydroxyl group, a carboxyl group, and a sulfo group)), provided that at least one of $A_3$ and $A_4$ is a hydrogen atom.

$A_3$ and $A_4$ each most preferably represents a hydrogen atom.

$R_1$ or $R_2$ in formula (II) may contain a ballast group or a polymer commonly employed in nondiffusible, photographic additives, such as couplers. A ballast group, as used in a compound according to formula (II), is a group which contains at least 8 carbon atoms and is relatively inert to photographic properties. Suitable ballast groups may be selected from alkyl groups, alkoxy groups, phenyl groups, alkylphenyl groups, phenoxy groups, alkylphenoxy groups, etc. Examples of the polymer are described, e.g., in JP-A-1-100530.

$R_1$ or $R_2$ may further contain a group which accelerates adsorption to silver halide grains. Examples of such an adsorption accelerating group are described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, and JP-A-63-234244, JP-A-63-234245 and JP-A-63-234246, including a thiourea group, a heterocyclic thioamido group, a mercapto heterocyclic group, and a triazole group.

Specific, illustrative examples of hydrazine nucleating agents represented by formula (II) are shown below but not in order to limit such compounds.

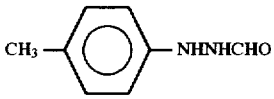

II-1)

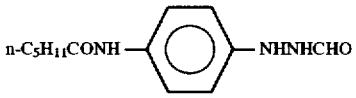

II-2)

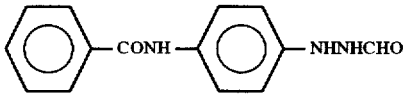

II-3)

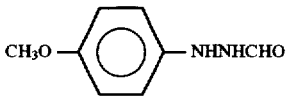

II-4)

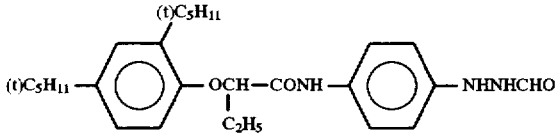

II-5)

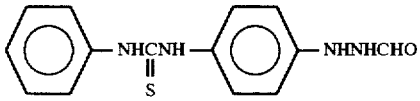

II-6)

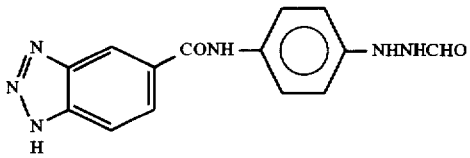

II-7)

-continued
II-8)
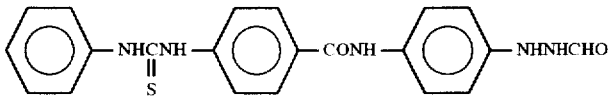
II-9)
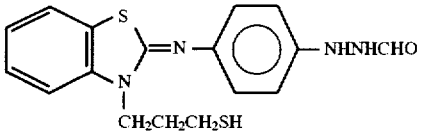
II-10)
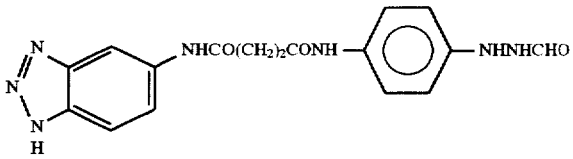
II-11)
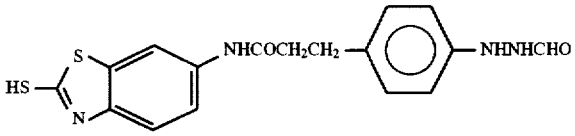
II-12)
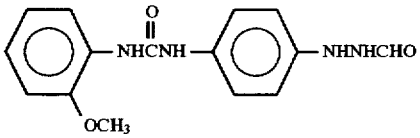
II-13)
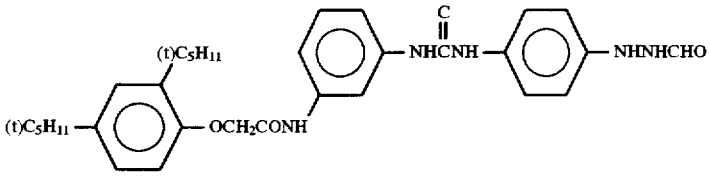
II-14)
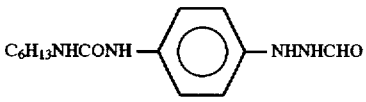
II-15)
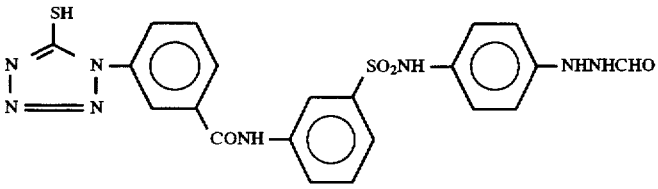
II-16)
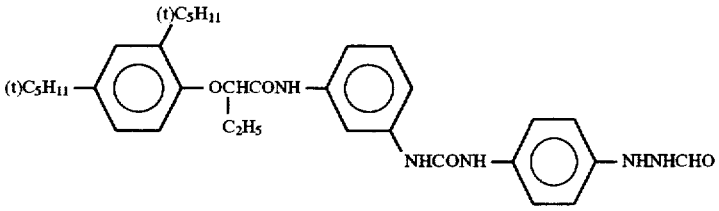
II-17)
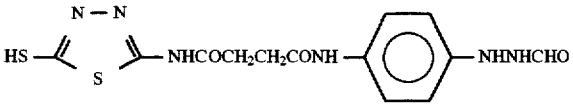

-continued
II-18)
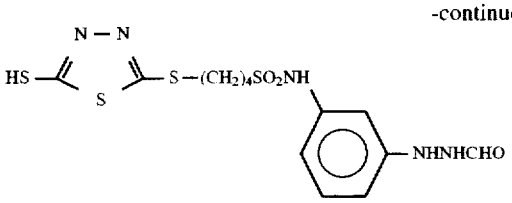
II-19)
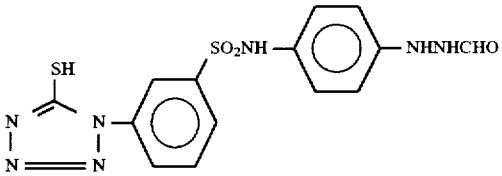
II-20)
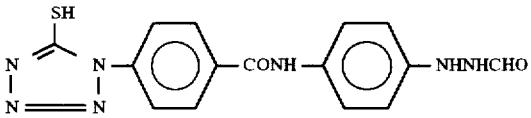
II-21)
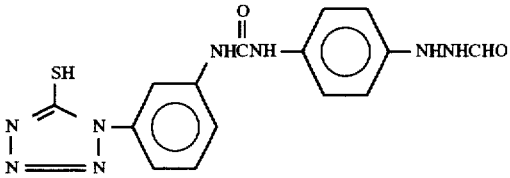
II-22)
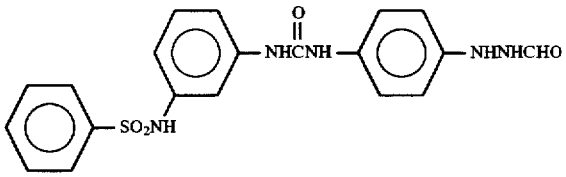
II-23)
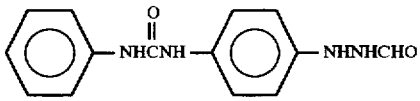
II-24)
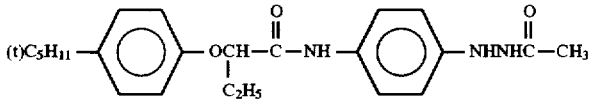
II-25)
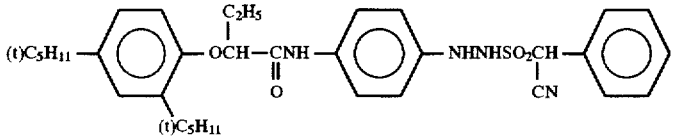
II-26)
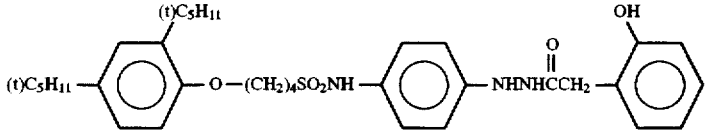
II-27)
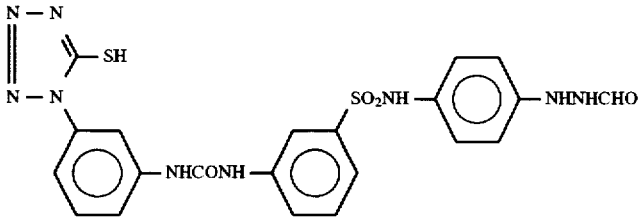

-continued
II-28)
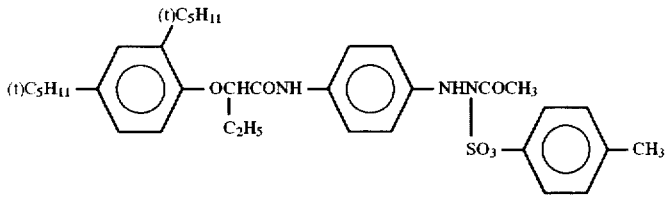
II-29)
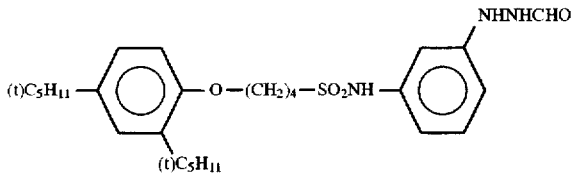
II-30)
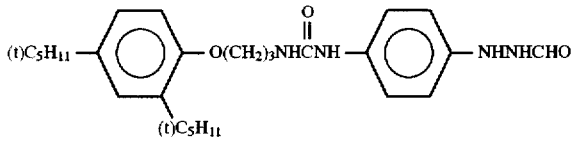
II-31)
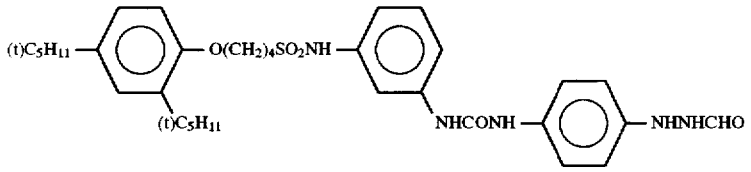
II-32)
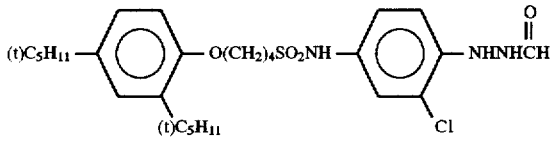
II-33)
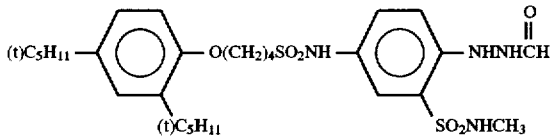
II-34)
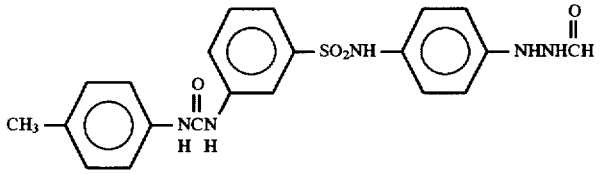
II-35)
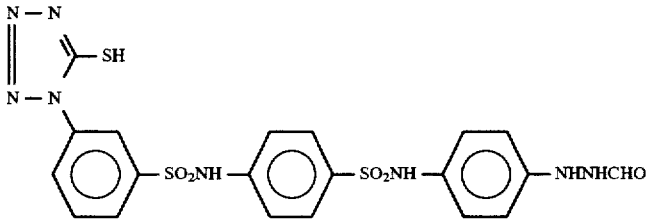
II-36)
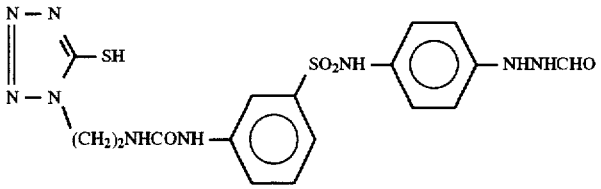

-continued
II-37)
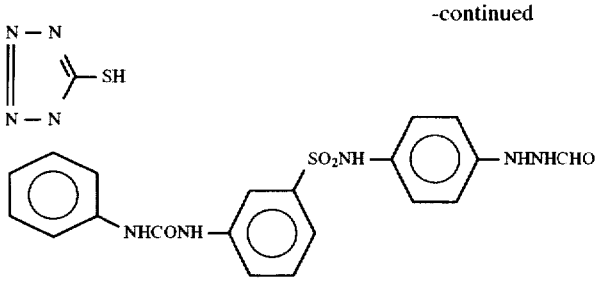
II-38)
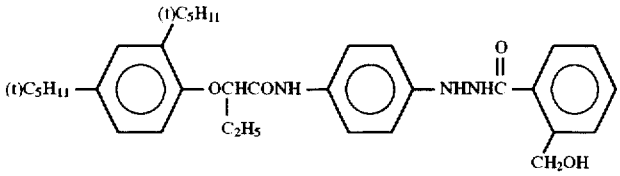
II-39)
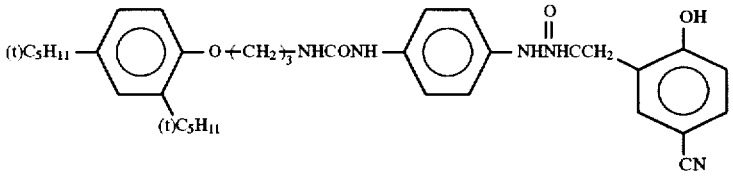
II-40)
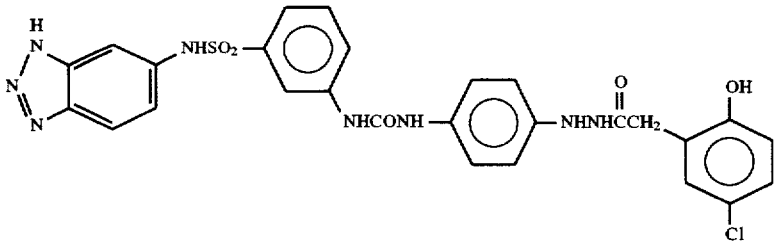
II-41)
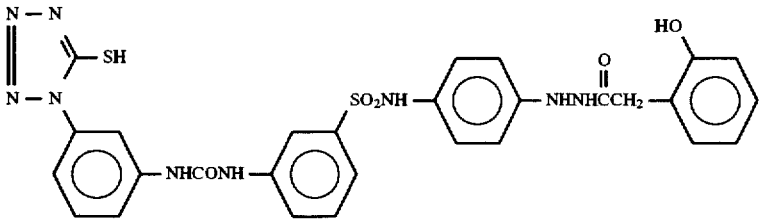
II-42)
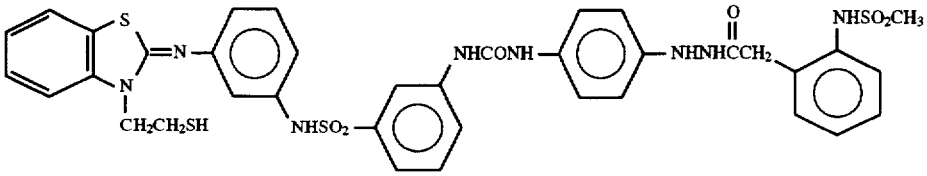
II-43)
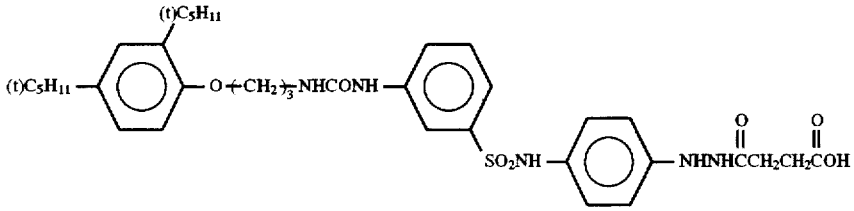
II-44)
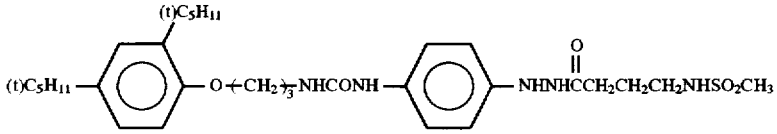

-continued
II-45)
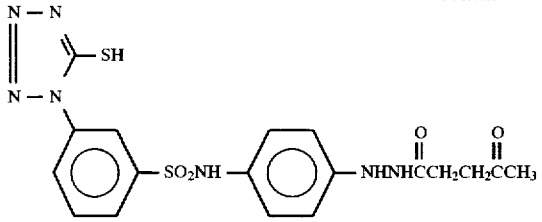
II-46)
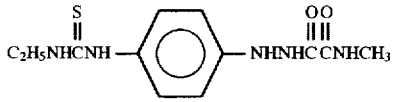
II-47)
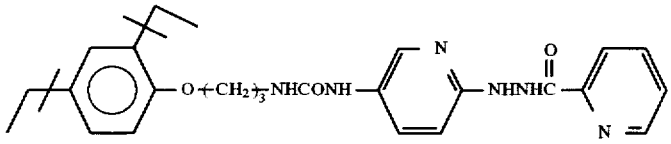
II-48)
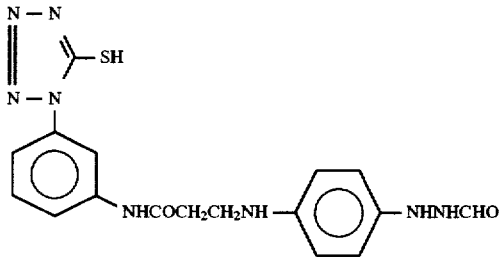
II-49)
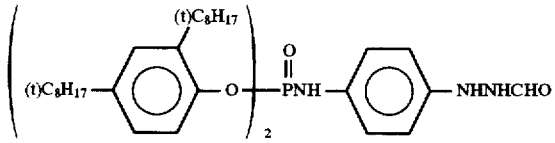
II-50)
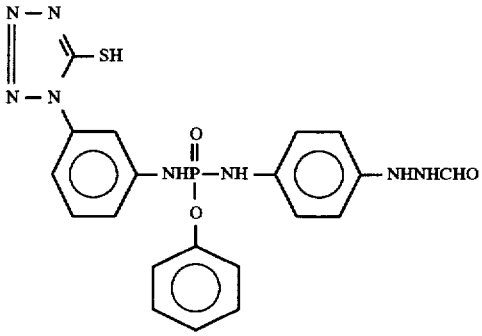
II-51)
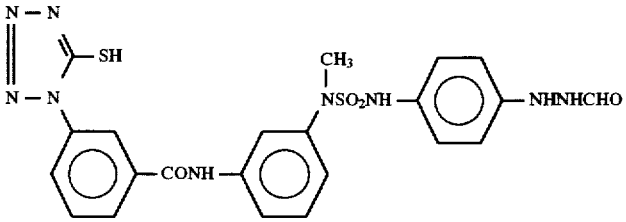
II-52)
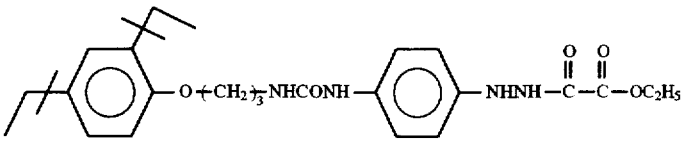

-continued
II-53)
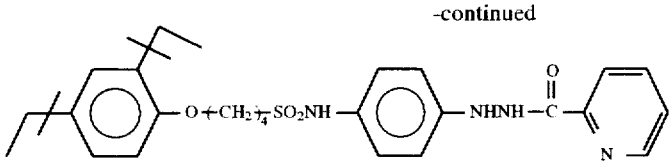
II-54)
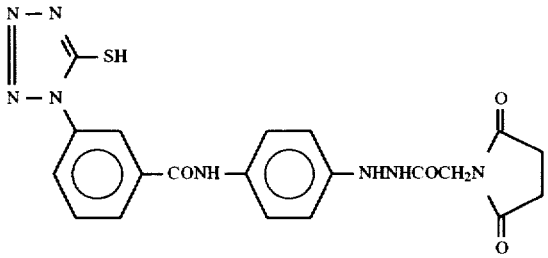
II-55)
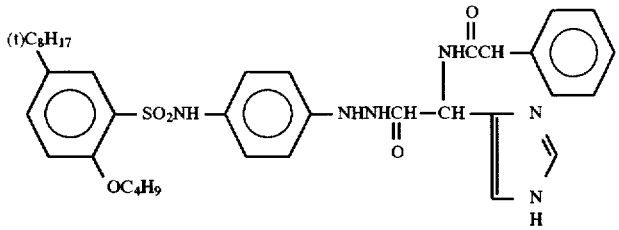
II-56)
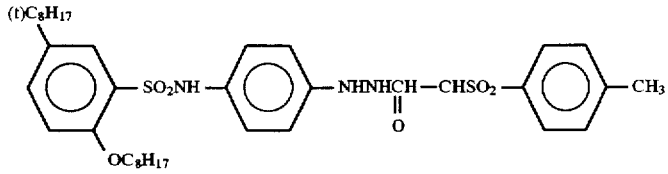
II-57)
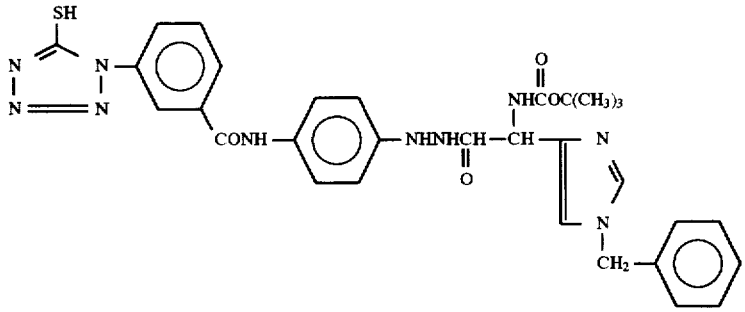
II-58)
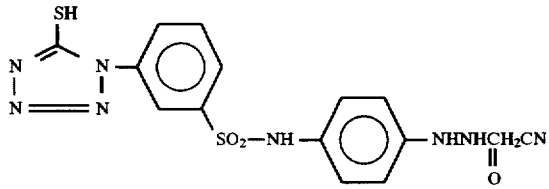
II-59)
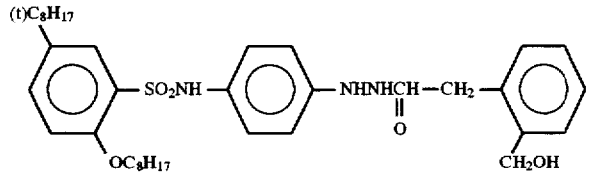
II-60)
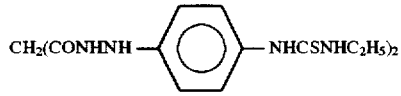

-continued
II-61)
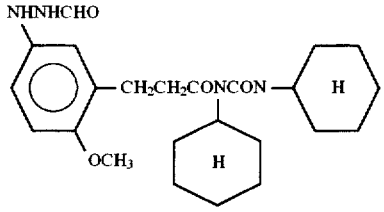
II-62)
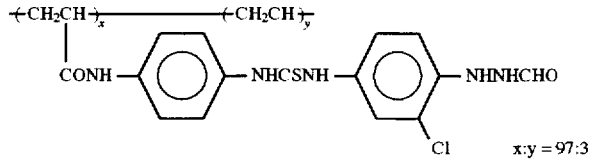
II-63)
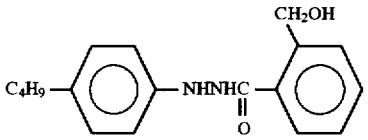
II-64)
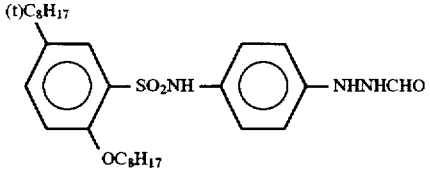
II-65)
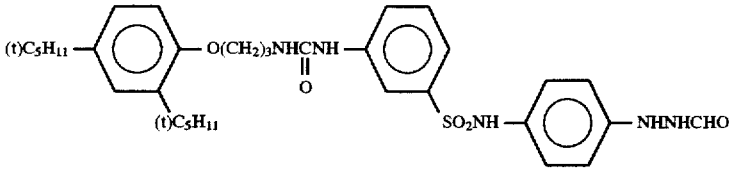
II-66)
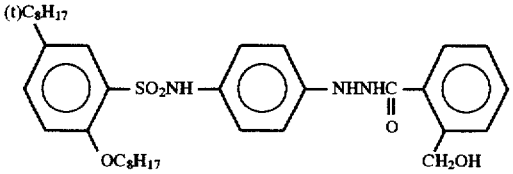
II-67)
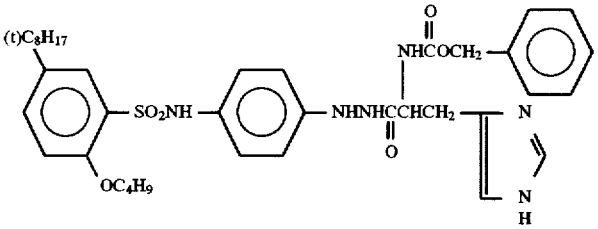
II-68)
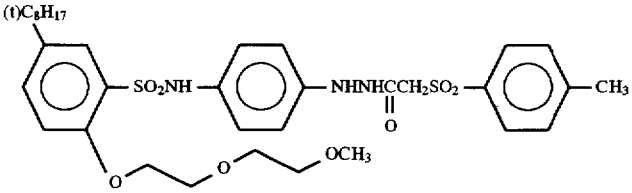

-continued

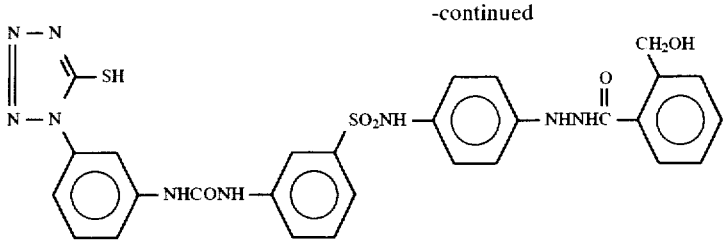

II-69)

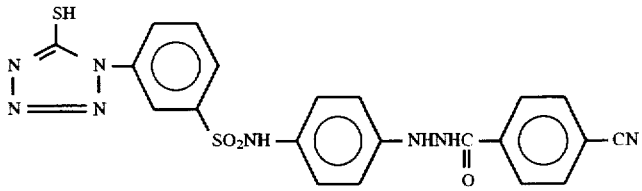

II-70)

Hydrazine nucleating agents are preferably used in an amount of from about $1\times10^{-6}$ to $5\times10^{-2}$ mol, and more preferably from about $1\times10^{-5}$ to $2\times10^{-2}$ mol, per mol of silver halide.

Light-sensitive materials according to the present invention may further comprise a quinone trapping agent or an ascorbic acid derivative in a layer different from the hydrazine nucleating agent-containing layer.

In one embodiment, light-sensitive materials of the present invention comprise a hydrazine nucleating agent in a first light-sensitive silver halide emulsion layer, a redox compound in a layer different from the first emulsion layer, and a quinone trapping agent in a second light-sensitive silver halide emulsion layer or a light-insensitive layer provided between the first light-sensitive silver halide emulsion layer and a second light-sensitive silver halide emulsion layer.

In another embodiment, light-sensitive materials of the present invention comprise a hydrazine nucleating agent in a first light-sensitive silver halide emulsion layer and a redox compound and a quinone trapping agent or an ascorbic acid derivative both in a second light-sensitive silver halide emulsion layer.

In still another embodiment, light-sensitive materials of the present invention comprise a hydrazine nucleating agent in a first light-sensitive silver halide emulsion layer, a redox compound in a light-insensitive layer, and a quinone trapping agent or an ascorbic acid derivative in a second light-sensitive silver halide emulsion layer.

In another embodiment, light-sensitive materials comprise a hydrazine nuleating agent in a first light-sensitive silver halide emulsion layer, a redox compound in a second light-sensitive silver halide emulsion layer, and a quinone trapping agent or an ascorbic acid derivative in a light-insensitive layer provided between the first light-sensitive silver halide emulsion layer and the second light-sensitive silver halide emulsion layer.

Quinone trapping agents which can be used in the present invention include, e.g., compounds which react with quinone to counteract the oxidizing effect of quinone. Such compounds include those generally used as reducing agents or an antioxidants and those capable of nucleophilic addition to quinone. Preferred of such quinone trapping agents are dihydroxybenzene derivatives, e.g., catechol and hydroquinone; hydrazine or hydrazide derivatives having an —NHNH— bond; sulfites; organic sulfinic acids or salts thereof; N-substituted hydroxylamines; 1,2-endiols (so-called reductones), e.g., ascorbic acid and reductic acid; and compounds capable of releasing these compounds in a developing solution.

Preferred dihydroxybenzene derivatives which may be used in the present invention are those represented by formula (III):

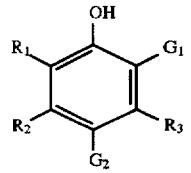

wherein $R_1$, $R_2$, $R_3$, and $R_4$, which may be the same or different, each represents a hydrogen atom, a hydroxyl group, a substituted or unsubstituted alkoxy group, a substituted or unsubstituted aryloxy group, a substituted or unsubstituted alkylthio group, a substituted or unsubstituted arylthio group, a halogen atom, a primary, secondary or tertiary amino group, a substituted or unsubstituted carbonamido group, a substituted or unsubstituted sulfonamido group, a substituted or unsubstituted alkyl group, a substituted or unsubstituted aryl group, a substituted or unsubstituted 5- or 6-membered heterocyclic group containing at least one of nitrogen, oxygen and sulfur atoms, a formyl group, a keto group, a sulfo group, a carboxyl group, a substituted or unsubstituted alkylsulfonyl group, or a substituted or unsubstituted arylsulfonyl group; and wherein at least one of $G_1$ and $G_2$ represents a hydroxyl group, with the other being selected from the groups described above as $R_1$, $R_2$, $R_3$ or $R_4$.

A number of specific examples of such dihydroxybenzene derivatives which may be used in the present invention are described in *The Merck Index*, 10th Ed. U.S. Pat. Nos. 2,728,659, 3,700,453, and 3,227,552, JP-A-49-106329, JP-A-50- 156438, JP-A-56-109344, JP-A-57-22237, JP-A-59-202465, JP-A-58-17431, JP-B-50-21249 (the term "JP-B"as used herein means an "examined published Japanese patent application"), JP-B-56-40818, JP-B-59-37497, British Patents 752,146 and 1,086,208, West German Patent OLS 2,149,789, *Chemical Abstracts, Vol.* 5, 6367h, and JP-A-57-17949. Particularly preferred of these dihydroxybenzene derivatives are catechol, hydroquinone, and catechol or hydroquinone substituted with 1 to 4 substituents, the sum of the Hammett's $\sigma$ values of the substituents other than two hydroxyl groups ranging from −1.2 to +1.2, and more preferably from −1.0 to +0.5.

Dihydroxybenzene derivatives of formula (III) which may be used in the present invention, include, but are not limited to, the specific examples shown below.

III-1
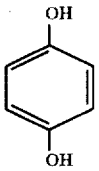
III-2
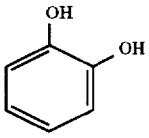
III-3
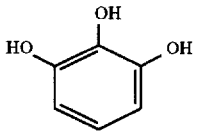
III-4
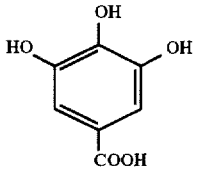
III-5
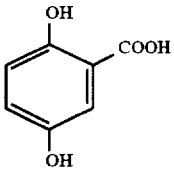
III-6
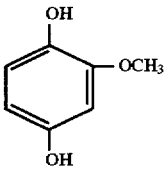
III-7
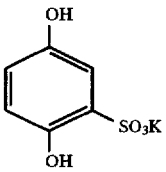
III-8
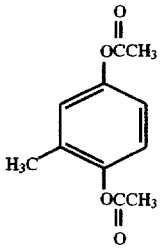
III-9
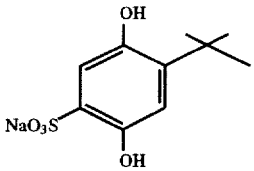
-continued
III-10
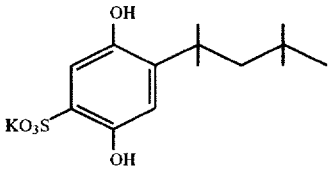
III-11
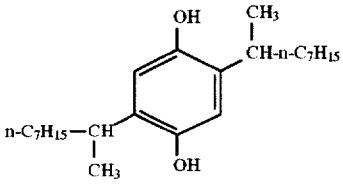
III-12
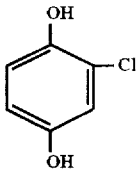
III-13
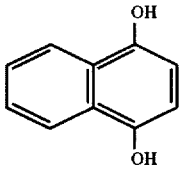
III-14
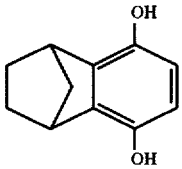
III-15
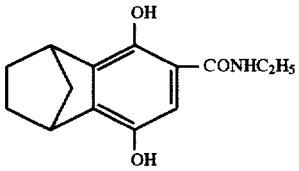
III-16
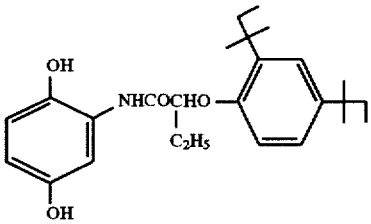
III-17
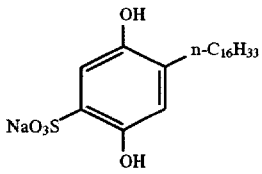

-continued

III-18

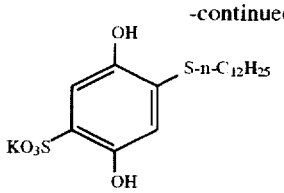

III-19

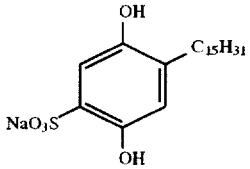

III-20

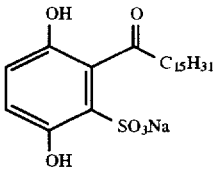

III-21

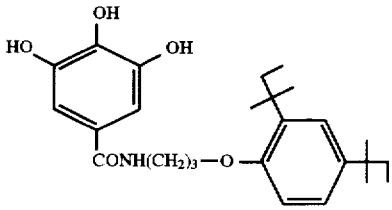

III-22

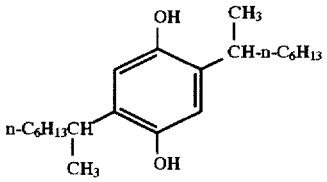

III-23

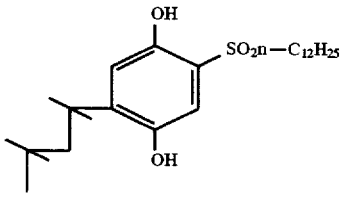

III-24

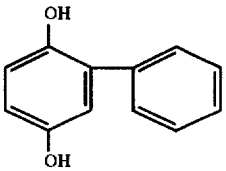

III-25

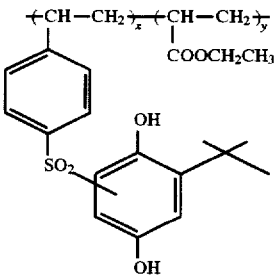

Organic sulfinic acids or salts thereof which may be used in the present invention preferably include those represented by formula (IV):

$$R-SO_2M \qquad \text{(IV)}$$

wherein M represents a hydrogen atom, an alkali metal atom, or ammonium (which may be substituted with 1 to 4 substituents); and R represents a substituted or unsubstituted alkyl group having from 1 to 30 carbon atoms; a substituted or unsubstituted phenyl group, or a substituted or unsubstituted naphthyl group.

In formula (IV), M preferably represents a hydrogen atom or an alkali metal atom (such as Li, Na, K, or Cs). Substituents of the group represented by R preferably include a straight chain, branched or cyclic alkyl group (more preferably having from 1 to 20 carbon atoms), an aralkyl group (more preferably a monocyclic or bicyclic aryl group combined with an alkyl group containing from 1 to 3 carbon atoms), an alkoxy group (more preferably having from 1 to 20 carbon atoms), a mono- or disubstituted amino group (more preferably substituted with an alkyl group, an acyl group, or an alkyl- or arylsulfonyl group each having not more than 20 carbon atoms; the total carbon atom number of substituents of the disubstituted amino group being not more than 20), an unsubstituted or mono-, di- or trisubstituted ureido group (more preferably having from 1 to 29 carbon atoms), a substituted or unsubstituted aryl group (more preferably a monocyclic or bicyclic aryl group having from 6 to 29 carbon atoms), a substituted or unsubstituted arylthio group (more preferably containing from 6 to 29 carbon atoms), a substituted or unsubstituted alkylthio group (more preferably containing from 1 to 29 carbon atoms), a substituted or unsubstituted alkylsulfoxy group (more preferably containing from 1 to 29 carbon atoms), a substituted or unsubstituted arylsulfoxy group (more preferably a monocyclic or bicyclic group containing from 6 to 29 carbon atoms), a substituted or unsubstituted alkylsulfonyl group (more preferably containing from 1 to 29 carbon atoms), a substituted or unsubstituted arylsulfonyl group (more preferably a monocyclic or bicyclic group containing from 6 to 29 carbon atoms), an aryloxy group (more preferably a monocyclic or bicyclic group containing from 6 to 29 carbon atoms), a carbamoyl group (more preferably containing from 1 to 29 carbon atoms), a sulfamoyl group (more preferably containing from 1 to 29 carbon atoms), a hydroxyl group, a halogen atom (such as F, Cl, Br, I), a sulfo group, and a carboxyl group. Of these substituents, those capable of being substituted may further have a substituent selected from an alkyl group having from 1 to 20 carbon atoms, a monocyclic or bicyclic aryl group having from 6 to 20 carbon atoms, an alkoxy group having from 1 to 20 carbon atoms, an aryloxy group having from 6 to 20 carbon atoms, an alkylthio group having from 1 to 20 carbon atoms, an arylthio group having from 6 to 20 carbon atoms, an alkylsulfonyl group having from 1 to 20 carbon atoms, an arylsulfonyl group having from 6 to 20 carbon atoms, a carbonamido group having from 1 to 20 carbon atoms, a sulfonamido group having up to 20 carbon atoms, a carbamoyl group having from 1 to 20 carbon atoms, a sulfamoyl group having from 1 to 20 carbon atoms, an alkylsulfoxy group having from 1 to 20 carbon atoms, an arylsulfoxy group having from 1 to 20 carbon atoms, an ester group having from 2 to 20 carbon atoms, a hydroxyl group, —COOM, —$SO_2M$ (wherein M represents a hydrogen atom, an alkali metal atom, or a substituted or unsubstituted ammonium group), and a halogen atom (such as F, Cl, Br, I). These groups may be connected to each other to form a ring. Further, these groups may be a part of a homopolymer or copolymer chain.

Organic sulfinic acids or salts thereof represented by formula (IV) which may be used in the present invention include, but are not limited to, the following specific examples.

IV-1

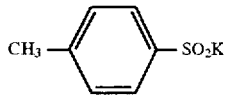

IV-2

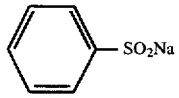

IV-3

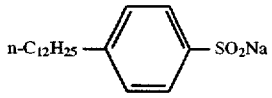

IV-4

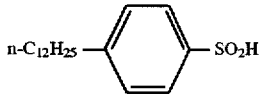

IV-5

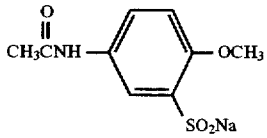

IV-6

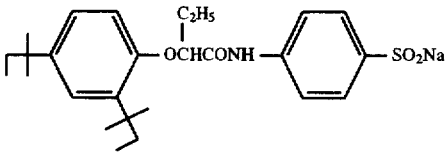

IV-7

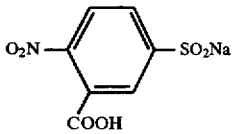

IV-8

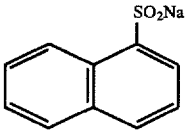

IV-9

$n\text{-}C_4H_9SO_2Na$

IV-10

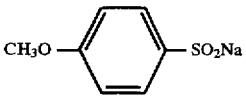

IV-11

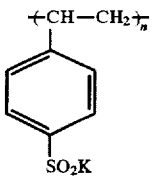

-continued

IV-12

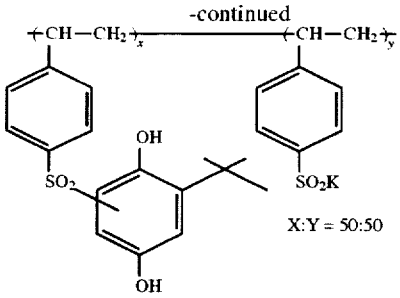

X:Y = 50:50

Methods for synthesizing these organic sulf inic acids as well as other examples of the organic sulfinic acids which can be used as quinone trapping agents in the present invention are described, e.g., in R. B. Wagner and H. D. Zook, *Synthetic organic Chemistry*, pp. 807–810, John Wiley & Sons, Inc., New York (1953).

The N-substituted hydroxylamines preferably include those represented by formula (V):

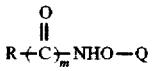

(V)

wherein m represents 0 or 1; Q represents a hydrogen atom, an acyl group having from 1 to 20 carbon atoms, or a substituted or unsubstituted phenyl group having from 1 to 20 carbon atoms; and R represents a substituted or unsubstituted alkyl group having from 1 to 30 carbon atoms or a substituted or unsubstituted phenyl group from 1 to 30 carbon atoms.

Preferred of the compounds of formula (V) are those wherein m represents 0 or 1, and Q represents a hydrogen atom. Examples of preferred substituents for the alkyl or phenyl group as R include a straight chain, branched or cyclic alkyl group (more preferably having from 1 to 20 carbon atoms), an aralkyl group (more preferably a monocyclic or bicyclic group having from 1 to 3 carbon atoms in the alkyl moiety thereof), an alkoxy group (more preferably having from 1 to 20 carbon atoms), a mono- or disubstituted amino group (more preferably substituted with an alkyl group, an acyl group, an alkyl-sulfonyl group, or an aryl-sulfonyl group each having up to 20 carbon atoms; the total carbon atom number of the disubstituted amino group being not more than 20), a mono-, di- or tri-substituted or unsubstituted ureido group (more preferably having from 1 to 29 carbon atoms), a substituted or unsubstituted aryl group (more preferably a monocyclic or bicyclic group having from 6 to 29 carbon atoms), a substituted or unsubstituted arylthio group (more preferably having from 6 to 29 carbon atoms), a substituted or unsubstituted alkylthio group (more preferably having from 1 to 29 carbon atoms), a substituted or unsubstituted alkylsulfoxy group (more preferably having from 1 to 29 carbon atoms), a substituted or unsubstituted arylsulfoxy group (more preferably a monocyclic or bicyclic group having from 6 to 29 carbon atoms), a substituted or unsubstituted alkylsulfonyl group (more preferably having from 1 to 29 carbon atoms), a substituted or unsubstituted arylsulfonyl group (more preferably a monocyclic or bicyclic group having from 1 to 29 carbon atoms), an aryloxy group (more preferably a monocyclic or bicyclic group having from 6 to 29 carbon atoms), a carbamoyl group (more preferably having from 1 to 29 carbon atoms), a sulfamoyl group (more preferably from 1 to 29 carbon atoms), a hydroxyl group, a halogen atom (Such as F, Cl, Br, I), a sulfo group, and a carboxyl group. Of these substituents, those capable of being substituted may further have a substituent selected from an alkyl group having from 1 to 20 carbon atoms, a monocyclic or bicyclic aryl group having from 6 to 20 carbon atoms, an alkoxy group having from 1 from 20 carbon atoms, an aryloxy group having from 6 to 20 carbon atoms, an alkylthio group having from 1 to 20 carbon atoms, an arylthio group having from 6 to 20 carbon atoms, an alkylsulfonyl group having from 1 to 20 carbon atoms, an arylsulfonyl group having from 6 to 20 carbon atoms, a carbonamido group having from 1 to 20 carbon atoms, a sulfonamido group having up to 20 carbon atoms, a carbamoyl group having from 1 to 20 carbon atoms, a sulfamoyl group having from 1 to 20 carbon atoms, an alkylsulfoxy group having from 1 to 20 carbon atoms, an arylsulfinyl group having from 6 to 20 carbon atoms, an ester group having from 2 to 20 carbon atoms, a hydroxyl group, —COOM, —$SO_2M$ (wherein M represents a hydrogen atom, an alkali metal atom, or a substituted or unsubstituted ammonium group), and a halogen atom (such as F, Cl, Br, I). Specific examples of these compounds of formula (V) as well as the method of synthesis are described, e.g., in R. B. Wagner and H. D. Zook, *Synthetic Organic Chemistry*, p. 556 and 576.

N-substituted hydroxylamines of formula (V), which may be used in the present invention, include, but are not limited to, the specific examples shown below.

$CH_3CH_2CONHOH$ V-1 n-$C_{15}H_{31}CONHOH$ V-2 n-$C_{12}H_{25}NHOH$ V-3 n-$C_{17}H_{34}CONHOH$ V-4

V-5

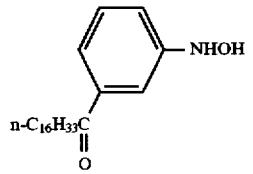

V-6

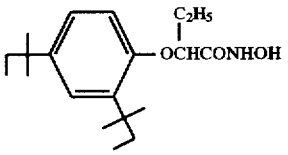

V-7

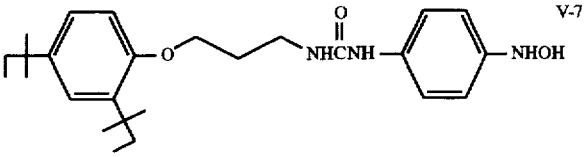

V-8

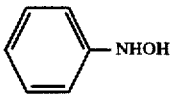

V-9

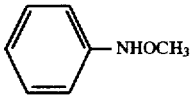

Examples of suitable hydrazine derivatives which can be used as quinone trapping agents are described in Research Disclosure, No. 23510 (1983) and references cited therein, U.S. Pat. No. 4,478,928, JP-A-60-140338, JP-A-60-179734, JP-A-59-195231, JP-A-59-195233, JP-A-59-201045, JP-A-59-201046, JP-A-59-201047, JP-A-59-201048, and JP-A-59-201049 the contents of which are herein incorporated by reference. Preferred of these hydrazine derivatives are those having a weaker ability to endow light-sensitive materials with high contrast characteristics than the compound of formula (I) which is used for obtaining high contrast characteristics. Particularly preferred compounds are those represented by formula (VI):

$$Ar-\underset{\underset{R_0}{|}}{N}-\underset{\underset{R_{00}}{|}}{N}-G-B \qquad (VI)$$

wherein Ar represents a substituted or unsubstituted phenyl group or a substituted or unsubstituted naphthyl group; G represents a carbonyl group or a sulfonyl group; B represents a formyl group, a substituted or unsubstituted acyl group, a substituted or unsubstituted alkylsulfonyl group, a substituted or unsubstituted arylsulfonyl group, a substituted or unsubstituted alkylsulfinyl group, a substituted or unsubstituted aryl-sulfinyl group, an N-substituted or unsubstituted carbamoyl group, an N-substituted or unsubstituted sulfamoyl group, an alkoxycarbonyl group, an aryloxycarbonyl group, an N-substituted or unsubstituted sulfinamoyl group, a substituted or unsubstituted thioacyl group, or a 5- or 6-membered heterocyclic group; and at least one of $R_0$ and $R_{00}$ represents a hydrogen atom, with the other representing a substituted or unsubstituted arylsulfonyl group or a substituted or unsubstituted acyl group.

Of the compounds represented by formula (VI), preferred are those represented by formula (VIa):

$$Ar-NHNH-G-B \qquad (VIa)$$

wherein Ar represents a phenyl group which is substituted so that the sum of the Hammett's σ values may be −0.5 or less; G represents a sulfonyl group or a carbonyl group; and B represents a substituted or unsubstituted alkyl group or a substituted or unsubstituted aryl group.

Substituents on a phenyl group as represented by Ar in formula (VIa) include a straight chain, branched or cyclic alkyl group (preferably having from 1 to 20 carbon atoms), an aralkyl group (preferably a monocyclic or bicyclic group having from 1 to 3 carbon atoms in the alkyl moiety thereof), an alkoxy group (preferably having from 1 to 20 carbon atoms), a mono- or disubstituted amino group (preferably substituted with an alkyl, acyl, alkylsulfonyl or arylsulfonyl group having up to 20 carbon atoms; the total carbon atom number of the substituents of the disubstituted amino group being not more than 20 carbon atoms), a mono-, di- or tri-substituted or unsubstituted ureido group (preferably having from 1 to 29 carbon atoms), a substituted or unsubstituted aryl group (preferably a monocyclic or bicyclic group having from 6 to 29 carbon atoms), a substituted or unsubstituted arylthio group (preferably having from 6 to 29 carbon atoms), a substituted or unsubstituted alkylthio group (preferably having from 1 to 29 carbon atoms), a substituted or unsubstituted alkylsulfoxy group (preferably having from 1 to 29 carbon atoms), a substituted or unsubstituted arylsulfoxy group (preferably a monocyclic or bicyclic group having from 6 to 29 carbon atoms), a substituted or unsubstituted alkylsulfonyl group (preferably having from 1 to 29 carbon atoms), a substituted or unsub- stituted arylsulfonyl group (preferably a monocyclic or bicyclic group having from 6 to 29 carbon atoms), an aryloxy group (preferably a monocyclic or bicyclic group having from 6 to 29 carbon atoms), a carbamoyl group (preferably from 1 to 29 carbon atoms), a sulfamoyl group (preferably from 1 to 29 carbon atoms), a hydroxyl group, a halogen atom (such as F, Cl, Br, I), a sulfo group, or a carboxyl group. Of these substituents, those capable of being substituted may further have a substituent selected from an alkyl group (having from 1 to 20 carbon atoms), a monocyclic or bicyclic aryl group (having from 6 to 20 carbon atoms), an alkoxy group (having from 1 from 20 carbon atoms), an aryloxy group (having from 6 to 20 carbon atoms), an alkylthio group (having from 1 to 20 carbon atoms), an arylthio group (having from 6 to 20 carbon atoms), an alkylsulfonyl group (having from 1 to 20 carbon atoms), an arylsulfonyl group (having from 6 to 20 carbon atoms), a carbonamido group (having from 1 to 20 carbon atoms), a sulfonamido group (having up to 20 carbon atoms), a carbamoyl group (having from 1 to 20 carbon atoms), a sulfamoyl group (having from 1 to 20 carbon atoms), an alkylsulfoxy group (having from 1 to 20 carbon atoms), an arylsulfinyl group (having from 6 to 20 carbon atoms), an ester group (having from 2 to 20 carbon atoms), a hydroxyl group, —COOM, —$SO_2M$ (wherein M represents a hydrogen atom, an alkali metal atom, or a substituted or unsubstituted ammonium group), and a halogen atom (such as F, Cl, Br, I). These substituents may optionally be connected to each other to form a ring.

Compounds represented by formula (VI-a) which can be used according to the present invention include, but are not limited to the specific examples shown below.

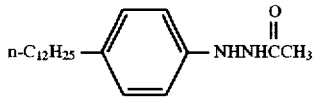

VIa-1

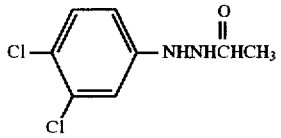

VIa-2

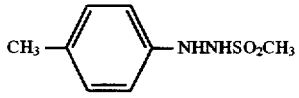

VIa-3

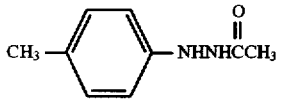

VIa-4

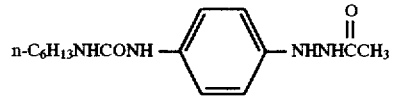

VIa-5

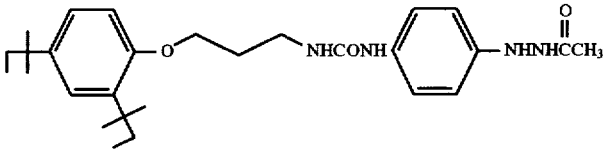

VIa-6

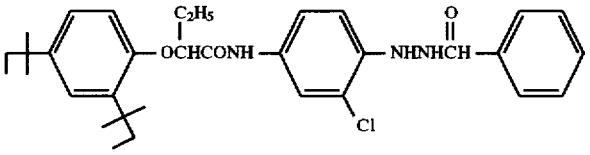

VIa-7

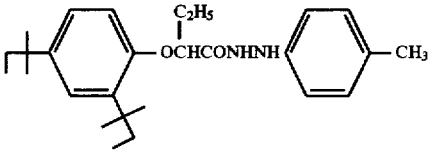

VIa-8

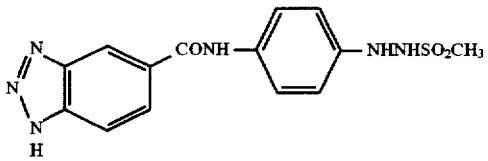

VIa-9

-continued

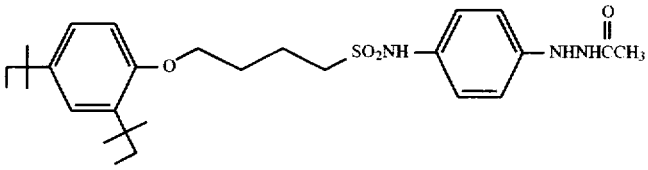

VIa-10

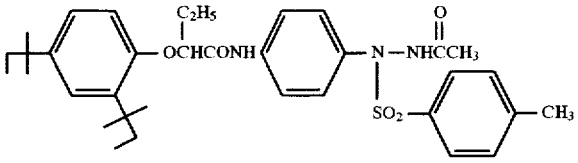

VIa-11

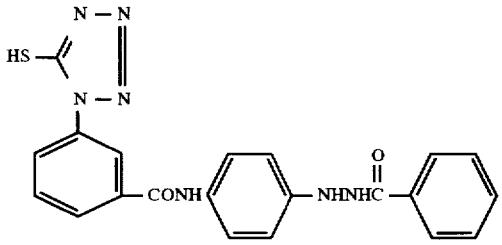

VIa-12

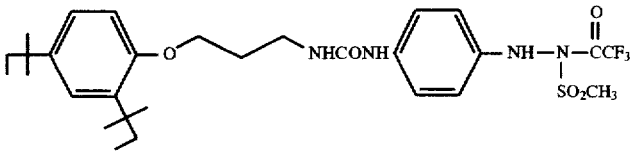

VIa-13

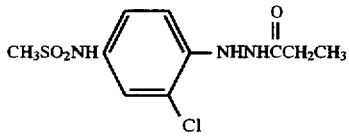

VIa-14

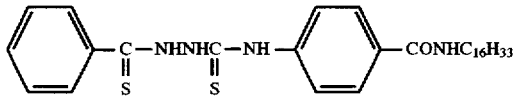

VIa-15

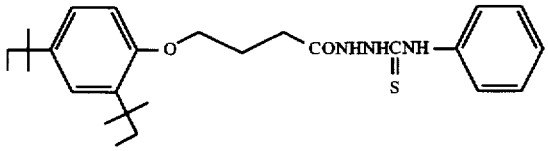

VIa-16

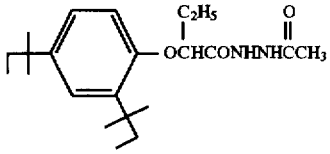

VIa-17

In addition to the above-described hydrazine compounds, hydrazine derivatives described in JP-A-59-195233, JP-A-59-200231, JP-A-59-201045, JP-A-59-201046, JP-A-59-201047, JP-A-59-201048, and JP-A-59-201649 may also be used effectively in the present invention.

Cyclic hydrazide compounds represented by formula (VII), shown below, are also effective:

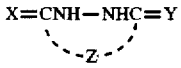

(VII)

wherein Z represents an atomic group necessary to form a 5- or 6-membered heterocyclic ring; and X and Y each represents an oxygen atom, =N—R (wherein R represents a hydrogen atom, a substituted or unsubstituted alkyl group, or a substituted or unsubstituted phenyl group), or a sulfur atom.

Compounds represented by formula (VII) used according to the present invention include, but are not limited, to the specific examples shown below.

VII-1

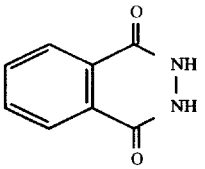

VII-2

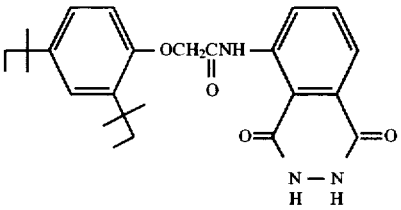

VII-3

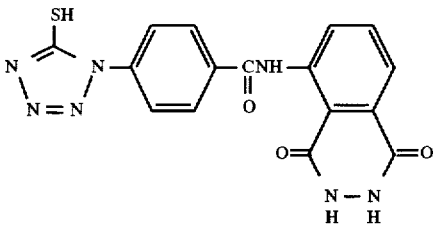

VII-4

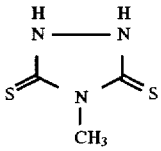

VII-5

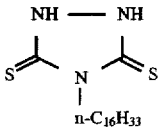

VII-6

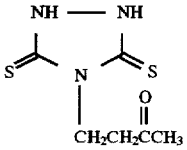

VII-7

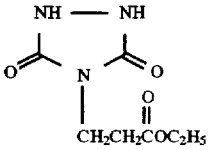

VII-8

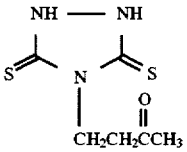

VII-9

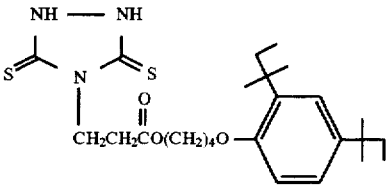

-continued

VII-10

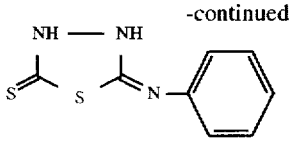

VII-11

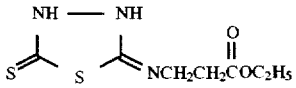

VII-12

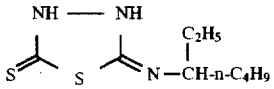

Reductones which can be used in the present invention as quinone trapping agents include, e.g., endiol type compounds, thiol-enol type compounds, enaminol type compounds, endiamin type compounds, and enamin-thiol type compounds. Specific examples of such reductones and methods of synthesis are well known in the art. For example, as presented, in Otsugu Nomura and Hirohisa Ohmura, *Reductone no kagaku*, Uchida Rokakuho Shinsha (1969).

Of such compounds, particularly preferred are 3-carbonyl-endiol compounds represented by formula (VIII), aminoreductones represented by formula (IX), and imino-reductones represented by formula (X).

Formula (VIII) is presented as follows:

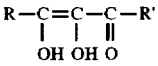

(VIII)

wherein R and R', which may be the same or different, each represents an alkyl group, an alkyl group substituted with a hydroxyl group, an alkoxy group, an aryl group, a carboxyl group, an amino group, or an imino group, an allyl group, an aryl group, or an aryl group substituted with a hydroxyl group, an alkoxy group, an aryl group, a carboxyl group, a halogen atom, or an amino group; or R and R' are connected to each other via a carbon-carbon bond or an oxygen atom, a nitrogen atom or a sulfur atom therebetween to form a ring.

Alkyl or aryl ethers or esters of compounds of formula (VIII) may also be used as a precursors which are capable of producing compounds of formula (VIII).

Formulas (IX) and (X) are presented as follows:

(IX)

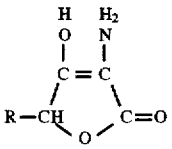

(X)

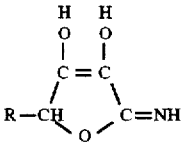

wherein R has the same meaning as defined above for Formula (VIII).

Particularly preferred reductones include, but are not limited to, the specific examples shown below.

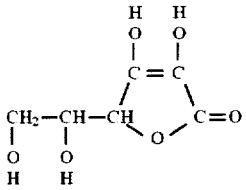
(IX-1)
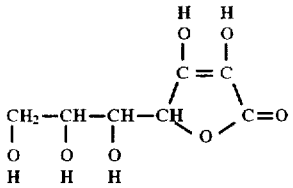
(IX-2)
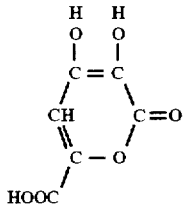
IX-3
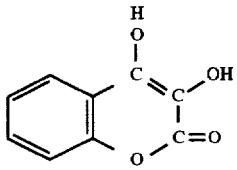
IX-4
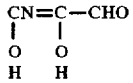
IX-5
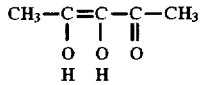
IX-6
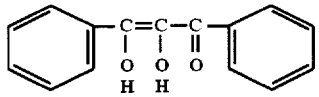
IX-7
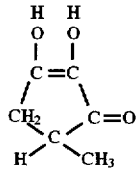
IX-8
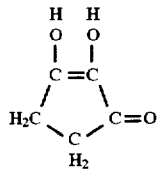
IX-9
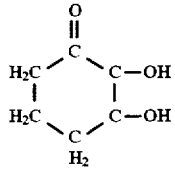
IX-10
-continued
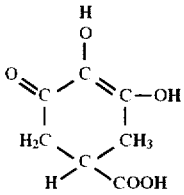
IX-11
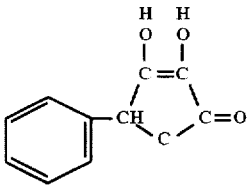
IX-12
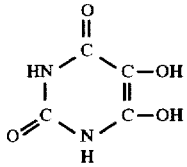
IX-13
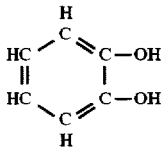
IX-14
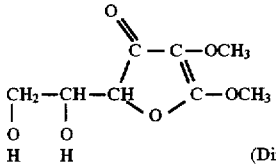
IX-15
(Dimethylether of IX-1)
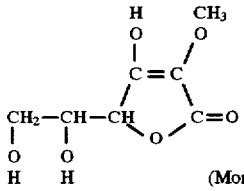
IX-16
(Monomethylether of IX-1)
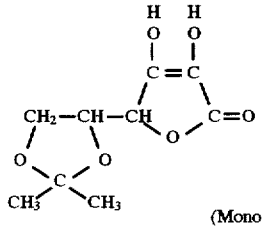
IX-17
(Monoacetone Derivative of IX-1)
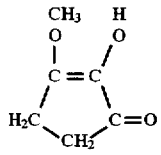
IX-18
(Monomethylether of IX-9)

-continued

IX-19

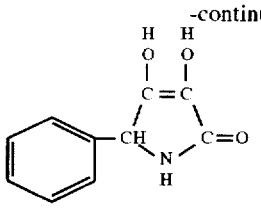

X-1

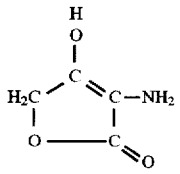

Others

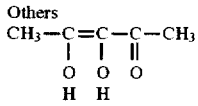

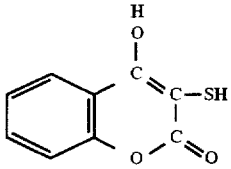

The above-described quinone trapping agent is incorporated into a second silver halide emulsion layer. Incorporation of the quinone trapping agent can be carried out in the same manner as described with respect to the compound of formula (II).

The quinone trapping agent is usually used in an amount of from about $1\times10^{-6}$ to $1\times10^{-1}$ mol, and preferably from about $1\times10^{-5}$ to $5\times10^{-2}$ mol, per mol of silver halide.

Ascorbic acid derivatives which can be used in the present invention include, but are not limited, to the specific examples shown below.

XI-1: Ascorbyl stearate
XI-2: Ascorbyl palmitate
XI-3: Ascorbyl 2,6-dipalmitate
XI-4: Ascorbic acid
XI-5: Sodium ascorbate
XI-6: l-Erythroascorbic acid
XI-7: d-Glucoascorbic acid
XI-8: 6-Deoxy-l-ascorbic acid
XI-9: l-Rhamnoascorbic acid
XI-10: l-Fucoascorbic acid
XI-11: d-Glucoheptoascorbic acid The amount of the ascorbic acid derivative which may be used is not particularly limited and usually ranges from about $1\times10^{-6}$ to $2\times10^{-4}$ mol, and preferably from about $6\times10^{-6}$ to $1\times10^{-4}$ mol, per $m^2$ of a silver halide light-sensitive material of the present invention.

If desired, the ascorbic acid can be incorporated into light-sensitive materials of the present invention in the form of a solution in water or in a low-boiling organic solvent (e.g., methanol). In the case where the above-described redox compound is incorporated into light-sensitive materials in the form of an emulsified dispersion together with a polymer, the ascorbic acid may be added to the aqueous colloid at the time of dispersion or may be dissolved in a low-boiling organic solvent together with the redox compound and the polymer, and then dispersed by emulsification.

Silver halide emulsions which can be used in the present invention may have any halogen composition, such as silver chloride, silver chlorobromide, silver iodobromide, and silver iodochlorobromide.

Fine silver halide grains (e.g., having a mean grain size of about 0.7 μm or less) are preferred to be used in the present invention. A particularly preferred mean grain size is about 0.5 μm or less. Grain size distribution is not essentially limited, but a monodispersion is preferred. The term "monodispersion", as used herein, means a dispersion in which at least about 95% of the weight or number of grains fall within a size range of about ±40% of a mean grain size.

Silver halide grains in a photographic emulsion may have a regular crystal form, such as a cubic form and an octahedral form, or an irregular crystal form, such as a spherical form and a plate-like form, or a composite form of these types of crystal forms.

Individual silver halide grains may have a uniform phase or different phases between the inside and the surface layer thereof. Two or more different silver halide emulsions separately prepared may be used as a mixture.

During silver halide grain formation or physical ripening of grains, a cadmium salt, a sulfite salt, a lead salt, a thallium salt, a rhodium salt or a complex thereof, an iridium salt or a complex thereof, may be present in the system.

Emulsion layers or other hydrophilic colloidal layers of the light-sensitive material according to the present invention may comprise a water-soluble dye as a filter dye or an anti-irradiation dye or for various other purposes. Filter dyes which can be used according to the present invention are dyes for reducing photographic sensitivity, preferably ultraviolet absorbers having a spectral absorption maximum in the intrinsic sensitivity region (of silver halide and dyes showing substantial light absorption) in the range of from about 350 to 600 nm, which dyes are used for improving safety against safelight in handling of light-sensitive materials.

Such dyes are preferably fixed, by using a mordant, to an emulsion layer or a light-insensitive hydrophilic colloidal layer farther from a support than a silver halide emulsion layer depending on the purpose. The dyes are added usually in an amount of from about $1\times10^{-3}$ to 1 g/$m^2$, and preferably from about 50 to 500 mg per $m^2$ of a light-sensitive material of the present invention, though varying depending on the molar absorption coefficient of the dye.

Specific examples of suitable dyes are described in JP-A-63-64039, and also include, but are not limited to, the following specific examples.

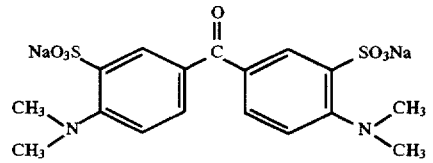

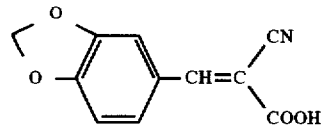

-continued

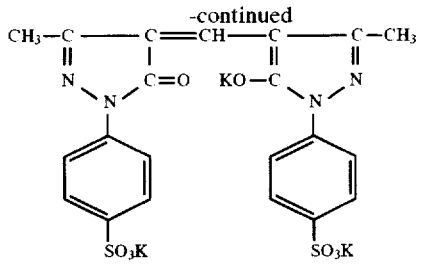

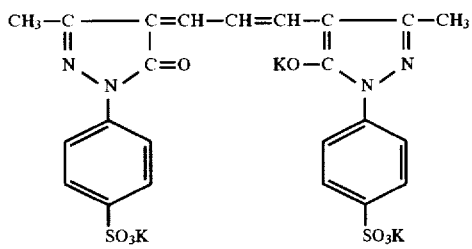

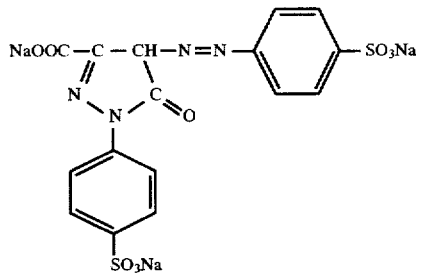

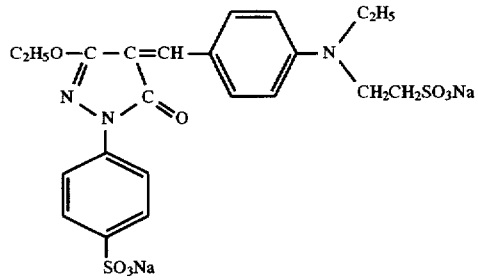

Such dyes may be used either individually or in combination of two or more thereof. The dyes are added to a coating composition, for a light-sensitive and/or light-insensitive hydrophilic colloidal layer, in the form of a solution in an appropriate solvent, e.g., water, an alcohol (e.g., methanol, ethanol, propanol), acetone, methyl cellosolve, or a mixture thereof.

Binders or protective colloids which can be used in the photographic emulsions, used according to the present invention, preferably include gelatin. Hydrophilic colloids other than gelatin may also be utilized, including proteins (e.g., gelatin derivatives, graft polymers of gelatin and other high polymers, albumin, and casein); cellulose derivatives (e.g., hydroxyethyl cellulose, carboxymethyl cellulose, and cellulose sulfate); sugar derivatives (e.g., sodium alginate and starch derivatives); and a variety of synthetic hydrophilic high polymers (e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole); as well as copolymers comprising monomers constituting these homopolymers.

Gelatins which may be used in the present invention include lime-processed gelatins, acid-processed gelatins, hydrolysis products of gelatin, and enzymatic decomposition products of gelatin.

Silver halide emulsions which can be used in the present invention may or may not be chemically sensitized. Chemical sensitization of silver halide emulsions is carried out by any known techniques, such as sulfur sensitization, reduction sensitization, and noble metal sensitization, either alone or in combination thereof.

Among the noble metal sensitization techniques, typical is gold sensitization using a gold compound, usually a gold complex. Complexes of noble metals other than gold, e.g., platinum, palladium and iridium, may also be employed. Specific examples of these noble metal compounds are described in U.S. Pat. No. 2,448,060 and British Patent 618,061.

Sulfur sensitization is effected by using a sulfur compound contained in gelatin as well as various sulfur compounds, e.g., thiosulfates, thioureas, thiazoles, and rhodanines.

Reduction sensitization is carried out by using a reducing compound, e.g., stannous salts, amines, formamidinesulfinic acid, and silane compounds.

Silver halide emulsion layers used in the present invention may further comprise known spectral sensitizing dyes.

For prevention of fog during preparation, preservation or photographic processing of the light-sensitive material or for stabilization of photographic properties, various compounds can be introduced into light-sensitive materials of the present invention. Such compounds include, e.g., azoles (such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, and nitrobenzotriazoles); mercaptopyrimidines; mercaptotriazines; thioketo compounds (such as oxazolinethione); azaindenes (such as triazaindenes, tetraazaindenes (especially4-hydroxy-substituted (1,3,3a,7)-tetraazaindenes), and pentaazaindenes); benzenethiosulfonic acids, benzenesulfinic acids, benzenesulfonic acid amides, and other compounds known as antifoggants or stabilizers. Preferred of these compounds are benzotriazoles (e.g., 5-methylbenzotriazole) and nitroindazoles (e.g., 5-nitroindazole). If desired, these compounds may be introduced into a processing solution.

Photographic emulsion layers or other hydrophilic colloidal layers used in the present invention may comprise an organic or inorganic hardening agent, such as chromates (e.g., chromium alum), aldehydes (e.g., formaldehyde and glutaraldehyde), N-methylol compounds (e.g., dimethylolurea), dioxane derivatives, active vinyl compounds (e.g., 1,3,5-triacryloylhexahydro-s-triazine and 1,3-vinylsulfonyl-2-propanol), active halogen compounds (e.g., 2,4-dichloro-6-hydroxy-s-triazine), and mucohalogenic acids, either individually or in combination thereof.

Photographic emulsion layers or other hydrophilic colloidal layers may further comprise various surface active agents for the purpose of enhancing coating, preventing static charge, improving slip properties, emulsifying and aiding dispersion, preventing blocking, and improving photographic characteristics (e.g., acceleration of development, increased contrast, and increased sensitivity).

Useful surface active agents include, e.g., nonionic surface active agents, such as saponin (steroid type), alkylene oxide derivatives (e.g., polyethylene glycol, polyethylene glycol/polypropylene glycol condensates, polyethylene glycol alkyl ethers or polyethylene glycol alkylaryl ethers, polyethylene glycol sorbitan esters, polyalkylene glycol alkylamines or amides, polyethylene oxide adducts of silicone), glycidol derivatives (e.g., alkenylsuccinic acid polyglycerides, and alkylphenol polyglycerides), fatty acid esters of polyhydric alcohols, and alkyl esters of saccharides; anionic surface active agents containing an acid group (e.g., a carboxyl group, a sulfo group, a phospho group, a sulfuric ester group, and a phosphoric ester group, such as alkylcarboxylic acid salts, alkylsulfonates, alkylbenzenesulfonates, alkylnaphthalenesulfonates, alkylsulfates, alkylphosphates, N-acyl-N-alkyltaurines, sulfosuccinic esters, sulfoalkyl polyoxyethylene alkylphenyl ethers, and polyoxyethylene alkylphosphates); amphoteric surface active agents (such as amino acids, aminoalkylsulfonic acids, aminoalkylsulfates or phosphates, alkylbetaines and amine oxides); and cationic surface active agents, such as alkylamines, aliphatic or aromatic quaternary ammonium salts, heterocyclic quaternary ammonium salts (e.g., pyridinium salts, and imidazolium salts, and phosphonium or sulfonium salts containing an aliphatic or heterocyclic ring).

Surface active agents which are particularly useful in the present invention are polyalkylene oxides having a molecular weight of from about 600 or more as disclosed in JP-B-58-9412. For the particular purpose of improving dimensional stability, polymer lattices, such as polyalkyl acrylates, may be used.

Examples of development accelerators or a nucleation infectious development accelerators which can be suitably used in the present invention include the compounds disclosed in JP-A-53-77616, JP-A-54-37732, JP-A-53-137133, JP-A-60-140340, and JP-A-60-14959, as well as various compounds containing a nitrogen or sulfur atom.

Development accelerators include, but are not limited to, the following specific examples.

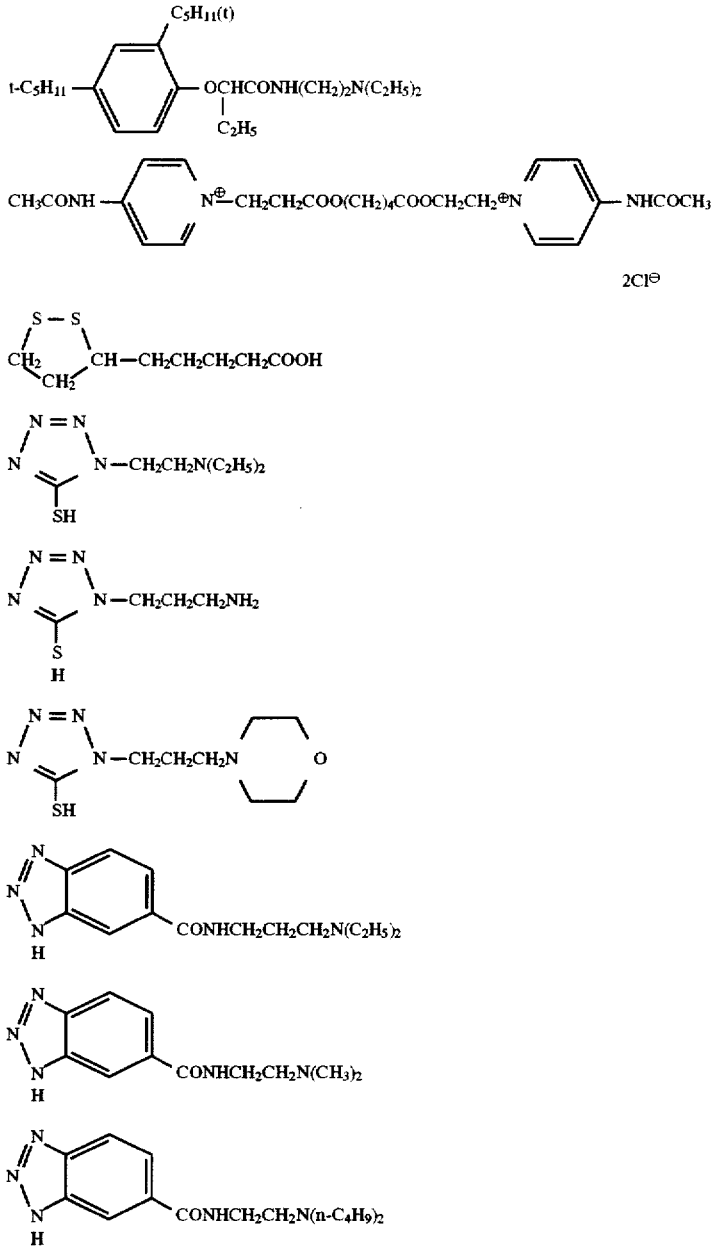

-continued

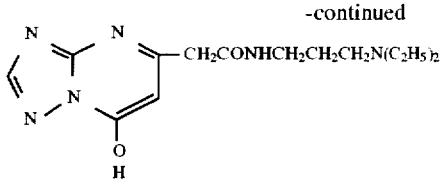

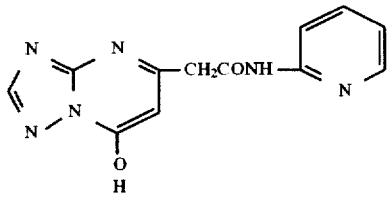

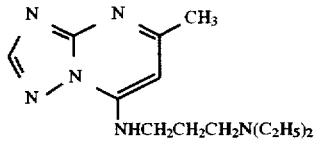

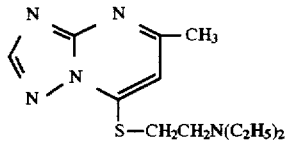

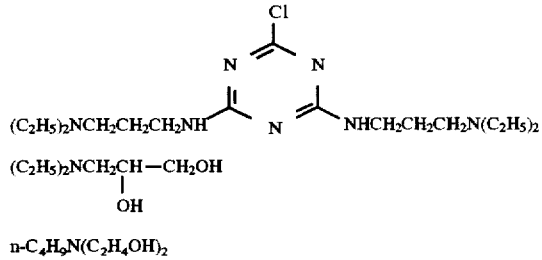

These accelerators may be used in an amount usually of from about $1.0\times10^{-3}$ to 0.5 g/m$^2$, and preferably from about $5.0\times10^{-3}$ to 0.1 g/m$^2$ of a silver halide light-sensitive material of the present invention, although the optimum amount varies depending on the type of the compound.

Development accelerators can be incorporated into coating compositions in the form of a solution in an appropriate solvent, e.g., water, alcohols (e.g., methanol and ethanol), acetone, dimethylformamide, and methyl cellosolve.

The above-mentioned additives may be used either individually or in combination of two or more types thereof.

Silver halide light-sensitive materials of the present invention can be processed with stable developing solutions to obtain ultrahigh contrast characteristics. There is no need to use conventional infectious developers or highly alkaline developers having a pH of nearly 13, e.g., as described in U.S. Pat. No. 2,419,975.

More specifically, a negative image having sufficiently high contrast can be obtained by processing silver halide light-sensitive materials of the present invention with a developer comprising at least about 0.15 mol/l of a sulfite ion as a preservative and having a pH between about 10.5 and 12.3, particularly between about 11.0 and 12.0.

Developing agents which can be used in a developing solution is not particularly limited. For example, dihydroxybenzenes (e.g., hydroquinone), 3-pyrazolidones (e.g., 1-phenyl- 3-pyrazolidone and 4,4-dimethyl-1-phenyl-3-pyrazolidone), and aminophenols (e.g., N-methyl-p-aminophenol) may be used either alone or in combinations thereof.

A combination of a dihydroxybenzene (as a main developing agent) and a 3-pyrazolidone or an aminophenol (as an auxiliary developing agent) is particularly suitable for development of light-sensitive materials according to the present invention. In this type of a developing solution, the developing agent is preferably used in an amount of from about 0.05 to 0.5 mol/l, and the auxiliary developing agent is preferably used in an amount of less than about 0.06 mol/l.

Addition of an amine compound to a developing solution used according to the present invention is effective in increasing the rate of development, thereby to shorten the time of development, as suggested, e.g., in U.S. Pat. No. 4,269,929.

Developing solutions may further comprise a pH buffering agent (e.g., sulfites, carbonates, borates or phosphates of alkali metals) and development restrainers or antifoggants (e.g., bromides, iodides, and organic antifoggants, wherein nitroindazoles or benzotriazoles are particularly preferred). If desired, the developing solution may further comprise one or more of a water softener, a dissolution aid, toning agents, a development accelerator, a surface active agent (the above-described polyalkylene oxides are particularly preferred), a defoaming agent, a hardening agent, a silver stain inhibitor (e.g., 2-mercaptobenzimidazolesulfonic acids), and other known developing solution additives.

Useful compounds as silver stain inhibitors are described, e.g., in JP-A-56-24347. Compounds described in JP-A-61-267759 are particularly useful as dissolution aids. Useful pH buffering agents are described, e.g., in JP-A-60-93433 and JP-A-62-186259.

Fixing solutions having any of known compositions may be used. Suitable fixing agents which may be used in the present invention include, e.g., thiosulfates, thiocyanates, and organic sulfur compounds known to be effective as fixing agents. Fixing solutions may contain a water-soluble aluminum salt, or other hardening agent.

Processing temperatures usually range from about 18° to 50° C.

Photographic processing of light-sensitive materials of the present invention are desirably carried out by means of an automatic developing machine. Light-sensitive materials according to the present invention provide negative images having sufficiently high contrast even when the overall processing time of from entering into an automatic developing machine until withdrawal is set in the range from about 90 to 120 seconds.

The present invention is now illustrated in greater detail by way of the following Examples, but it should be understood that the present invention is not deemed to be limited thereto. All the percents, parts, and ratios are by weight unless otherwise indicated.

Preparation of Light-Sensitive Emulsions A to E

Emulsion A

A silver nitrate aqueous solution and a mixed aqueous solution of potassium iodide and potassium bromide were simultaneously added to a gelatin aqueous solution kept at 50° C. for 60 minutes in the presence of $4\times10^{-7}$ mol/mol-Ag of potassium hexachloroiridate (III) and ammonia while maintaining a pAg at 7.8 to prepare a monodispersed emulsion of cubic silver halide grains having a mean grain size of 0.28 μm and an average silver iodide content of 0.3 mol %. After the emulsion was desalted by a flocculation method, 40 g/mol-Ag of inert gelatin was added thereto. 5,5'-Dichloro-9-ethyl-3,3'-bis(3-sulfopropyl) oxacarbocyanine as a sensitizing dye and an aqueous solution of $10^{-3}$ mol/mol-Ag of potassium iodide were added to the emulsion while maintaining at 50° C. After allowing the emulsion to stand for 15 minutes, the temperature was decreased. The resulting emulsion was designated Emulsion A.

Emulsion B

A silver nitrate aqueous solution and a sodium chloride aqueous solution were simultaneously added to a gelatin aqueous solution kept at 50° C. in the presence of $5.0\times10^{-6}$ mol/mol-Ag of $(NH_4)_3RhCl_6$. After soluble salts were removed by a well-known method, gelatin was added to the emulsion. To the primitive emulsion was added 2-methyl-4-hydroxy-1,3,3a,7-tetraazaindene as a stabilizer to obtain a monodispersed emulsion of cubic grains having a mean grain diameter of 0.15 μm. The resulting emulsion was designated Emulsion B.

Emulsion C

Emulsion C was prepared in the same manner as for Emulsion A, except that 5,5'-dichloro-9-ethyl-3,3'-bis(3-sulfopropyl)oxacarbocyanine was not used.

Emulsion D

Emulsion D was prepared in the same manner as for Emulsion A, except for replacing 5,5'-dichloro-9-ethyl-3,3'-bis(3-sulfopropyl)oxacarbocyanine with the following compound S-1 and further adding the following compound S-1'.

S-1:

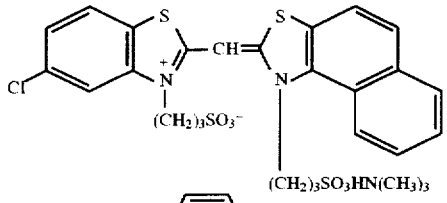

S-1':

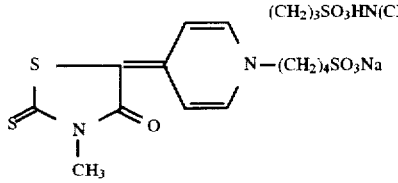

Emulsion E

A silver nitrate aqueous solution and a mixed aqueous solution of sodium chloride and potassium bromide containing $2.7\times10^{-7}$ mol/mol-Ag of ammonium hexachlororhodate (III) and $4\times10^{-7}$ mol/mol-Ag of potassium hexachloroiridate (III) were added simultaneously to a gelatin aqueous solution (pH=4.0) kept at 50° C. at a constant feed rate over 30 minutes to prepare a mono-dispersed emulsion of silver bromide having a mean grain diameter of 0.23 μm and a chlorine content of 70 mol %. After soluble salts were removed by a well-known washing method, sodium thiosulfate and potassium chloroaurate were added thereto to conduct chemical sensitization. To the emulsion was further added a solution of 0.1 mol %/mol-Ag of potassium iodide to conduct conversion of the grain surface. The emulsion was maintained at 50° C., and $2.7\times10^{-4}$ mol/mol-Ag of the following compound S-2 as a sensitizing dye. Fifteen minutes later, the temperature was decreased. The resulting emulsion was designated Emulsion E.

S-2:

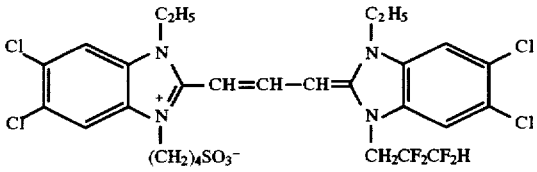

EXAMPLE 1

A gelatin layer containing 1.5 g/m² of gelatin, Emulsion A in an amount corresponding to 0.3 g/m² of Ag, and the redox compound and/or quinone trapping agent shown in Table 1 below was coated on a 150 μm thick polyethylene terephthalate film having a 0.5 μm thick subbing layer comprising a vinylidene chloride copolymer.

Emulsion A was re-melted, and $7.1\times10^{-5}$ mol/m² of hydrazine nucleating agent II-5 was added thereto at 40° C. Further, 0.02 mol/mol-Ag of methyl hydroquinone, 5-methylbenzotriazole, 4-hydroxy-1,3,3a,7-tetraazaindene, compounds (a) and (b) shown below, polyethyl acrylate (30% based on gelatin), and compound (c) shown below as a gelatin hardening agent were added thereto. The resulting coating composition was coated on the gelatin layer to a silver coverage of 3.4 g/m² and dried to form a light-sensitive emulsion layer.

Compound (a): 3.5 mg/m²

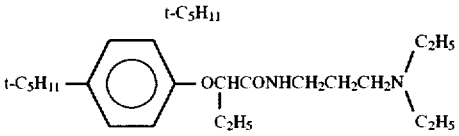

Compound (b): 15.0 mg/m²

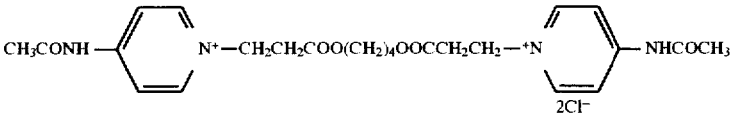

Compound (c): 2.0 wt % based on gelatin

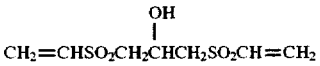

A composition comprising 1.5 g/m² of gelatin, 0.3 g/m² of polymethyl methacrylate particles (mean particle size: 2.5 μm), and the surface active agents shown below was coated on the light-sensitive emulsion layer and dried to form a protective layer.

| Surface Active Agents: | |
|---|---|
| 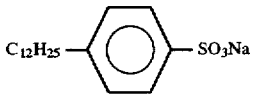 | 37 mg/m² |
| $CH_2COOC_6H_{13}$<br>\|<br>$CHCOOC_6H_{13}$<br>\|<br>$SO_3Na$ | 37 mg/m² |
| $C_8F_{17}SO_2N(C_3H_7)CH_2COOK$ | 2.5 mg/m² |

Each of the resulting samples was exposed to tungsten light of 3200° K. through an optical wedge and a contact screen ("150L Chain Dot Type", produced by Fuji Photo Film Co., Ltd.), developed with a developer having the following formulation at 34° C. for 30 seconds, fixed with a fixer ("GR-F1" produced by Fuji Photo Film Co., Ltd.), washed, and dried.

| Developer Formulation: | |
|---|---|
| Hydroquinone | 50.0 g |
| N-Methyl-p-aminophenol | 0.3 g |
| Sodium hydroxide | 18.0 g |
| 5-Sulfosalicylic acid | 55.0 g |
| Potassium sulfite | 110.0 g |
| Disodium ethylenediaminetetraacetate | 1.0 g |
| Potassium bromide | 10.0 g |

-continued

| Developer Formulation: | |
|---|---|
| 5-Methylbenzotriazole | 0.4 g |
| 2-Mercaptobenzimidazole-5-sulfonic acid | 0.3 g |
| Sodium 3-(5-mercaptotetrazole)benzenesulfonate | 0.2 g |
| N-n-Butyldiethanolamine | 15.0 g |
| Sodium toluenesulfonate | 8.0 g |
| Water to make | 1 l |
| pH (adjusted with potassium hydroxide) | pH 11.6 |

Photographic properties of the thus processed samples were determined in term of the following items, and the results obtained are shown in Table 1 below.

1. Gradient (G):

A slope of the straight line connecting the point at a density of 0.3 and the point at a density of 3.0 in the characteristic curve. The higher the value G, the higher the contrast.

2. Dot Gradation:

Dot Gradation=Exposure amount providing dot area ratio of 95% (logE 95%)—Exposure amount providing dot area ratio of 5% (logE 5%)

3. $D_{max}$:

A density at an exposure amount larger than the exposure amount providing a density of 1.5 by 0.4 in terms of $^{\Delta logE}$.

As is apparent from the results shown in Table 1, the samples according to the present invention have broadened dot gradation. The dots of the samples of the invention have a smooth shape and a high optical density.

TABLE 1

| Sample No. | Redox Compound Kind | Redox Compound Amount (mol/m²) | Quinone Trapping Agent Kind | Quinone Trapping Agent Amount (mol/m²) | G | Dot Gradation | $D_{max}$ | Remark |
|---|---|---|---|---|---|---|---|---|
| 101 | — | — | — | — | 14.5 | 1.23 | 4.8 | Comparison |
| 102 | I-17 | $20 \times 10^{-5}$ | — | — | 14.0 | 1.45 | 4.3 | " |
| 103 | I-34 | " | — | — | 14.5 | 1.48 | 4.4 | " |
| 104 | I-38 | " | — | — | 13.5 | 1.43 | 4.4 | " |
| 105 | I-17 | " | VIa-10 | $1.0 \times 10^{-5}$ | 14.5 | 1.46 | 4.6 | Invention |
| 106 | I-34 | " | " | " | 14.5 | 1.49 | 4.8 | " |
| 107 | I-38 | " | " | " | 14.0 | 1.45 | 4.8 | " |
| 108 | I-17 | " | VIb-8 | $2.0 \times 10^{-5}$ | 14.5 | 1.46 | 4.5 | " |
| 109 | I-34 | " | " | " | 14.5 | 1.49 | 4.8 | " |
| 110 | I-38 | " | " | " | 14.0 | 1.45 | 4.8 | " |

EXAMPLE 2

A coating composition comprising Emulsion B, the compounds according to the present invention as shown in Table 2 below, and 1,3-vinylsulfonyl-2-propanol as a hardening agent was coated on a polyester support to a silver coverage of 0.4 g/m² (gelatin coverage: 0.3 g/m²). After an intermediate layer comprising 0.5 g/m² of gelatin was coated thereon, a coating composition comprising Emulsion B, 15 mg/m² of hydrazine nucleating agent II-30, a polyethyl acrylate latex in an amount of 30 wt % (solid basis) based on gelatin, and 1,3-vinylsulfonyl-2-propanol in an amount of 2.0% based on gelatin as a hardening agent was coated on the intermediate layer to form a light-sensitive emulsion layer.

A coating composition comprising 1.5 g/m² of gelatin, 0.3 g/m² of polymethyl methacrylate particles (average particle size: 2.5 μm) as a matting agent, and the following surface active agents (coating aid), stabilizer, and ultraviolet absorber was then coated thereon and dried to form a protective layer.

Surface Active Agent:

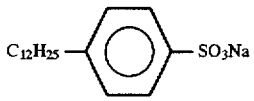

37 mg/m²

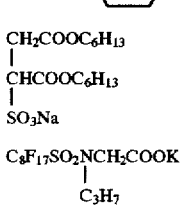

37 mg/m²

2.5 mg/m²

Stabilizer: 2.1 mg/m²
Thioctic acid
Ultraviolet Absorber: 100 mg/m²

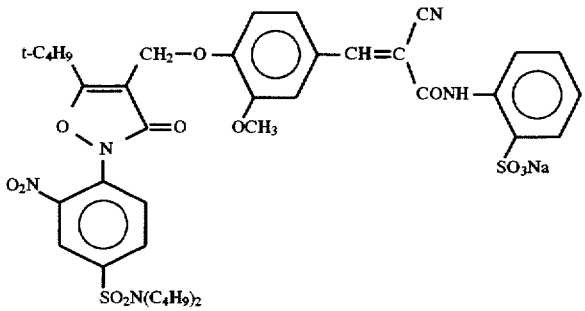

The thus prepared sample was imagewise exposed to light through an original, developed at 38° C. for 20 seconds, fixed, washed, and dried by using a bright room printer "P-607" available from Dainippon Screen Mfg. Co., Ltd. Image quality of the thus formed super-imposed letter image was evaluated and rated as follows.

5. Superimposed Letter Image Quality:

The sample was exposed to light at a proper exposure so that a dot area of 50% of the original might become a dot area of 50% on the light-sensitive material for contact work. As a result, when a letter having a line width of 30 μm could be reproduced, such image quality was rated "5" (best quality). On the other hand, with the exposure condition being equal, only a 150 μm wide letter could be reproduced, such image quality was rated "1" (worst quality). Image quality between "5" and "1" was rated "4" to "2" according to visual observation. Quality rated "3" or higher is a level acceptable for practical use.

The results obtained are shown in Table 2. It can be seen that the samples according to the present invention exhibit excellent superimposed image quality and have a high $D_{max}$.

TABLE 3

| | Redox Compound | | Quinone Trapping Agent | | | | |
|---|---|---|---|---|---|---|---|
| Sample No. | Kind | Amount (mol/m²) | Kind | Amount (mol/m²) | Image Quality | $D_{max}$ | Remark |
| 301 | — | — | — | — | 3.0 | 5.4 | Comparison |
| 302 | I-28 | $5.0 \times 10^{-5}$ | — | — | 4.0 | 5.0 | " |
| 303 | I-38 | " | — | — | 4.5 | 5.1 | " |
| 304 | I-4 | $7.0 \times 10^{-5}$ | — | — | 4.5 | 5.0 | " |
| 305 | I-41 | " | — | — | 4.0 | 4.9 | " |
| 306 | I-28 | $5.0 \times 10^{-5}$ | VIa-8 | $5.0 \times 10^{-5}$ | 4.5 | 5.3 | Invention |
| 307 | I-38 | " | " | " | 4.5 | 5.4 | " |
| 308 | I-4 | $7.0 \times 10^{-6}$ | " | $7.0 \times 10^{-6}$ | 4.5 | 5.4 | " |
| 309 | I-41 | " | " | " | 4.5 | 5.3 | " |

EXAMPLE 3

The following layers UL, ML, OL, and PC were coated in this order on a 150 μm thick polyethylene terephthalate film having a 0.5 μm thick subbing layer comprising a vinylidene chloride copolymer. Compounds (a) to (c) are the same as those used in Example 1.

UL:

Emulsion A was re-melted with gelatin at 40° C. and mixed with the following compounds to prepare a coating composition.

| | |
|---|---|
| 5-Methylbenzotriazole | 3 mg/m² |
| 4-Hydroxy-1,3,3a,7-tetraazaindene | 1.3 mg/m² |
| Compound (a) | 0.4 mg/m² |
| Compound (b) | 1.5 mg/m² |
| Compound (d) | 15.0 mg/m² |
| Polyethyl acrylate | 30% based on gelatin |
| Compound (c) | 4.0% based on gelatin |
| (gelatin hardening agent) | |
| Redox compound (I-51) | $6.4 \times 10^{-5}$ mol/m² |

The coating composition was coated to a silver coverage of 0.4 g/m² (gelatin coverage: 0.5 g/m²).

Compound (d):

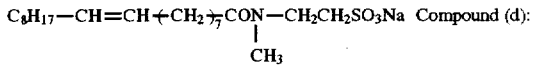

ML:

A coating composition comprising 10 g of gelatin, 4.0%, based on gelatin, of Compound (c), each of the quinone trapping agents shown in Table 3 below, and water to make 250 ml was coated to a gelatin coverage of 1.5 g/m².

OL:

Emulsion A was re-melted at 40° C. and mixed with the following compounds to prepare a coating composition.

| | |
|---|---|
| 5-Methylbenzotriazole | 85 mg/m² |
| 4-Hydroxy-1,3,3a,7-tetraazaindene | $2 \times 10^{-3}$ mol/Agmol |
| Hydrazine nucleating agent (II-5) | $6.7 \times 10^{-5}$ mol/m² |
| Compound (a) | 3 mg/m² |
| Compound (b) | 15 mg/m² |
| Compound (d) | 50 mg/m² |
| Polyethyl acrylate | 30% based on gelatin |
| Compound (c) | 4% based on gelatin |

The resulting coating composition was coated to a silver coverage of 3.4 g/m².

PC:

To a gelatin solution were added a polymethyl methacrylate dispersion (average particle size: 2.5 μm) and the following surface active agents, and the coating composition was coated so as to have a gelatin coverage of 1.5 g/m² and a polymethyl methacrylate coverage of 0.3 g/m².

| Surface Active Agent: | |
|---|---|
| 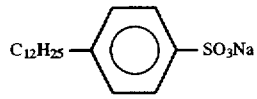 | 37 mg/m² |
| $CH_2COOC_6H_{13}$<br>\|<br>$CHCOOC_6H_{13}$<br>\|<br>$SO_3Na$ | 37 mg/m² |
| $C_8F_{17}SO_2NCH_2COOK$<br>\|<br>$C_3H_7$ | 2.5 mg/m² |

Each of the resulting samples was exposed to light and development-processed in the same manner as in Example 1. The dot quality of the processed sample was observed and rated according to the following system.

5 . . . Best quality

4 . . . Acceptable for practical use

3 . . . Lower limit for practical use

2 . . . Unacceptable for practical use

1 . . . Worst quality

Qualities from 3 to 5 were rated at intervals 0.5. The results obtained are shown in Table 3. It can be seen that the samples according to the present invention exhibit satisfactory dot quality and have a high $D_{max}$.

TABLE 3

| Sample No. | Quinone Trapping Agent Compound No. | Amount (mol/m²) | $D_{max}$* | Dot Quality | Remark |
|---|---|---|---|---|---|
| 401 | — | — | 4.20 | 4.0 | Comparison |
| 402 | VIa-10 | $2.0 \times 10^{-6}$ | 4.83 | 4.5 | Invention |
| 403 | " | $8.0 \times 10^{-6}$ | 5.06 | " | " |
| 404 | VIa-18 | $2.0 \times 10^{-6}$ | 4.95 | " | " |
| 405 | " | $8.0 \times 10^{-6}$ | 5.19 | " | " |
| 406 | VIa-6 | $1.0 \times 10^{-5}$ | 4.51 | " | " |
| 407 | " | $2.0 \times 10^{-5}$ | 4.65 | " | " |

Note: *An optical density at an exposure amount larger than the exposure amount providing a density of 1.5 by 0.5 in terms of logE.

EXAMPLE 4

The following layers UL, ML, OL, and PC were coated in this order on a 150 μm thick polyethylene terephthalate film having a 0.5 μm thick subbing layer comprising a vinylidene chloride copolymer. Compounds (a) to (d) are the same as those Example 3.

UL:

Emulsion A was re-melted at 40° C. and mixed with the following compounds to prepare a coating composition.

| | |
|---|---|
| 5-Methylbenzotriazole | 90 mg/m² |
| 4-Hydroxy-1,3,3a,7-tetraazaindene | $2 \times 10^{-3}$ mol/Agmol |
| Hydraine nucleating agent (II-5) | $8.1 \times 10^{-5}$ mol/m² |
| Compound (a) | 3 mg/m² |
| Compound (b) | 16 mg/m² |
| Compound (d) | 50 mg/m² |
| Polyethyl acrylate | 30 wt % based on gelatin |
| Compound (c) | 4 wt % based on gelatin |

The coating composition was coated to a silver coverage of 3.8 g/m².

OL:

Emulsion C was re-melted with gelatin at 40° C. and mixed with the following compounds.

| | |
|---|---|
| 5-Methylbenzotriazole | 3 mg/m² |
| 4-Hydroxy-1,3,3a,7-tetraazaindene | $2 \times 10^{-3}$ mol/Agmol |
| Redox compound (I-51) | $6.4 \times 10^{5}$ mol/m² |
| Compound (a) | 0.4 mg/m² |
| Compound (b) | 1.5 mg/m² |
| Compound (d) | 15 mg/m² |
| Polyethyl acrylate | 30 wt % based on gelatin |
| Compound (c) | 4 wt % based on gelatin |

The resulting coating composition was coated to a silver coverage of 0.4 g/m² (gelatin coverage: 0.5 g/m²).

ML:

A coating composition having the same formulation as used in ML of Example 3, except for using the quinone trapping agent shown in Table 5 blow, was coated to a gelatin coverage of 2.0 g/m².

PC:

A coating composition having the same formulation as used in PC of Example 3 was coated so as to have a gelatin coverage of 0.5 g/m² and a polymethyl methacrylate coverage of 0.3 g/m².

Each of the resulting samples was exposed to light, devolopment-processed, and evaluated in the same manner as in Example 3. The results obtained are shown in Table 4.

As can be seen from the results in Table 4, the samples according to the present invention exhibited high dot quality and high $D_{max}$. Further, the dot gradation of these samples as determined in the same manner as in Example 1 had a wider range of from 1.35 to 1.50 as compared with those of the samples of Example 3 ranging from 1.30 to 1.40.

TABLE 4

| Sample No. | Quinone Trapping Agent Compound No. | Amount (mol/m²) | $D_{max}$* | Dot Quality | Remark |
|---|---|---|---|---|---|
| 501 | — | — | 3.46 | 4.0 | Comparison |
| 502 | VIa-18 | $1.0 \times 10^{-5}$ | 4.21 | 4.5 | Invention |
| 503 | " | $2.0 \times 10^{-5}$ | 4.50 | 5.0 | " |
| 504 | V-7 | $2.0 \times 10^{-6}$ | 4.10 | " | " |
| 505 | " | $8.0 \times 10^{-6}$ | 4.55 | " | " |
| 506 | III-10 | $2.5 \times 10^{-6}$ | 4.02 | 4.5 | " |
| 507 | " | $7.5 \times 10^{-6}$ | 4.35 | 4.5 | " |

EXAMPLE 5

Light-sensitive materials were prepared in the same manner as in Example 4, except for replacing Emulsion A in UL with Emulsion E.

Each of the resulting samples was exposed, developed, and evaluated in the same manner as in Example 4. The results obtained are shown in Table 5 below. It can be seen that the samples according to the present invention show particularly high $D_{max}$ and high dot quality.

TABLE 5

| Sample No. | Quinone Trapping Agent Compound No. | Amount (mol/m²) | $D_{max}$* | Dot Quality | Remark |
|---|---|---|---|---|---|
| 601 | — | — | 3.46 | 4.0 | Invention |
| 602 | VIa-18 | $1.0 \times 10^{-5}$ | 4.51 | 5.0 | Invention |
| 603 | " | $2.0 \times 10^{-5}$ | 4.83 | " | " |
| 604 | V-7 | $2.0 \times 10^{-6}$ | 4.40 | " | " |
| 605 | " | $8.0 \times 10^{-6}$ | 4.68 | " | " |
| 606 | III-10 | $2.5 \times 10^{-6}$ | 4.29 | " | " |
| 607 | " | $7.5 \times 10^{-6}$ | 4.50 | " | " |

EXAMPLE 6

The following layers UL, ML, OL, and PC were coated in this order on a 150 μm thick polyethylene terephthalate film having a 0.5 μm thick subbing layer comprising a vinylidene chloride copolymer. Compounds (a) to (d) are the same as those used in Example 1.

UL:

Emulsion A was re-melted with gelatin at 40° C. and mixed with the following compounds to prepare a coating composition.

| | |
|---|---|
| 5-Methylbenzotriazole | 3 mg/m² |
| 4-Hydroxy-1,3,3a,7-tetraazaindene | 1.3 mg/m² |
| Compound (a) | 0.4 mg/m² |
| Compound (b) | 1.5 mg/m² |
| Compound (d) | 15.0 mg/m² |
| Polyethyl acrylate | 30 wt % based on gelatin |
| Compound (c) | 4.0 wt % based on gelatin |

The coating composition was coated to a silver coverage of 0.4 g/m² (gelatin coverage: 0.5 g/m²).

ML:

A coating composition comprising 10 g of gelatin, 4.0%, based on gelatin, of Compound (c), and water to make 250 ml was coated to a gelatin coverage of 1.5 g/m².

OL:

Emulsion A was re-melted at 40° C. and mixed with the following compounds to prepare a coating composition.

| | |
|---|---|
| 5-Methylbenzotriazole | 85 mg/m$^2$ |
| 4-Hydroxy-1,3,3a,7-tetraazaindene | $2 \times 10^{-3}$ mol/Agmol |
| Hydrazine nucleating agent (II-5) | $6.7 \times 10^{-5}$ mol/m$^2$ |
| Compound (a) | 3 mg/m$^2$ |
| Compound (b) | 15 mg/m$^2$ |
| Compound (d) | 50 mg/m$^2$ |
| Polyethyl acrylate | 30 wt % based on gelatin |
| Compound (c) | 4 wt % based on gelatin |

The resulting coating composition was coated to a silver coverage of 3.4 g/m$^2$.

PC:

To a gelatin solution were added a polymethyl methacrylate dispersion (average particle size: 2.5 μm) and the following surface active agents, and the coating composition was coated so as to have a gelatin coverage of 1.5 g/m$^2$ and a polymethyl methacrylate coverage of 0.3 g/m$^2$.

| Surface Active Agent: | |
|---|---|
| 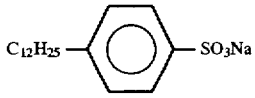 | 37 mg/m$^2$ |
| $CH_2COOC_6H_{13}$<br>\|<br>$CHCOOC_6H_{13}$<br>\|<br>$SO_3Na$ | 37 mg/m$^2$ |
| $C_8F_{17}SO_2N(C_3H_7)CH_2COOK$ | 2.5 mg/m$^2$ |

The thus prepared sample was designated Sample 701.

Samples 702 to 708 were prepared in the same manner as for Sample 701, except that UL further contained a redox compound and an ascorbic acid derivative as shown in Table 6 below.

Each of the resulting samples was exposed to light, development-processed, and evaluated in the same manner as in Example 1. Dot quality was evaluated and rated in the same manner as in Example 3. The results obtained are shown in Table 6. It can be seen from the results in Table 6 that the samples according to the present invention have high G values indicative of markedly high contrast and exhibit a considerably wide range of dot gradation indicative of satisfactory dot quality.

EXAMPLE 7

The following layers UL, ML, OL, and PC were coated in this order on a 150 μm thick polyethylene terephthalate film having a 0.5 μm thick subbing layer comprising a vinylidene chloride copolymer. Compounds (a) to (d) are the same as those used in Example 1.

UL:

Emulsion A was re-melted at 40° C. and mixed with the following compounds to prepare a coating composition.

| | |
|---|---|
| 5-Methylbenzotriazole | 90 mg/m$^2$ |
| 4-Hydroxy-1,3,3a,7-tetraazaindene | $2 \times 10^{-3}$ mol/Agmol |
| Hydrazine nucleating agent (II-5) | $8.1 \times 10^{-5}$ mol/m$^2$ |
| Compound (a) | 3 mg/m$^2$ |
| Compound (b) | 16 mg/m$^2$ |
| Compound (d) | 50 mg/m$^2$ |
| Polyethyl acrylate | 30 wt % based on gelatin |
| Compound (c) | 4 wt % based on gelatin |

The coating composition was coated to a silver coverage of 3.8 g/m$^2$.

ML:

The same coating composition as used for ML of Example 6 was coated to a gelatin coverage of 2.0 g/m$^2$.

OL:

Emulsion B was re-melted with gelatin at 40° C. and mixed with the following compounds to prepare a coating composition.

| | |
|---|---|
| 5-Methylbenzotriazole | 3 mg/m$^2$ |
| 4-Hydroxy-1,3,3a,7-tetraazaindene | $2 \times 10^{-3}$ mol/Agmol |
| Compound (a) | 0.4 mg/m$^2$ |
| Compound (b) | 1.5 mg/m$^2$ |
| Compound (d) | 15 mg/m$^2$ |
| Polyethyl acrylate | 30 wt % based on gelatin |
| Compound (c) | 4 wt % based on gelatin |

The resulting coating composition was coated to a silver coverage of 0.4 g/m$^2$ (gelatin coverage of 0.5 g/m$^2$).

PC:

A coating composition having the same formulation as used in PC of Example 6 was coated so as to have a gelatin coverage of 0.5 g/m$^2$ and a polymethyl methacrylate coverage of 0.3 g/m$^2$.

The thus prepared sample was designated Sample 801.

Samples 802 to 808 were prepared in the same manner as for Sample 801, except that OL further contained a redox compound and an ascorbic acid derivative as shown in Table 7 below.

Each of the resulting samples was exposed to light, development-processed, and evaluated in the same manner

TABLE 6

| | Redox Compound | | Ascorbic Acid Derivative | | | | | |
|---|---|---|---|---|---|---|---|---|
| Sample No. | Kind | Amount (mol/m$^2$) | Kind | Amount (mol/m$^2$) | G | Dot Gradation | Quality | Remark |
| 701 | — | — | — | — | 10.2 | 1.18 | 3 | Comparison |
| 702 | I-29 | $8.0 \times 10^{-5}$ | — | — | 10.4 | 1.30 | 4.0 | " |
| 703 | I-51 | $6.4 \times 10^{-5}$ | — | — | 10.8 | 4.29 | 4.0 | " |
| 704 | I-29 | $8.0 \times 10^{-5}$ | XI-1 | $1.7 \times 10^{-5}$ | 11.7 | 1.35 | 5 | Invention |
| 705 | I-51 | $6.4 \times 10^{-5}$ | " | " | 11.8 | 1.39 | 5 | " |
| 706 | " | " | " | $3.5 \times 10^{-5}$ | 12.4 | 1.42 | 5 | " |
| 707 | " | " | XI-4 | " | 12.8 | 1.32 | 4.5 | " |
| 708 | " | " | XI-5 | " | 12.6 | 1.36 | 4.5 | " |

as in Example 6. The results obtained are shown in Table 7. It can be seen from the results in Table 7 that the samples according to the present invention have high G values indicative of markedly high contrast and exhibit a considerably wide range of dot gradation indicative of satisfactory dot quality.

TABLE 7

| | Redox Compound | | Ascorbic Acid Derivative | | | | | |
|---|---|---|---|---|---|---|---|---|
| Sample No. | Kind | Amount (mol/m$^2$) | Kind | Amount (mol/m$^2$) | G | Dot Gradation | Dot Quality | Remark |
| 801 | — | — | — | — | 10.3 | 1.19 | 3 | Comparison |
| 802 | I-38 | $8 \times 10^{-5}$ | — | — | 10.5 | 1.24 | 4.0 | " |
| 803 | I-51 | $5.1 \times 10^{-5}$ | — | — | 10.6 | 1.26 | 4.0 | " |
| 804 | " | " | XI-1 | $5 \times 10^{-5}$ | 12.5 | 1.40 | 5 | Invention |
| 805 | " | " | XI-2 | " | 12.4 | 1.38 | 5 | " |
| 806 | " | " | XI-4 | $1.2 \times 10^{-5}$ | 12.8 | 1.30 | 4.5 | " |
| 807 | " | " | XI-5 | $3.7 \times 10^{-5}$ | 12.5 | 1.33 | 4.5 | " |
| 808 | " | " | XI-7 | $1.5 \times 10^{-5}$ | 12.7 | 1.33 | 4.5 | " |

EXAMPLE 8

A light-sensitive material was prepared in the same manner as for Sample 801 of Example 7, except for replacing Emulsion A in UL with Emulsion D and replacing Emulsion B in OL with Emulsion C. The resulting sample was designated Sample 901.

Samples 902 to 909 were prepared in the same manner as for Sample 901, except for replacing $8.1\times10^{-5}$ mol/m$^2$ of the hydrazine nucleating agent (II-5) with $5.0\times10^{-5}$ mol/m$^2$ of (II-5) and $1.0\times10^{-5}$ mol/m$^2$ of (II-19) and adding a redox compound and an ascorbic acid derivative to OL as shown in Table 9 below.

Each of the resulting samples was exposed, developed, and evaluated in the same manner as in Example 6. The results obtained are shown in Table 8 below. It can be seen that the samples according to the present invention have particularly high G values and considerably broad dot gradation, indicating satisfactory dot quality.

TABLE 8

| | Redox Compound | | Ascorbic Acid Derivative | | | | | |
|---|---|---|---|---|---|---|---|---|
| Sample No. | Kind | Amount (mol/m$^2$) | Kind | Amount (mol/m$^2$) | G | Dot Gradation | Dot Quality | Remark |
| 901 | — | — | — | — | 11.2 | 1.21 | 3.5 | Comparison |
| 902 | I-38 | $4.3 \times 10^{-5}$ | — | — | 11.4 | 1.31 | 4 | " |
| 903 | I-51 | $6.4 \times 10^{-5}$ | — | — | 11.4 | 1.33 | 4 | " |
| 904 | I-38 | $4.3 \times 10^{-5}$ | X-1 | $2.2 \times 10^{-5}$ | 13.1 | 1.41 | 5 | Invention |
| 905 | I-51 | $6.4 \times 10^{-5}$ | " | $3.2 \times 10^{-5}$ | 13.6 | 1.44 | 5 | " |
| 906 | " | " | " | $6.4 \times 10^{-5}$ | 13.5 | 1.45 | 5 | " |
| 907 | " | " | X-2 | $6.4 \times 10^{-5}$ | 13.2 | 1.43 | 5 | " |
| 908 | " | " | X-4 | $1.3 \times 10^{-5}$ | 13.8 | 1.38 | 4.5 | " |
| 909 | " | " | X-5 | $3.2 \times 10^{-5}$ | 13.8 | 1.40 | 4.5 | " |

EXAMPLE 9

A light-sensitive material was prepared in the same manner as in Example 8, except for replacing the sensitizing dye S-1 in UL with S-3 shown below and replacing the sensitizing dye S-1 in OL with S-4 shown below.

When the resulting sample was exposed, developed, and evaluated in the same manner as in Example 8, it exhibited satisfactory performance properties as observed in Example 8.

S-3:

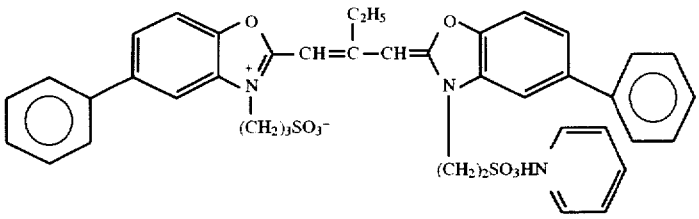

S-4:

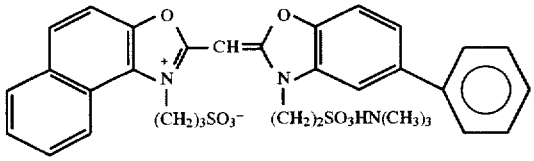

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising on a film support a plurality of light-sensitive silver halide emulsion layers, wherein (A) at least one of said light-sensitive silver halide emulsion layers contains a hydrazine nucleating agent represented by formula (II):

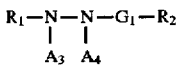

(II)

wherein $R_1$ represents an aliphatic group or an aromatic group; $R_2$ represents a hydrogen atom, an alkyl group, an aryl group, an alkoxy group, an aryloxy group, an amino group, a hydrazino group, a carbamoyl group, or an oxycarbonyl group; $G_1$ represents a carbonyl group, a sulfonyl group, a sulfoxy group,

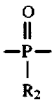

(wherein $R_2$ is as defined above),

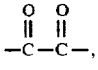

a thiocarbonyl group, or an iminomethylene group; and $A_3$ and $A_4$ each represents a hydrogen atom, a substituted or unsubstituted alkylsulfonyl group, a substituted or unsubstituted arylsulfonyl group, or a substituted or unsubstituted acyl group, provided that at least one of $A_3$ and $A_4$ is a hydrogen atom, and (B) a light-sensitive silver halide emulsion layer other than said layer containing said hydrazine nucleating agent contains, (i) a redox compound capable of releasing a development inhibitor when said redox compound is oxidized, wherein said redox compound is represented by formula (I):

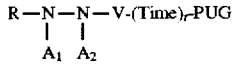

(I)

wherein $A_1$ and $A_2$ each represents a hydrogen atom, a sulfinic acid residue,

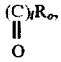

wherein $R_0$ represents an alkyl group, an alkenyl group, an aryl group, an alkoxy group, or an aryloxy group and l represents 1 or 2, or an unsubstituted acyl group, provided that at least one of $A_1$ and $A_2$ is a hydrogen atom; Time represents a divalent linking group containing a hetero atom and is linked to V through said hetero atom; t represents 0 or 1; PUG represents a residue of a development inhibitor; and V represents a carbonyl group,

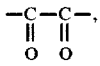

a sulfonyl group, a sulfoxy group, an iminomethylene group, a thiocarbonyl group, or

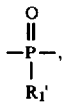

wherein $R_1$, represents an alkoxy group or an aryloxy group; R represents an aliphatic group, an aromatic group, or a heterocyclic group; and (ii) a quinone trapping agent in an amount of $1\times10^{-5}$ to $5\times10^{-2}$ mol per mol of silver halide.

2. A silver halide photographic material comprising on a film support a plurality of light-sensitive silver halide emulsion layers, wherein (A) at least one of said light-sensitive silver halide emulsion layers contains a hydrazine nucleating agent represented by formula (II):

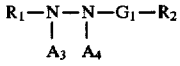

(II)

wherein $R_1$ represents an aliphatic group or an aromatic group; $R_2$ represents a hydrogen atom, an alkyl group, an aryl group, an alkoxy group, an aryloxy group, an amino group, a hydrazino group, a carbamoyl group, or an oxycarbonyl group; $G_1$ represents a carbonyl group, a sulfonyl group, a sulfoxy group, $$-\overset{\overset{\displaystyle O}{\|}}{\underset{\underset{\displaystyle R_2}{|}}{P}}-$$

(wherein $R_2$ is as defined above), $$-\overset{\overset{\displaystyle O}{\|}}{C}-\overset{\overset{\displaystyle O}{\|}}{C}-,$$

a thiocarbonyl group, or an iminomethylene group; and $A_3$ and $A_4$ each represents a hydrogen atom, a substituted or unsubstituted alkylsulfonyl group, a substituted or unsubstituted arylsulfonyl group, or a substituted or unsubstituted acyl group, provided that at least one of $A_3$ and $A_4$ is a hydrogen atom, (B) a light-sensitive silver halide emulsion layer other than said layer containing said hydrazine nucleating agent contains a redox compound capable of releasing a development inhibitor when said redox compound is oxidized, wherein said redox compound is represented by formula (I):

$$R-\underset{\underset{\displaystyle A_1}{|}}{N}-\underset{\underset{\displaystyle A_2}{|}}{N}-V\text{-}(Time)_t\text{-}PUG \qquad (I)$$

wherein $A_1$ and $A_2$ each represents a hydrogen atom, a sulfinic acid residue, $$\overset{\overset{\displaystyle O}{\|}}{(C)_l}R_o,$$

wherein $R_O$ represents an alkyl group, an alkenyl group, an aryl group, an alkoxy group, or an aryloxy group and l represents 1 or 2, or an unsubstituted acyl group, provided that at least one of $A_1$ and $A_2$ is a hydrogen atom; Time represents a divalent linking group containing a hetero atom and is linked to V through said hetero atom; t represents 0 or 1; PUG represents a residue of a development inhibitor; and V represents a carbonyl group, $$-\overset{\overset{\displaystyle O}{\|}}{C}-\overset{\overset{\displaystyle O}{\|}}{C}-,$$

a sulfonyl group, a sulfoxy group, an iminomethylene group, a thiocarbonyl group, $$-\overset{\overset{\displaystyle O}{\|}}{\underset{\underset{\displaystyle R_1'}{|}}{P}}-,$$

wherein $R_1$, represents an alkoxy group or an aryloxy group; R represents an aliphatic group, an aromatic group, or a heterocyclic group; and (C) a light-insensitive layer, positioned between (i) said light-sensitive silver halide emulsion layer containing a hydrazine nucleating agent and (ii) said light-sensitive silver halide emulsion layer containing a redox compound, contains a quinone trapping agent in an amount of $1\times10^{-5}$ to $5\times10^{-2}$ mol per mol of silver halide.

* * * * *